US011105160B2

(12) United States Patent
Leismer et al.

(10) Patent No.: US 11,105,160 B2
(45) Date of Patent: Aug. 31, 2021

(54) LOW PROFILE, PRESSURE BALANCED, OIL EXPANSION COMPENSATED DOWNHOLE ELECTRICAL CONNECTOR SYSTEM

(71) Applicant: ACCESSESP UK LIMITED, Staines (GB)

(72) Inventors: Dwayne Leismer, Houston, TX (US); Andras Bencze, Morden (GB); Rogelio Cantu, Houston, TX (US); Matthew Paul Benham, Houston, TX (US)

(73) Assignee: ACCESSESP UK LIMITED, Great Yarmouth (GB)

( * ) Notice: Subject to any disclaimer, the term of this patent is extended or adjusted under 35 U.S.C. 154(b) by 0 days.

(21) Appl. No.: 15/408,336

(22) Filed: Jan. 17, 2017

(65) Prior Publication Data

US 2017/0204680 A1 Jul. 20, 2017

Related U.S. Application Data

(60) Provisional application No. 62/279,757, filed on Jan. 16, 2016.

(51) Int. Cl.
*E21B 17/02* (2006.01)
*E21B 43/12* (2006.01)
(Continued)

(52) U.S. Cl.
CPC ..... *E21B 17/028* (2013.01); *E21B 17/003* (2013.01); *E21B 17/042* (2013.01); *E21B 43/128* (2013.01); *H01R 13/005* (2013.01); *H01R 13/5219* (2013.01); *H01R 13/533* (2013.01)

(58) Field of Classification Search
CPC .... E21B 17/028; E21B 17/026; E21B 43/128; H01R 13/005
See application file for complete search history.

(56) References Cited

U.S. PATENT DOCUMENTS 3,980,369 A * 9/1976 Panek ..... E21B 17/028 439/204
7,611,339 B2 11/2009 Tetzlaff et al.
(Continued)

FOREIGN PATENT DOCUMENTS

GB 2504301 1/2014
WO 2010078326 7/2010

OTHER PUBLICATIONS

Schlumberger Glossary "annulus" definition. Available at: http://www.glossary.oilfield.slb.com/Terms/a/annulus.aspx.*
(Continued)

*Primary Examiner* — Blake E Michener
*Assistant Examiner* — Theodore N Yao
(74) *Attorney, Agent, or Firm* — Gordon G. Waggett, P.C.

(57) ABSTRACT

The present invention is directed to fluid compensated downhole connectors and connection systems employing an intensified dielectric fluid compensation. Also disclosed is a permanent downhole fluid compensated electrical connector assembly employing an intensified dielectric fluid compensation. The present disclosure is also directed to a field bypass connector system for a downhole completion tool, such as a packer, and a retrievable wet connect system also employing intensified dielectric fluid compensation.

24 Claims, 47 Drawing Sheets

(51) Int. Cl.

| | |
|---|---|
| ***E21B 17/00*** | (2006.01) |
| ***E21B 17/04*** | (2006.01) |
| ***H01R 13/00*** | (2006.01) |
| ***H01R 13/52*** | (2006.01) |
| ***H01R 13/53*** | (2006.01) |
| ***E21B 17/042*** | (2006.01) |
| ***H01R 13/533*** | (2006.01) |

(56) References Cited

U.S. PATENT DOCUMENTS

| | | | | |
|---|---|---|---|---|
| 8,113,273 | B2 | 2/2012 | Manke et al. | |
| 8,664,817 | B2 | 3/2014 | Rumbaugh et al. | |
| 8,692,115 | B2 | 4/2014 | Rumbaugh et al. | |
| 8,919,432 | B1 | 12/2014 | Tetzlaff et al. | |
| 8,931,552 | B2 | 1/2015 | Head | |
| 8,950,476 | B2 | 2/2015 | Head | |
| 8,985,226 | B2 | 3/2015 | Head | |
| 9,028,264 | B2 | 5/2015 | Head | |
| 9,054,615 | B2 | 6/2015 | Head et al. | |
| 2002/0129945 | A1 | 9/2002 | Brewer et al. | |
| 2002/0192090 | A1* | 12/2002 | Du | E21B 43/128 417/423.11 |
| 2005/0016769 | A1* | 1/2005 | Wallace | H01R 13/523 175/40 |
| 2007/0284117 | A1* | 12/2007 | Smithson | E21B 17/023 166/385 |
| 2012/0312528 | A1* | 12/2012 | Rayssiguier | E21B 17/026 166/244.1 |
| 2013/0040480 | A1* | 2/2013 | Frey | F04B 47/06 439/199 |
| 2014/0030904 | A1* | 1/2014 | Head | H01R 13/00 439/283 |
| 2015/0354328 | A1 | 12/2015 | Jenisch et al. | |

OTHER PUBLICATIONS

Bladder definition available from: https://www.lexico.com/en/definition/bladder (Year: 2020).*

PCT/ISA—PCT Search Report, Written Opinion and transmittal in counterpart application PCT/IB2017/000050 dated May 12, 2017, 11 pages.

* cited by examiner

STEP 1

STEP 2

STEP 3

WITHOUT FLUID

WITH FLUID

STEP 4

STEP 5

STEP 6

LOW PROFILE, PRESSURE BALANCED, OIL EXPANSION COMPENSATED DOWNHOLE ELECTRICAL CONNECTOR SYSTEM

CROSS-REFERENCE TO RELATED APPLICATIONS

This application claims the benefit of the filing date of and priority to: U.S. Provisional Application Ser. No. 62/279,757 entitled "Low Profile, Pressure Balanced, Oil Expansion Compensated Downhole Electrical Connector System" and filed Jan. 16, 2016, Confirmation No. 3594; said provisional application is incorporated by reference herein in its entirety for all purposes.

STATEMENT REGARDING FEDERALLY SPONSORED RESEARCH OR DEVELOPMENT

Not Applicable.

BACKGROUND OF THE INVENTION

The present disclosure relates generally to permanent downhole electrical connector systems installed onto a permanent completion use, e.g., with ESP applications. The present disclosure also relates generally to retrievable wet connector systems used in a downhole environment for, e.g., ESP applications. In one aspect, this present disclosure pertains to a fluid compensated connector system for use in permanent completions. In another embodiment, the disclosure pertains to fluid compensated connector systems for use in retrievable wet connector systems.

ESP systems require connection to an electric power supply, which drives the motor (not specific to motor type). Conventional ESPs typically use electrical connectors that are assembled manually—these are simple plug and socket type connections, which must be fitted in a controlled environment.

In a typical ESP application (tubing deployed ESP), the electrical power is supplied to the electric motor from the surface VSD via an ESP cable. The ESP cable is installed onto the production tubing during the ESP installation and it is normally terminated in a MLE (motor lead extension) which incorporates a pothead. The pothead then is connected to the motor during the installation.

Typically a male/female connector is employed that enables the connection between power supply and ESP to be made-up remotely, so that it is operable in the harsh conditions of an oil-well, where high pressures and temperatures are present, and the fluid filled environment may be corrosive. The female connector is of interest here (plug-head—also described in an earlier patent). Inside this connector are voids around seals, electrodes and wires, so dielectric fluid/oil is used to fill these volumes, which is essential to preventing electrical breakdown due to high voltage differentials. The dielectric oil is also the medium for pressure compensation, without which the connector could be damaged by high pressure differentials.

Hydrostatic pressure in fluids externally, and thermal expansion of fluid internally are two primary sources of pressure differentials; in addition pressure transients are a normal effect of ESP activity, creating smaller but rapidly changing pressure differentials; lastly well interventions may directly or indirectly change the hydrostatic pressure differential around the connector.

With the retrievable ESP system, the ESP cable is installed onto the production tubing and the permanent completion and it is connected to the permanent downhole wet connector (fixed end). The power is then transferred to the motor through the retrievable mating wet connector (plug head) when this is deployed and connected to the downhole wet connector.

BRIEF SUMMARY OF THE INVENTION

In one embodiment, the invention described herein is a permanent downhole electrical connector system comprised of a downhole wet connector (fixed end—described in an earlier patent), steel tubing enclosed power cables, a low-profile three phase field connector (receptacle) and the field attachable PLE (power lead extension including the low profile three phase field connector plug). Variants on the form factor provide a simple solution to address specific applications as well. This system is factory filled with dielectric oil and includes an automatic pressure balance and expansion compensator system.

In another embodiment, the invention described here includes the integration of a pressure compensator device, into an electrical connector, to eliminate the effects of static and dynamic pressure differentials that may result in a loss of dielectric oil, or ingress of well-bore fluids; thus preventing premature failure from electrical discharge. The device creates a means by which the internal oil volume of the connector can accommodate expansion and contraction due to temperature changes, maintaining internal pressure within safe operating limits.

In one embodiment, the device is also designed such that the internal pressure is always greater than external pressure by 7-14 psi, so that well-bore fluids do not ingress when the connector is mated in a fluid filled environment. These functions are primarily achieved in the construction of the device, which uses edge welded bellows, manufactured from corrosion resistant alloys. Low inertia and zero friction actuation enable the device to immediately respond to any changes in the environmental conditions. Within the connector housing small pistons are also used to provide individual pressure compensation around specialist sliding seals. These small pistons can be connected on the back-side to the primary device in order to maintain separation with external fluids.

The protection afforded by this device is used with both manually assembled bulkhead electrical connections, and remotely connected plug and socket electrical connectors (fixed-end and plug-head described in an earlier patent).

In another embodiment, there is disclosed a fluid compensated downhole connection system comprising: (a) at least one connector housing having an inside chamber; (b) one or more electrical conduits having an internal annular space surrounding an electrical wire/cable, a first conduit end and a second conduit end, the first conduit end being connected to the housing, wherein the conduit annular space is in fluid communication with the housing inside chamber, the conduit annular space and housing inside chamber defining a fluid flow path; (c) a dielectric fluid port in fluid communication with the inside chamber for introducing a dielectric fluid into the fluid path, the dielectric fluid creating an internal fluid pressure; and (d) a bellows having first and second ends, and an interior annular chamber, the first bellows end being connected to the connector housing in fluid communication with the housing inside chamber, the bellows second end being exposed to downhole wellbore fluid pressure and capable of reacting to the wellbore pressure to cause the bellows to provide a compensating adjustment to the internal fluid pressure. This fluid compensated downhole connection system can also further comprise the use of check valves.

In one embodiment, the fluid compensated downhole connection system is installed in a retrievable wet connect system. In this embodiment, the retrievable wet connect system comprises: (a) a tubular member having a first threaded end, a second threaded end, and an inner annulus in fluid communication with the wellbore fluid pressure; (b) the tubular member first end further comprising a high pressure bulkhead electrical connector capable of permitting the introduction of electrical signals from a surface cable into each of the respective electrical cables in a first of the at least one connector housing, (c) the tubular member second end comprising a threaded connection; and (d) a female wet connect assembly located proximate the tubular member second end, the wet connect assembly comprising a wet connect housing having an internal chamber; the second conduit end being connected to the wet connect housing, wherein the conduit annular space is in fluid communication with the housing inside chamber and the wet connect internal chamber, the conduit annular space, housing inside chamber and wet connect housing internal chamber defining the fluid flow path; female electrical sockets mounted to an end of the wet connect housing and being capable of receiving pin-style male connectors to permit transmission of electrical signals through the connection system to another section of wellbore tubing; the wet connect sockets having electrically insulated electrical contacts located within the wet connect housing Another embodiment pertains to a permanent downhole fluid compensated electrical connector assembly comprising: (1) a field connector receptacle at a first assembly end, the receptacle having a housing with a first internal chamber; (b) a wet connector receptacle at a second assembly end, the wet connector having a housing with a second internal chamber; (c) one or more electrical conduits having an internal annular space surrounding an electrical wire/cable, a first conduit end and a second conduit end, the first conduit end being connected to the receptacle housing, the second conduit end being connected to the wet connector housing, wherein the conduit annular space, first internal chamber and second internal chamber are in fluid communication with each other, the conduit annular space, first internal chamber and second internal chamber defining a fluid flow path; (d) a dielectric fluid port in fluid communication with the inside chamber for introducing a dielectric fluid into the fluid path, the dielectric fluid creating an internal fluid pressure; and (e) a bellows having first and second ends, and an interior annular chamber, the first bellows end being connected the wet connector receptacle, the bellows second end being exposed to downhole wellbore fluid pressure and capable of reacting to the wellbore pressure to cause the bellows to provide a compensating adjustment to the internal fluid pressure. In one embodiment, this permanent downhole electrical connector assembly is installed in a permanent completion portion of production tubing. In another embodiment, the permanent downhole electrical connector assembly further comprises a separate bellows for each of the one or more electrical conduits.

Yet another embodiment discloses a field bypass connector system for a downhole completion tool comprising: (a) a downhole completion tool mountable on a production tubular member, the completion equipment having an internal feedthrough passage; (b) a clamp-type field connector plug mounted on the tubular member at a position along the tubular member in the direction uphole from the completion tool, the plug having a housing with a first internal chamber, the position of the clamp-type field connector plug being axially and rotationally adjustable when being mounted on the tubular member; (c) a clamp-type field connector receptacle mounted on the tubular member at a position along the tubular member in the direction downhole from the completion tool, the receptacle having a housing with a second internal chamber, the position of the clamp-type field connector receptacle being axially and rotationally adjustable when being mounted on the tubular member; (d) one or more electrical conduits having an internal annular space surrounding an electrical wire/cable, a first conduit end and a second conduit end, the first conduit end being connected to the connector plug, the second conduit end being connected to the connector receptacle, the one or more conduits passing through the feedthrough passage, wherein the conduit annular space, first internal chamber and second internal chamber are in fluid communication with each other, the conduit annular space, first internal chamber and second internal chamber defining a fluid flow path; (e) a dielectric fluid port in fluid communication with the inside chamber for introducing a dielectric fluid into the fluid path, the dielectric fluid creating an internal fluid pressure; and (f) a bellows having first and second ends, and an interior annular chamber, the first bellows end being connected to the connector housing in fluid communication with the housing inside chamber, the bellows second end being exposed to downhole wellbore fluid pressure and capable of reacting to the wellbore pressure to cause the bellows to provide a compensating adjustment to the internal fluid pressure. In one embodiment, of the field bypass connector system, the completion tool is a packer.

In another embodiment there is disclosed a field bypass connector system for a downhole completion tool comprising: (1) a downhole completion tool mountable on a production tubular member, the completion equipment having an internal feedthrough passage; (2) a clamp-type field connector plug mounted on the tubular member at a position along the tubular member in the direction uphole from the completion tool, the plug having a housing with a first internal chamber, the position of the clamp-type field connector plug being axially and rotationally adjustable when being mounted on the tubular member; (3) a clamp-type field connector receptacle mounted on the tubular member at a position along the tubular member in the direction downhole from the completion tool, the receptacle having a housing with a second internal chamber, the position of the clamp-type field connector receptacle being axially and rotationally adjustable when being mounted on the tubular member; (4) one or more electrical conduits having a first conduit end and a second conduit end, the first conduit end being connected to the connector plug, the second conduit end being connected to the connector receptacle, the one or more conduits passing through the feedthrough passage; (5) a first dielectric fluid port in fluid communication with the first internal chamber for introducing a dielectric fluid into the first chamber, the dielectric fluid creating an internal fluid pressure; and (6) a second dielectric fluid port in fluid communication with the second internal chamber for introducing a dielectric fluid into the second chamber, the dielectric fluid creating an internal fluid pressure. In one embodiment, the field bypass connector system, the one or more electrical conduits have an internal annular space surrounding an electrical wire/cable, and wherein the conduit annular space, first internal chamber and second internal chamber are in fluid communication with each other, the conduit annular space, first internal chamber and second internal chamber defining a fluid flow path; and a bellows having first and second ends, and an interior annular chamber, the first bellows end being connected to the connector housing in fluid communication with the housing inside chamber, the bellows second end being exposed to downhole wellbore fluid pressure and capable of reacting to the wellbore pressure to cause the bellows to provide a compensating adjustment to the internal fluid pressure.

DETAILED DESCRIPTION OF THE INVENTION

Figure 1:
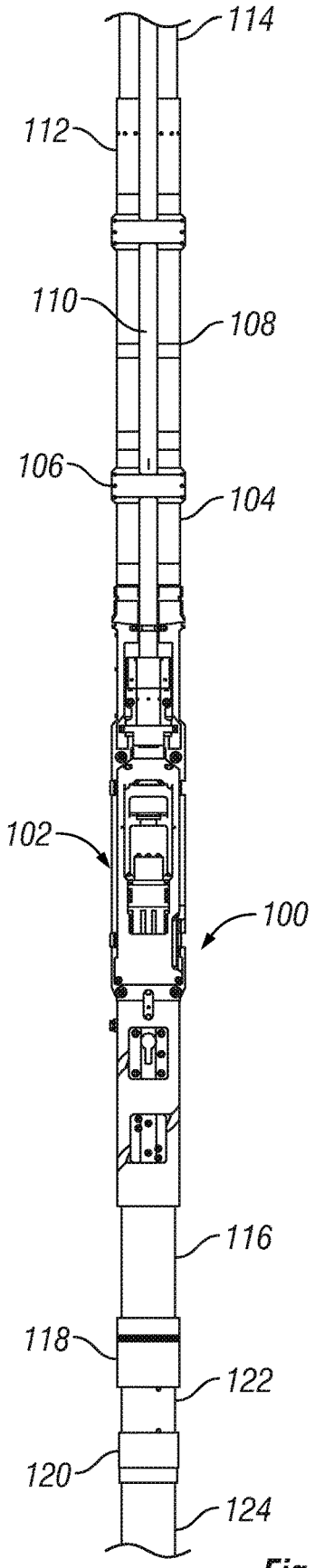
FIG. 1 is a plan view of a partial length of the permanent completion portion of a production tubing assembly according to an embodiment of the present disclosure.

Reference is now made to the drawings which depict preferred embodiments, but are not drawn to scale.

The power lead extension or PLE is comprised of a flat ESP cable (usually #4 or #2 AWG) with a length of up to 200 ft. and the low profile field connector also called the plug (similar in function to a pothead). The length of the cable allows for the field splice to the surface ESP cable (round or flat) to be performed on the production tubing (4.5" OD) above the permanent completion (5.5" OD). This is ever so important due to the space constraints when the permanent completion is installed in 7" casing. In case of a production packer installed on the tubing above the permanent completion, the cable length can be extended such that the PLE is spliced into the packer penetrator thus eliminating the need for an additional splice below the packer.

The ESP cable of the PLE can be replaced with tubing encapsulated power cable (TEPC) and the low-profile three-phase field connector can be converted to accept the tubing encapsulated power leads. The free end of the tubing enclosed cable can pass through the packer (similar to a packer penetrator) and it can be terminated onto the surface ESP cable above the packer. In this configuration, the power conductors below the packer are completely isolated from the well bore fluid. This will extend the life of the electrical conductors in extreme harsh downhole environments.

The female low-profile three-phase field connector (the plug) can also be factory installed directly onto a surface flat ESP cable with lengths up to 10,000 ft. With this option, there is no need for a PLE, thus eliminating any field splice in the string (to be used only when no production packer is installed).

The male low-profile three-phase field connector (the receptacle) is part of the permanent downhole wet connector system. It is permanently mounted onto the ⅜" steel tubes which are connected to the wet mate. Each of the three power leads from the fixed end is routed through the steel tubes into the receptacle and is terminated in the electrical contact pins. This connector provides the interface to the PLE.

The permanent downhole connector system is factory pre-filled with dielectric oil prior to installation onto the permanent completion. The dielectric oil fills the internal cavities of the rear section of the wet mate (where the power leads terminate into the fixed-end electrodes), the annular space between the ID of the steel tube and the OD of the power lead inside the tube, and the cavities inside the receptacle up to the check valves on each pin contact.

In downhole applications, it is highly desirable to ensure the dielectric fluid inside the equipment is at the same pressure as or higher than the well bore media (usually the hydrostatic pressure). In addition to this, it must also allow for the dielectric oil expansion due to the elevated downhole temperatures. Majority of downhole applications utilize flexible polymer bladder systems. The novelty for the present permanent downhole wet connector pressure balance and oil compensation system is the use of fully sealed metallic flexible edge welded bellows. The steel bellows unit acts as an accumulator and as an expansion compensator for the dielectric oil. This assembly is permanently connected to the wet mate body. The dielectric oil within the bellows unit communicates with the oil inside the permanent downhole connector system. As the tool is deployed into the well, the hydrostatic pressure and the temperature steadily increase until the system reaches the desired depth. The hydrostatic pressure acting on the flexible bellows is transferred over to the incompressible dielectric fluid inside the equipment due to the flexible bellows expansion and the pressure balance is achieved. At the same time, the temperature rise in the well causes the dielectric oil to expand, such that the bellows are forced to compress due to the increase in the oil volume in the system. The compression of the bellows causes the pressure of the dielectric fluid to be raised due to the residual spring force of the steel bellows. Depending on the well bore temperature and the amount of the dielectric oil expansion, the internal pressure could be up to 15 PSI higher than the hydrostatic pressure of the well bore fluid. This is advantageous as the polymer seals used in the downhole connector system are pressurized from the inside and become positively energized, thus providing a more reliable and durable seal.

The bellows compensator is factory pre-set with additional oil volume. When additional oil volume is used, the bellows will be compressed in a controlled manner, thus the dielectric oil pressure will be maintained higher than the ambient pressure.

The PLE male connector (the plug) is not factory prefilled with dielectric oil. The oil fill of the plug takes place when it is connected to the receptacle. During the field connection of the plug, normally closed check valves built into the receptacle are actuated, which opens the flow path for the dielectric oil in the downhole permanent connector system to be transferred into the PLE plug until most of the air voids in the plug are filled with oil. The higher internal pressure will force the oil into the plug until the pressure balance due to the oil volume change in the accumulator is achieved. When the plug is removed, the check valves return to their closed position and prevent the oil from draining from the permanent downhole electrical connector system. Using this check valve arrangement and the pre-set oil volume in the bellows, it is possible to connect and disconnect the PLE several times during the permanent completion installation, or in case the equipment must be retrieved from the well and the PLE must be replaced. The number of connections is limited by the pre-set volume of oil inside the metal bellows accumulator/compensator, as a small volume of oil is lost at each connection.

Elastomeric seals (O-rings) are only used on the wet mate electrodes and in the low-profile three-phase connector (the receptacle). Some of these O-rings act as the primary seals between the dielectric fluid and the well bore media, whereas others are only used for the check valve arrangement in the receptacle.

Metal-to-metal seals are utilized in the permanent downhole connector system to seal on the steel tubes. These seals can be industry standard metal-to-metal seals, using NPT threads and tube fittings, or specially designed metal-to-metal seals to replace the NPT connections.

The permanent downhole electrical connector system components in contact with the well bore media are manufactured from corrosion resistant nickel alloys to ensure extended operating life even in the harshest well environments. The polymer seals exposed to the well bore fluid are made from high temperature and extremely chemical resistant elastomers (FFKM grades). These seals can be replaced with a more specific compound depending on the environment of the well on which the connector is to be installed.

Features of the present permanent downhole electrical connector system invention include:

Low profile, compact connector system design for use with the permanent completion in 7"-29# casing or larger Tubing enclosed power cables from the wet mate to the receptacle.

Metal-to-metal seals on the tubing.

Field-testable metal-to-metal seals of the non NPT seal configuration.

Pressure balanced and oil expansion compensated system using steel bellows accumulator/compensator.

Positive internal pressure maintained due to the metal bellows residual spring force.

Elastomeric sealing element protection from high pressure differential.

Manufactured from corrosion resistant alloys and chemically resistant elastomers.

Extended operating life due to the combination of design and material selection.

Easily configurable PLE to be used with ESP cables or production packer penetrators.

Easily convertible field connector to be used with tubing encapsulated power cable.

Prevents dielectric oil drainage due to the integrated check valve design.

Factory installed downhole permanent connector onto the permanent completion.

Simple plug and play, effective field connection of the PLE.

Multiple PLE field connections allowable.

Maximizes completion flexibility.

Flexible low-profile design for use in specific applications.

Ability to run through packer without any splicing.

Features of the pressure compensator for use with dielectric fluid filled electrical connections includes:

Typically used for high power electrical connections

Enables automated equipment connection in harsh environments, including high pressure, high temperature corrosive fluids Provides fluid volume compensation, used with passive bulkhead and active socket & pin electrical connections Prevents pressure differentials across static and dynamic sealing elements Develops positive pressure inside electrical connector housing Maintains internal pressure within safe operating limits Creates isolation of internal dielectric fluid from external wellbore fluid Connector includes specialist elastomer seals, which are resistant to well bore fluids at a wide range of temperatures and pressures All components of connector housing manufactured from corrosion resistant alloys Reference is now further made to the figures to illustrate embodiments of the present disclosure.

FIG. 1 illustrates a portion of a production tubing string assembly 100 comprising upper production tubing section 114 which leads to surface (not shown) and a lower production tubing section 124. This is a general view of a typical production tubing installation 100 of the permanent completion section of a retrievable ESP system. Production tubing 100 further comprises an ACP section 102 connected between the upper and lower production tubing strings (114, 124). The ACP 102 annular connection port top level assembly employs side pocket style wet connector system. An ESP cable 110 runs down the production tubing assembly 100 from the surface to the ACP. The ESP cable 110 could be any style cable known in the art, including one or more individually protected cable or cables embedded within a cable housing. A gas venting coupling 112 is employed to allow gas build-up from ESP system to escape to annulus. A shroud joint 104 is provided for retrievable components of a retrievable ESP system. A cable protector split clamp 106 is provided to fix and protect ESP and other cables going down the assembly. A centralizer coupling 108 is shown. A spacer joint 116 is shown to provide spacing for a B-profile coupling 118, a coupling with an internal B-profile to release the alignment pin on a retrievable system. A no-go coupling 120 is shown, and serves as a coupling with an undersized ID to provide a hard-stop for depth indication. Another spacer joint 122 spaces the no-go coupling 120 from the B-profile coupling 118.

Figure 2:
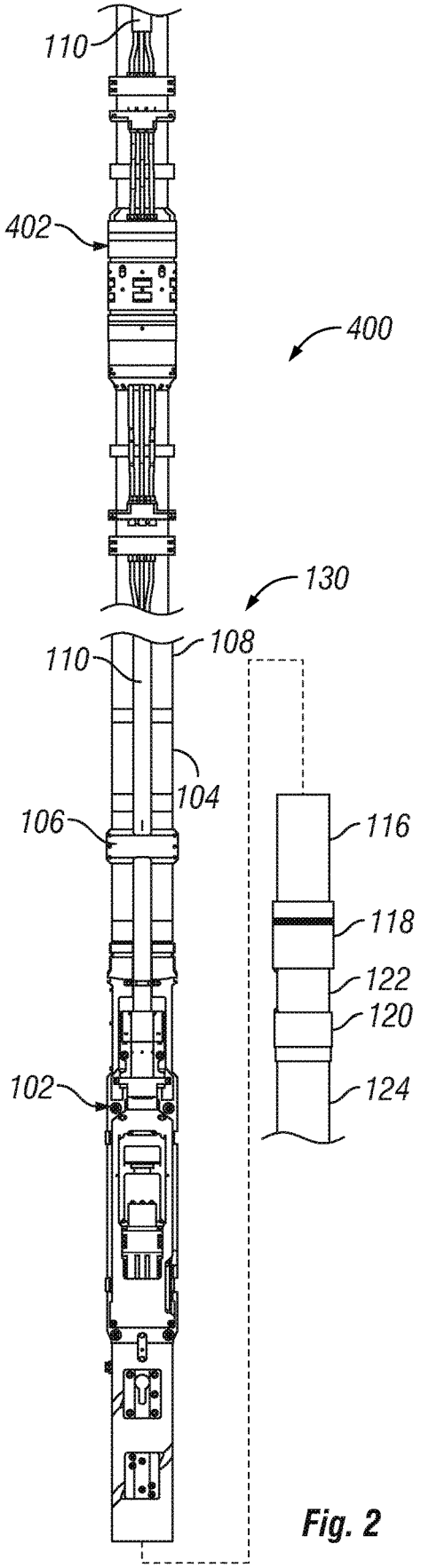
FIG. 2 shows a plan view of a partial length of another permanent completion portion of a production tubing assembly according to an embodiment of the present disclosure with field bypass connector.
Figure 3:
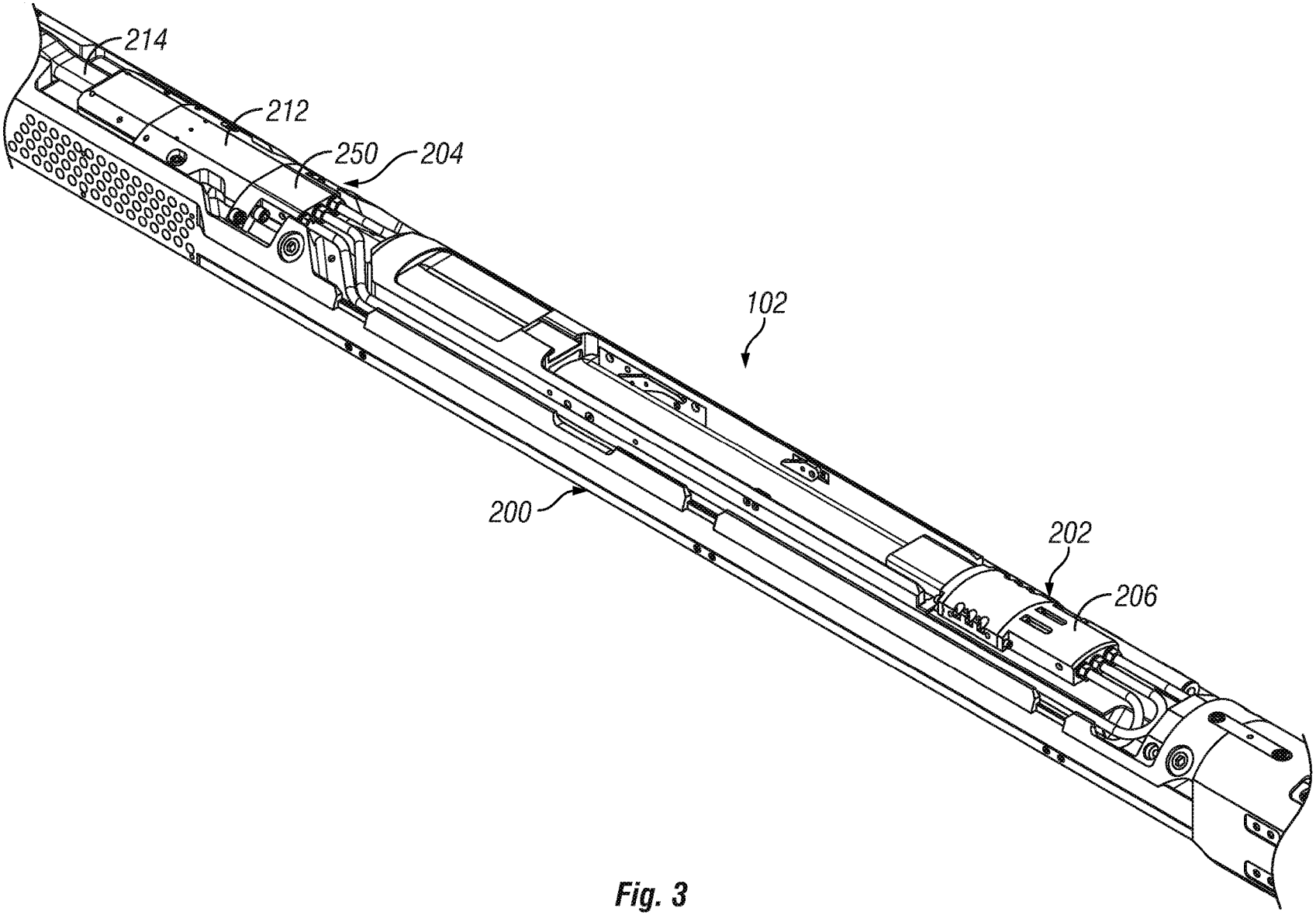
FIG. 3 shows a perspective view of an annular connection port (also referred to herein as an ACP) connection section on a permanent production tubing assembly according to an embodiment of the present disclosure.
Figure 4:
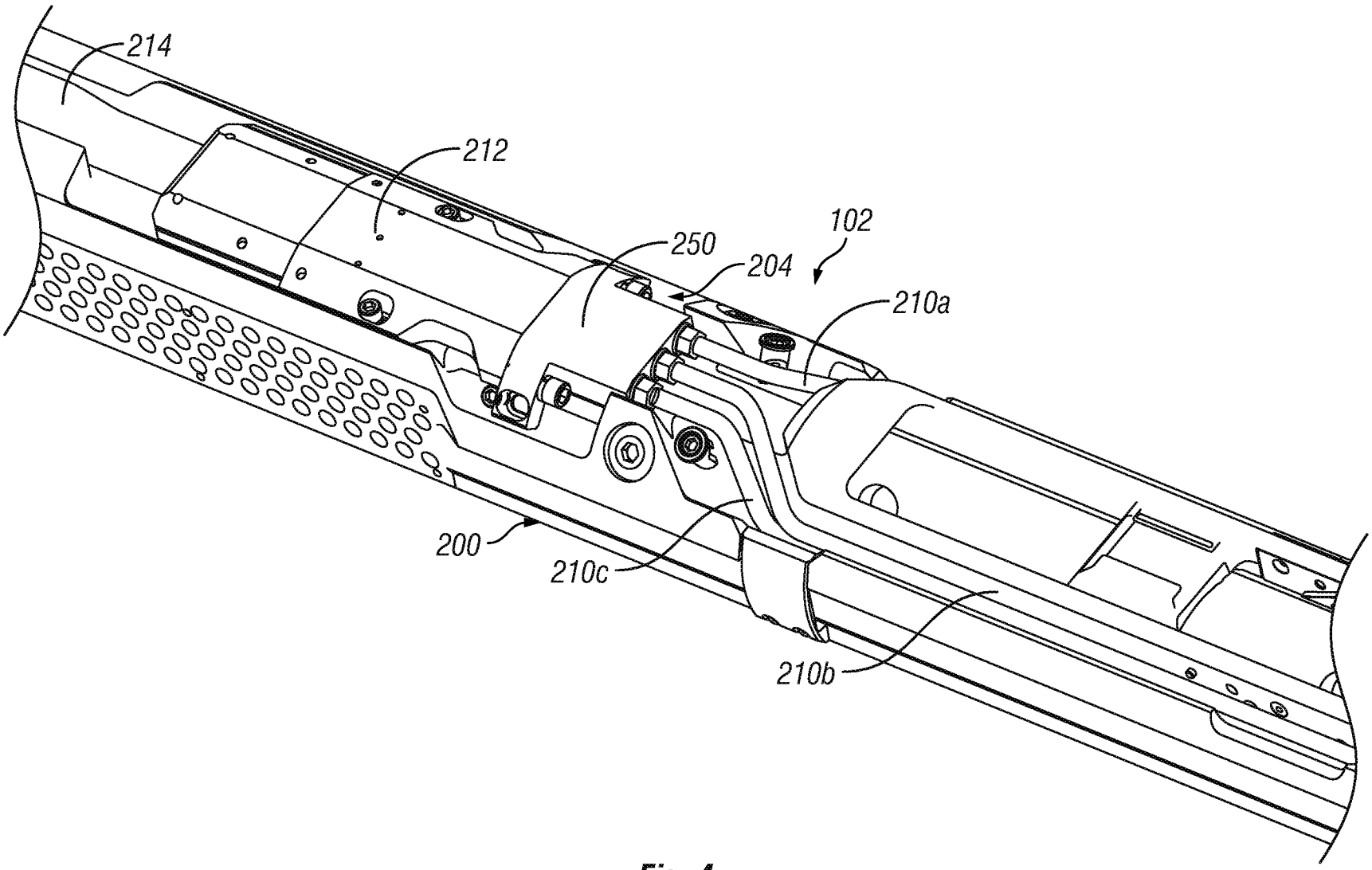
FIG. 4 shows an enlarged portion of FIG. 3 (the permanent downhole connector).

Referring now to FIG. 2 there is depicted another, alternate version of a production tubing assembly 130 providing a general view of a field bypass connector system 400 used here with a downhole packer on a production tubing installation with lines passing through the packer using additional field connectors. For example, a splice-less assembly of cables passes through completions equipment 402. In this embodiment of a field connector run through completions equipment (here a packer is shown), the connectors are shop installed in a no-splice version. The field bypass connector system 400 depicts a serial field connector assembly 402 illustrating back to back connected receptacles going through a packer. On the opposite side of each back to back connected receptacles are field mating connections to permit, e.g., connection of plug extension cables directed to the ACP, where cables can then continue down the string via ESP cable 126 (126*a*, 126*b*, 126*c*) or for the connection of cables directed to the surface via ESP cables 110.

Referring now also to FIGS. 3-20, there is shown an ACP connector section 200 in the ACP 102. Housed within the ACP connector section 200 is the permanent downhole electrical connector assembly 202. This assembly 202 further comprises a field connector assembly/receptacle 204 (with housing 250) at one end and a wet mate connector 206 interconnected by one or more fluid compensated-containing modified tubing enclosed leads/cables 210, 210*a*, 210*b*, 210*c* (wire inside of a tube)(e.g., TEC, etc. known in the art) modified in accordance with the teachings of the present disclosure.

The electrical connector assembly 202 further comprises a bellows/accumulator system 208 shown here attached as part of the wet mate connector 206. The bellows/accumulator system 208 further comprises a bellows first end 208*a*, a bellows second end 208*b*, a bellows annular housing 208*c*, a bellows internal annular wall 208*d* defining a bellows internal annual chamber 208*j*, a flexible sealing element 208*e* having an open fixed end 208*f* and a movable, closed end 208*g*, a movable end cap 208*h* for sealing the bellow, a bellows flexible sealing element internal cavity 208*i* for receiving wellbore fluid through open end 208*f*, a bellows annual chamber 208*j*, a connection 208*k* of bellows to the wet mate connector, and an annular connection orifice 2081.

In one embodiment, the bellows could be modified to serve to increase the pressure of the internal dielectric fluid ($P_i$) to maintain $P_i$ greater than the wellbore pressure ($P_w$). In another embodiment, each conduit that receives a dielectric fluid could have its own bellows. In other embodiments, two or more conduits could share a common bellows.

The completion tubing 102 further comprises a field connector plug 212 capable of receiving the field connector receptacle 204 end of the permanent downhole electrical connector assembly 202 to complete an electrical connection between the ACP connector system 200 and the ESP cable 110 on the upper production tubing section 114. The field connector plug 212 further comprises a field connector plug contact bore internal wall 212*a* defining the field connector plug annular internal chamber 292*b* around the field connector plug contact/socket insulator 288. The field connector plug 212 further comprises a field connector plug rear cavity internal wall 212*b* defining the field connector plug cable individual annular area 292*f* around the cable 214 which can extend up to the surface or to other part of the tubing string, e.g., cable 110 in FIG. 1. Cable 214 can be for power, signal, or other control line wire to surface The wet mate connector 206 generally comprises housing manifold 216 for maintaining one or more connections, and electrode housing 218, lead/cable connections 220 (metal to metal seal preferred). Compression nut metal-metal seals 220*a*, 220*b*, 220*c* provide the required compression for sealing elements 220*b* in order to form the metal-metal sealing. Metal-metal sealing element 220*b* serves as a primary metal-metal seal, installed on tubing 210 *a,b,c*, in housing 216 and connections 220 to provide the barrier between the manifold interior space 230 filled with dielectric fluid/oil 226 and the well bore fluid 228 in the manifold 242. A permanent downhole connection test seal 220*c* (elastomeric seal) provides the sealing for field pressure testing of connection 220.

The bellows 208 is connected to housing manifold 216 via bellows connection 222. A dielectric fluid port 224 is provided for charging the system at surface with dielectric fluid 226. These connections are exposed on the outside to wellbore fluid 228 which exerts a wellbore hydrostatic pressure $P_w$ (the downhole pressure generated by the column of fluid above the permanent downhole connector system). Atmospheric or ambient air pressure is indicated as $P_a$ herein.

Connection manifold 216 further comprises manifold interior space 230 (filled with dielectric fluid 226 at an internal connector pressure $P_i$ (the pressure generated by the bellow compensator system 208 inside the permanent downhole connector system 202 and field connector plug 212 when connected to assembly 202). Flow pathway 232 provides interior space and back side of all connections in fluid communication with each other and with dielectric fluid.

As illustrated, each cable further comprises a cable annular space 234. Permanent downhole connector electrical power lead 236 connects the wet mate connector electrode 238 to the field connector receptacle contact pin 264. Permanent downhole connector electrical power lead overmold 236*a* is present over the termination between the permanent downhole connector electrical power lead 236 and the wet mate connector electrode 238.

The wet mate connector electrode 238 is a permanent downhole electrical connector wet mate electrode, which connects with 528 (Plug head) during downhole deployment. The wet mate connector electrode cone end 238*a* is a self-centering connection end of the wet mate connector electrode 238, and provides a first area of contact between wet mate connector electrode 238 and 532 (plug head guide pin) of 528 (plug head).

A permanent downhole connector pressure test orifice 240 serves as a pressure port for field testing of connections 220. The permanent downhole connector pressure test manifold 242 provides a pathway/manifold for wellbore fluid 228 to provide communication with one or more sealing connections 220 on tubing 210 and to allow field pressure testing through port 240.

A wet mate connector electrode sealing element 244 serves as the primary elastomeric seal, installed on the wet mate electrode 238 and inside housing 216. The seal 244 provides the barrier between the manifold interior space 230 filled with dielectric oil 226 and the well bore fluid 228. The lead/cable connections 220 are typically threaded 246, with various thread types (parallel, NPT, other) being possible. A field connector receptacle check valve assembly 248 provides the sealing of the pressure compensated dielectric fluid 226, at the field connector receptacle end 204 (opposite end to the bellows assembly 208).

A fastener 252 for the field connector assembly comprises bolt and spring washers to secure the field connector plug 212 to the field connector receptacle housing 250 of the field connector assembly 204. A field connector receptacle/plug sealing element 254 serves as a primary elastomeric seal, installed on the field connector receptacle guide tube 256 to seal the inside receptacle housing 250 and the field connector plug contact bore internal wall 212*a*, when the plug 212 is installed onto field connector receptacle 204. This seal provides the barrier between the receptacle individual interior space 278*a,b,c* filled with dielectric fluid/oil 226 and the well bore fluid 228.

Field connector receptacle guide tube 256 provides the alignment between the field connector receptacle 204 and plug 212 during field installation and houses the sealing elements 254, protects the field connector receptacle contact pins 264 and forms the field connector receptacle individual cavities, filled with dielectric fluid/oil 226 from the bellows system 208 through the cable annular space 234 in the tubing 210. Field connector receptacle power lead short insulator 258 comprises an insulator bush installed onto the power lead 236 of the field connector receptacle 204. Field connector receptacle check valve spring 260 applies the required force to return and hold the valve body 266 to and in its original position, to provide sealing for the oil compensator system, when the field connector plug 212 is removed from the receptacle 204 (during installation) or not present (before installation). Field connector receptacle contact pin insulator 262 comprises an insulator sleeve installed on the field connector receptacle contact pin 264 and inside the field connector receptacle housing 250. The valve spring 260 pushes against this sleeve, trapping it in place and preventing the contact pin 264 and the power lead 236 from moving axially towards the guide tube open end 270. Field connector receptacle contact pin 264 is an electrical contact pin, crimped onto the power lead 236 to provide the electrical contact terminal for the field connector receptacle 204.

Field connector receptacle check valve body 266 is an insulator sleeve, providing electrical insulating layer for the contact pin 264. Its function also comprises a check valve, to provide a positive hydraulic sealing of the dielectric fluid of the bellows compensator system. In unconnected situation, it seals against the elastomeric sealing elements 272 and 274, not allowing dielectric fluid from the annular areas 278 *a,b,c*, 280 *a,b,c*, and 282 *a,b,c* to drain. When the field connector plug 212 is connected, the valve body 266 is shifted away from the guide tube open end 270, unseating the valve from the sealing element 272, thus allowing dielectric fluid 226 from chambers 278 *a,b,c*, 280 *a,b,c* and 282 *a,b,c* to enter the annular chambers 292 *a,b* of the field connector plug 212.

Check valve body contact face 266*a* is located at the end face of valve body 266, and provides the contact face for shifting the valve body and unseating the valve, thus opening the path for the dielectric fluid to pass. Check valve body internal sealing wall 266*b* comprises the boundary defined by the through bore of the valve body 266, in which the sealing between the valve body 226 and the field connector receptacle contact pin 264 takes place by means of the field connector receptacle check valve dynamic seal 274. Check valve body nose sealing tapered face 266*c* comprises the primary sealing face of the check valve body 266.

Field connector receptacle pressure test orifice 268 is a pressure port for field testing of connections 220 on the field connector receptacle 204. Guide tube open end 270 is the open end of the field connector receptacle 204, which accepts the field connector plug 212.

Field connector receptacle contact pin individual annular chambers 270 *a,b,c* are annular chambers formed by the valve body 266 of the check valve 248 and the field connector receptacle contact pin 264. Field connector receptacle check valve static seal 272 is an elastomeric seal to provide primary sealing for the check valve of the field connector receptacle check valve assembly 248.

Field connector receptacle check valve dynamic seal 274 is an elastomeric seal used to provide sealing for the check valve 248. The check valve body 266 slides over this seal and provides dynamic sealing, and it forces the dielectric fluid 226 communication between the field connector receptacle 204 and the field connector plug 212 through the annular area 284 only. Field connector receptacle pressure test manifold 276 serves as a pathway/manifold for wellbore fluid to provide communication with one or more sealing connections 220 on tubing 210 and to allow field pressure testing of the connections 220 on the field connector receptacle 204.

Valve spring individual annular area 278*a,b,c* communicates with power cable annular area 234, but not manifold in housing 250 of field connector receptacle 204.

Field connector receptacle contact pin individual annular area 280*a,b,c* communicates with valve spring individual annular area 278*a,b,c* and the power cable individual annular area 234, but not manifold in housing 250 of field connector receptacle 204

Field connector receptacle contact pin insulator individual annular area 282*a,b,c* communicates with the field connector receptacle contact pin individual annular area 280*a,b,c*, the with valve spring individual annular area 278*a,b,c* and the power cable annular area 234, but not manifold in housing 250 of field connector receptacle 204.

Field connector receptacle valve body individual annular area 284*a,b,c* communicates with the field connector receptacle contact pin insulator individual annular area 282*a,b,c*, field connector receptacle contact pin individual annular area 280*a,b,c*, the with valve spring individual annular area 278*a,b,c* and the power cable annular area 234, but not manifold in housing 250 of field connector receptacle 204.

Threaded end of guide tube 286 provides a connection method of the guide tube 256 in housing 250. Field connector plug contact socket insulator 288 is an insulator sleeve installed on the field connector plug contact socket 290 and inside the field connector plug housing 212 to provide electrical insulation and activate the field connector receptacle check valve body 266, during the connections of the field connector plug 212 and field connector receptacle 204.

Field connector plug contact socket insulator shoulder 288*a* is a circular shoulder feature of a larger diameter on the field connector plug contact socket insulator 288 to provide a mechanical contact with valve body contact face 266*a* and activate the check valve 248 by shifting the valve body 266.

Field connector plug contact socket 290 is an electrical contact pin, crimped onto the power lead 214 to provide the electrical contact terminal for the field connector plug 212. Field connector plug front face 292 comprises the front face of field connector plug 212, containing the individual field connector plug contact socket bore 292*a*, which comprises a main chamber of the field connector plug 212. Individual bore per phase for multiple of phases. Field connector plug contact individual annular chamber 292*b* comprises an annular chamber between the field connector plug contact bore internal wall 212*a* and the field connector plug contact socket insulator 288. Individual chamber per phase, for multiple of phases. Field connector plug contact socket internal chamber 292*c* is a chamber inside of the field connector plug contact socket 290. Field connector plug contact socket communication orifice 292*d* is a pathway in the field connector plug contact socket 290, for dielectric fluid/oil 226 to be transferred from field connector plug contact socket internal chamber 292*c* into field connector plug cable annular area 292*f*. Field connector plug contact insulator rear individual annular chamber 292*e* is an annular chamber between the field connector plug rear cavity wall 212*b* and the field connector plug contact socket insulator 288. Individual chamber per phase, for multiple of phases. Field connector plug cable individual annular area 292*f* is an annular chamber between the field connector plug contact socket insulator 288 and the cable 214. Individual chamber per phase, for multiple of phases.

Field connection annular area 294 is an annular chamber created between field connector receptacle guide tube 256 and the field connector plug contact bore internal wall 212*a*, when the field connector plug 212 starts engaging the field connector receptacle guide pin 256. Individual chamber per phase, for multiple of phases. Atmospheric air 296 from chambers 292*a,b,c* and dielectric oil 226 from chambers 292*a,b* can escape through this annular chamber during the field connector plug 212 and receptacle 204 connections.

Dielectric fluid passage annular flow path 294*a* is an annular chamber/flow path between the field connector plug bore internal wall 212*a* and the field connector receptacle guide sleeve 256, underneath the field connector receptacle check valve static seal 272, created when the check valve body 266 is unseated Field connector receptacle guide tube nose 298 is an insert made out of a polymer which is installed onto the end of the field connector receptacle guide tube 256 and provides protection for the tubes and prevents damages on surface of the field connector plug contact bore internal wall 212*a*.

Referring now to FIGS. 20A-20G, operation of the connection between the field connector plug 212 and the receptacle 204 is described. In Step 1 (FIG. 20A), the field connector plug is shown disconnected. Both the field connector plug 212 and receptacle 204 are installed in a vertical orientation only. The transport cap (not shown) for the field connector receptacle 204 is providing sealing and protection of the guide tubes 256 until the time of the connector field installation. At the well site, the protective cap is removed exposing the guide pins 256 and the field connector receptacle contact pin individual annular chambers 270*a,b,c*, full of dielectric fluid 226, at atmospheric pressure ($P_a$). The level of dielectric fluid reaches almost up to the open end 270 of the guide tubes 256. The valve body 266 of the field connector receptacle check valve assembly 248 is sealing off the individual chambers 284, 282, 280 and 278 by means of the valve body nose sealing tapered face 266*c* pushing against the field connector receptacle check valve static seal 272. The force required to maintain the contact between the check valve body 266 and seal 272 is provided by the field connector receptacle check valve spring 260. The dielectric fluid pressure in chambers 284, 282, 280 and 278 is $P_i$.

In Step 2 (FIG. 20B), the field connector plug contact socket bore 292*a* starts engaging with the field connector receptacle guide tube nose 298. As the field connector plug 212 is manipulated in order to make the connection with the field connector receptacle 204, the field connector plug contact socket bore 292*a* makes contact with the field connector receptacle guide tube nose 298 and self-aligns with the field connector receptacle tube 256. The cylindrical faces of both bore internal wall 212*a* and guide tube 256 for the field connection annular area 294. Trapped air from chambers 292*a* will escape through the field connection annular area 294.

In Step 3 (FIG. 20C), the field connector plug 212 is pushed over the field connector receptacle guide tube 256. As the field connector plug 212 engagement with the field connector receptacle guide tube 256 is increasing, more air from chambers 292*a* and 292*b* will be expelled through the field connection annular area 294. At the same time, the field connector plug contact socket 290 and the field connector plug contact socket insulator 288 enter the field connector receptacle contact pin individual annular chamber 270*a,b,c* and field connector plug contact socket 290 starts connecting with the field connector receptacle pin 264. Dielectric fluid 226 from the field connector receptacle contact pin individual annular chamber 270*a,b,c* is pushed out into the field connector plug contact socket bore 292*a*, and from there part of it is expelled from the connection through the field connection annular area 294.

In Step 4 (FIGS. 20D and 20E), activation of the field connector receptacle check valve 248 takes place. When the field receptacle plug 212 is pushed further over the field connector receptacle plug, the field connector plug contact socket insulator shoulder 288*a* makes contact with the check valve body contact face 266*a*. At this point there the check valve is still seated, thus no fluid transfer is possible.

In Step 5 (FIG. 20F), shifting of the field connector receptacle check valve body 266 takes place. By further movement of the field connector plug 212, the check valve body 266 is moved away from the field connector receptacle check valve static seal 272, and the field connector receptacle check valve spring 260 is compressed. Since the sealing between the valve body 266*a* and the sealing element 272 is lost, thus creating a new annular fluid path 294*a*, where the dielectric fluid 226, which is at the internal pressure $P_i > P_a$, has free passage from annular chamber 284 to the field connector plug contact individual annular chamber 292*b* through the newly created pathway 294*a*. This is the only dielectric fluid passage path, as there is a sealing between the check valve body 266 and the field connector receptacle contact pin 264, by means of a dynamic sealing element 274.

Dielectric fluid 226 in excess will not be expelled from the connection through the connection annular area 294, as the field connector receptacle/plug sealing element 254 enters the field connector plug contact socket bore 292*a*, and forms a seal against the field connector plug bore internal wall 212*a*. A small volume of trapped air 296 starts to be compressed inside chambers 292*c,d,e,f* and dielectric fluid 226 enters all annular chambers 292*c,d,e,f*.

In Step 6 (FIG. 20G), the field connector is fully engaged. The field connector plug end 292 is in contact with the end face of the field connector receptacle housing 250. At this point, the field connector is fully engaged, and the field connector plug contact socket 290 and the field connector receptacle contact pin 264 are fully connected. Any remaining small amount of air 296 is compressed in the annular chambers 292*e* and 292*f*. All other voids are filled with dielectric fluid 226, at pressure $P_i$.

After Step 6, the connector system is now ready for testing. Special tools are used to pressure test the connection 220 through the test orifice 268.

After pressure testing, the tool is deployed downhole. The manifold 276 will be filled by the well bore fluid 228 and the well bore hydrostatic pressure $P_w$.

Referring now to FIGS. 21-30, there is depicted a field bypass connector system 400 for downhole completion equipment 404, such as a packer (or other pieces of equipment)(shown here in partial longitudinal cut-away view to illustrate the cable(s) passing therethrough. For example, a splice-less assembly of cables passes through completions equipment 402. In this embodiment of a field connector run through completions equipment (here a packer is shown), the connectors are shop installed in a no-splice version. The field bypass connector system 400 depicts a serial field connector assembly 402 illustrating back to back connected receptacles going through a packer. On the opposite side of each back to back connected receptacles are field mating connections to permit, e.g., connection of plug extension cables directed to the ACP, where cables can then continue down the string via ESP cable 126 (126*a*, 126*b*, 126*c*) or for the connection of cables directed to the surface via ESP cables 110.

In this embodiment, the field bypass connector system 402 generally comprises the desired piece of equipment 404 (here, shown as a packer) mounted on the upper tubing assembly 114 (employing one or more standard tubing couplings 128). As will be apparent, at each end of the field bypass connector system 402, there is provided a clamp-type field connector receptacle 408 installed in standard tubing without need of prior orientation features. This provides for ease in making up the tool owing to the axial and rotational flexibility of the connectors. Receptacle 408 can be pressure compensated or not. The ESP lines/electrical cable (here, tubing encapsulated cables 410, 410*a*, 410*b*, 410*c*) connect between both of the opposed receptacles 408, and run through the packer 404. These electric cables 410 (and others described herein) may be single or multi-phase. Each of the respective receptacles 408 is designed to receive a corresponding clamp-type field connector plug 406 to again connect the ESP cables on the field bypass connector system 402 to upper and lower lengths of ESP cables (110 to surface or 126 to other downhole location along the production tubing). The clamp-on style field connector plug 406 may be installed in standard tubing without need of prior orientation features. For example, this dual connector system provides these clamp-on style field connector pairs 408, 406 with the ability to slidably (along axial length of upper production tubing 114) and rotatably (about tubing 114) adjust the position of the upper/lower receptacle pair (408, 406) to permit easy mating at the downhole end (where receptacle attaches to the TEPC from the ESP, which itself can vary in its make up from application to application thereby not permitting one to have a universal location for the downhole receptacle connection). Thus, once the lower receptacle is moved to mate with the downhole end, the upper end receptacle likewise moves to its fixed position, but the power cable to the surface can then be adjusted to meet it and make the connection. In one embodiment, these dual connectors could preferably be fluid compensated with dielectric fluid as described herein, and in other embodiments, they are not fluid compensated. Standard high pressure metallic tube bore through fittings 411 are provided for securing and hydraulically isolating the interior of the packer (or other equipment employing feed throughs) where tubing 410 (410*a*, 410*b*, 410*c*) passes through such feed throughs. Once the clamp-on style connectors are adjusted into their final position, the feed through fittings 411 are tightened.

The field connector plug clamp body/housing 412 serves as a housing and clamp body for the field connector plug 406. The plug 406 further comprises one or more electrical sockets 414 (three shown here, 414*a*, 414*b*, 414*c*) corresponding to the number of connections required to make with receptacle 408. Each electrical connection socket 414 serves as the electrical connector socket on the field connector receptacle 406 and can employ single or multiple sockets that will receive and connect to the electrical connection pin(s) 420*a,b,c*.

The field connector receptacle clamp body/housing 416 serves as a housing and clamp body for the field connector receptacle 408. The receptacle further comprises one or more electrical connector pins 420 (single or multiple male electrical pins (here shown with three pins 420*a*, 420*b*, 420*c*) to connect into the corresponding number of electrical connection slots 414 (414*a*, 414*b*, 414*c*). Standard high pressure metallic tube fittings 422 are provided for joining tubing 410 (410*a*, 410*b*, 410*c*) into the bulkhead 408. The partial cut-away view of housing 416 illustrates the internal cavity 424 for dielectric fluid. The cavity 424 stores and distributes dielectric fluid, 226, onto receptacle 408 to compensate pressure changes. A cavity for wellbore fluid 426 also exists. Wellbore fluid 426 enters the cavity and applies pressure $P_w$ onto pressure balancing device 428, forcing dielectric fluid 424 to counteract the increase on pressure therefore equalizing $P_i$. The pressure balancing device 428 acts as the active element that moves and balances $P_i$ to $P_w$. This device, 428 can be a piston (shown), bladder or bellows.

The two clamp halves of the respective housings 412, 414 are attached together in standard fashion, such as, with multiple screws that are recessed in counterbore holes 418.

Multiple fasteners 432 are used to join the clamp body halves together. Once the field connector plug clamp 406 is connected to the field connector receptacle clamp housing 406, fasteners 434 (such as bolt and spring washers) can be used to secure the plug 406 to the receptacle 408.

To assist in locking down the respective clamps 406, 408 to the tubing, the inside surfaces of clamps 406, 408 may be equipped with locking features 436, 430 comprising slip-type internal grooves on the top and bottom sides of clamp housing 412, 416 to bite down on the tubing when the screws are torqued. This provides axial and torsional locking of the clamp.

The field connector receptacle 204 and field connector plug 212 can be mounted on a field connector mounting clamp-type assembly 438, which can in turn be secured to tubing 114. Clamp type assembly 438 comprises an upper body 440 having an outer face in which receptacle 204 and plug 212 are mounted, and a lower body 442. A mounting clamp locking feature 444 may also be employed on the top inner face of upper body 440 and bottom inner face of lower body 442. Slip-type internal grooves 'bite' down on the tubing when screw(s) 545 or other attachment mechanisms are torqued. This provides axial and torsional locking on the clamp. A cable clamp 446 clamp secures cable 214 onto upper body 440. A cable protector 448 protects penetrator cable(s) 464 (464*a,b,c*) from damage. Penetrator cable(s) may be single or multiple, and are intended to pass through the completion equipment 404 to connect to the receptacle 204. Plug fasteners 450 secure the plug 212 onto the upper body 440. Receptacle fasteners 452 secure the receptacle 204 onto upper body 440. Mounting clamp fasteners 454 fasten, secure, and clamp upper body 440 and lower body 442 together onto tubing 114, by e.g., engaging threads in the threaded holes 456 in lower body 442. Face thread 458 may be employed for securing the receptacle 408 to the plug 406 axially. This also energizes the seals.

In one embodiment of the field bypass connection system, check valves are employed. In another embodiment, check valves are not employed.

In one embodiment of the field bypass connection system, each connector (plug 406 and receptacle 408) will feature internal dielectric fluid compensation. In another embodiment, the tubing encapsulated cables can also employ internal dielectric fluid compensation. In another embodiment, each connector and each cable will employ internal dielectric fluid compensation.

In one embodiment, the connectors are charged in situ with the dielectric fluid and the pistons/bellows employed are set. Each individual connector can be individually charged with the dielectric fluid, or the entire chamber could be charged with the dielectric fluid.

Although it is envisioned that the cable system could be charged with dielectric fluid along the entire production tubing string to surface, in a preferred embodiment, dielectric fluid compensation is provide up to a packer or other equipment in the upper production string.

It will also be understood that the cable tubing could incorporate other biphase conduits, e.g., downhole pressure sensor wires, downhole hydraulic conduit, or downhole gauges.

Figure 5:
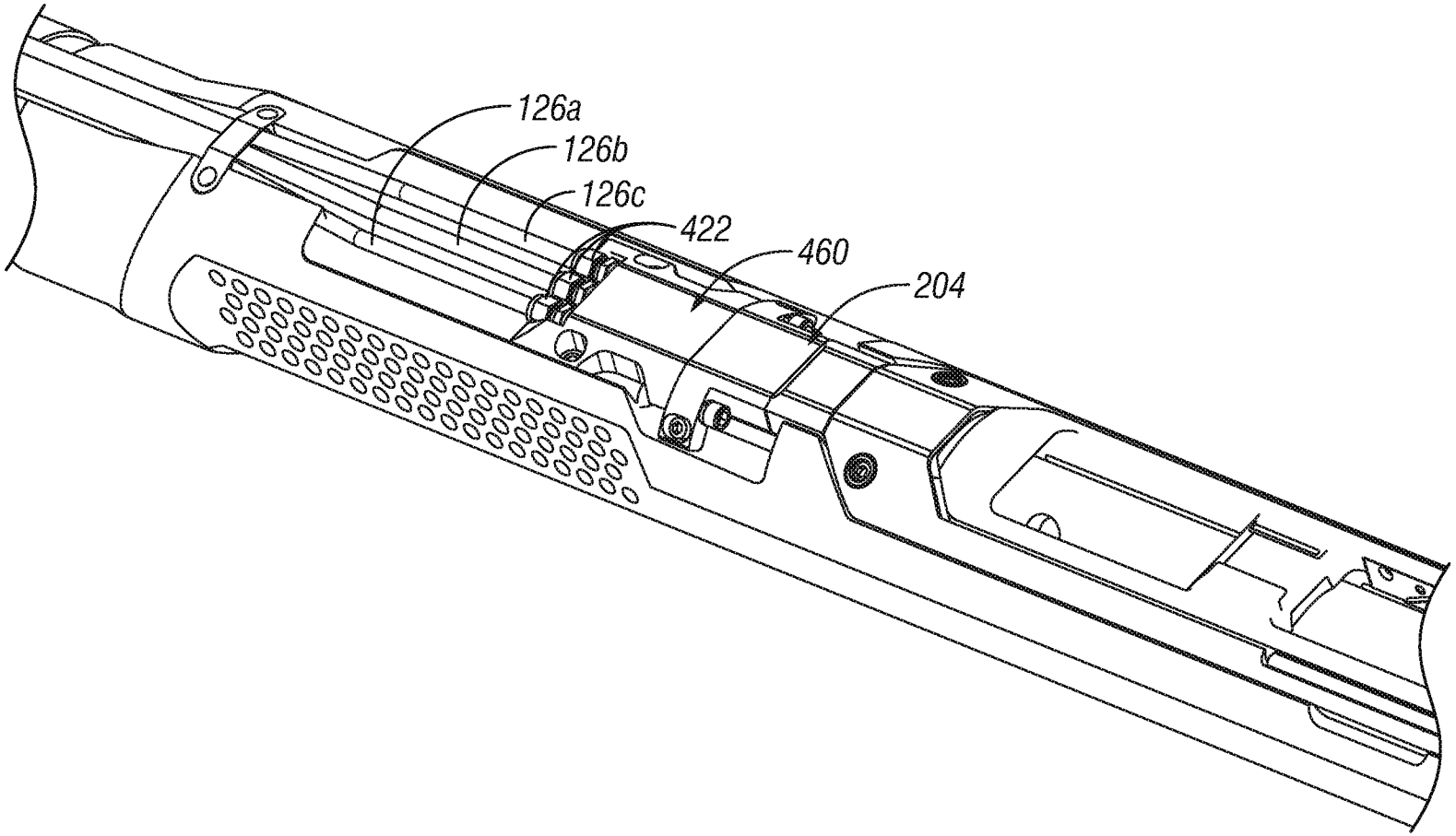
FIG. 5 is an enlarged perspective view of a portion of an alternate ACP configuration.
Figure 5A:
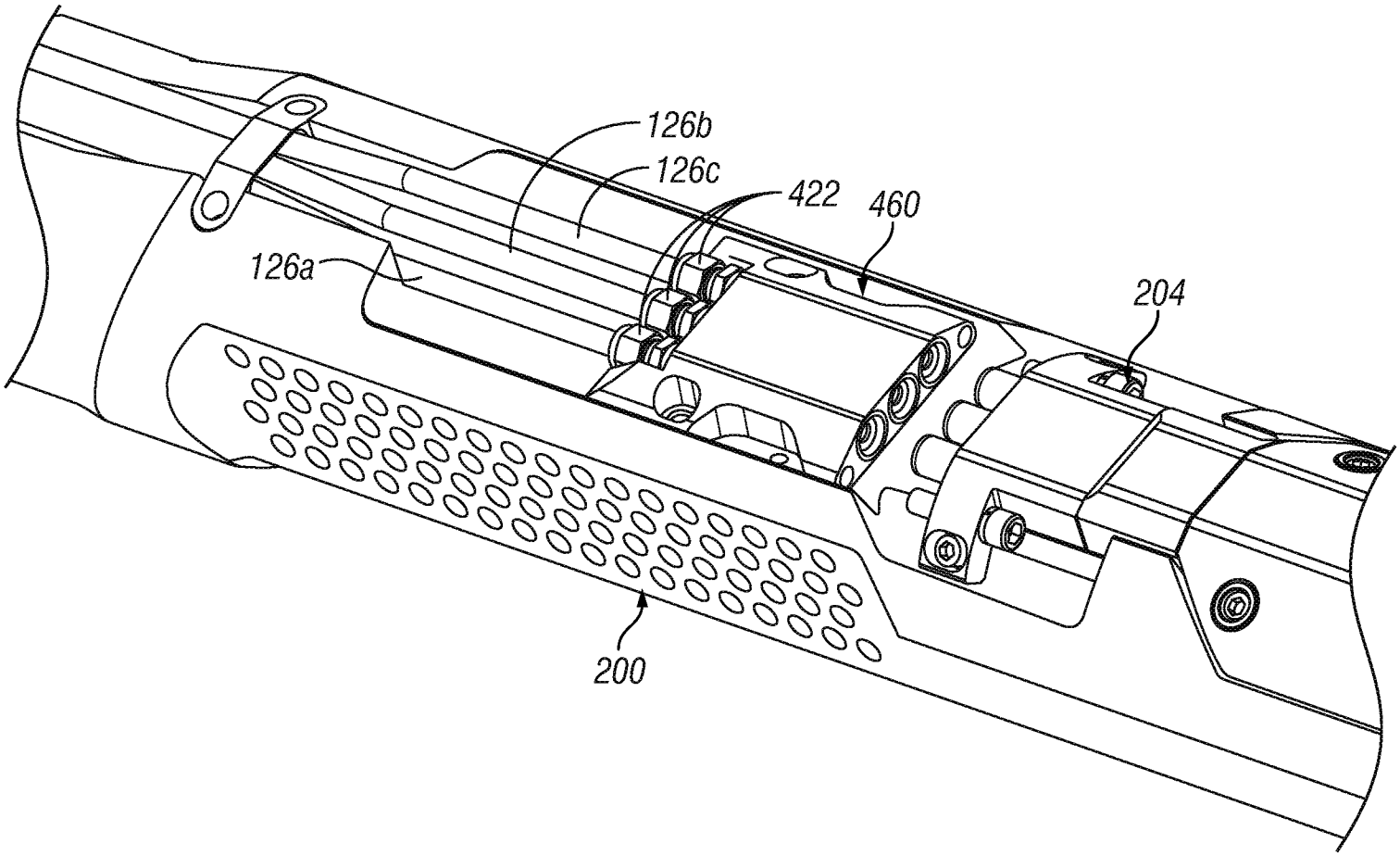
FIGS. 5A-5B illustrate the alternate ACP configuration of FIG. 5 being partially disconnected.
Figure 5B:
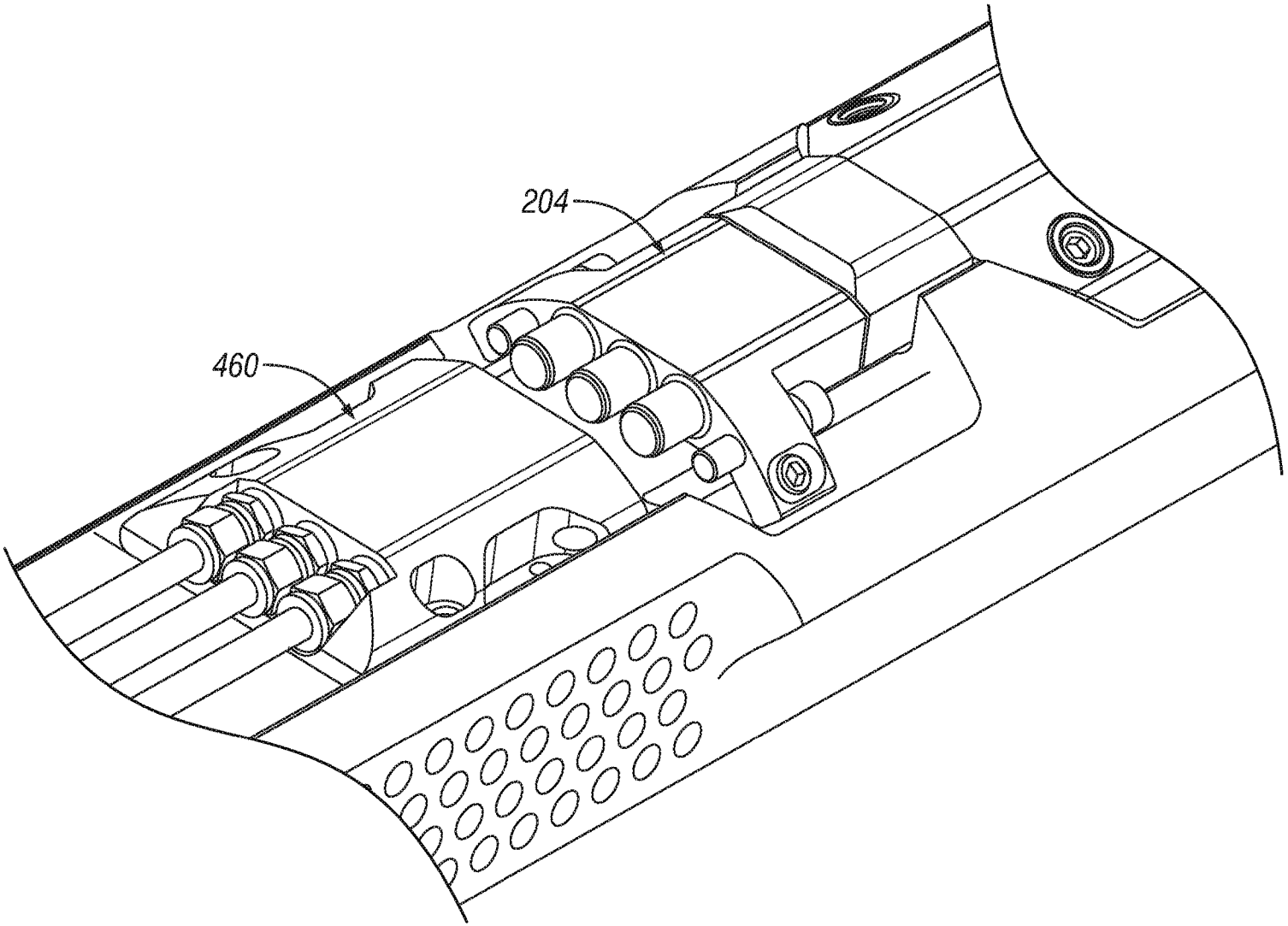
Figure 6:
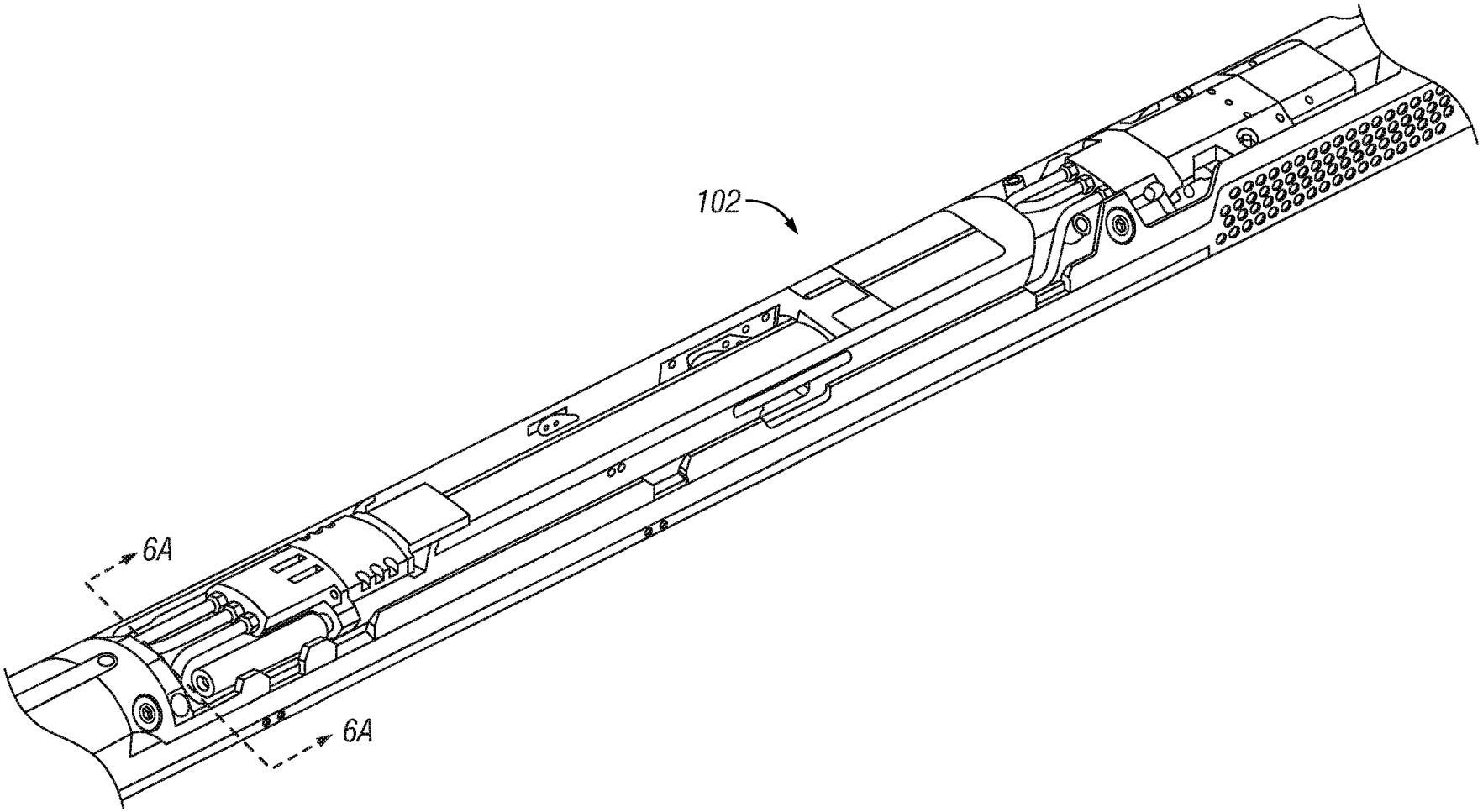
FIG. 6 shows another perspective view of the ACP of FIG. 3.
Figure 6A:
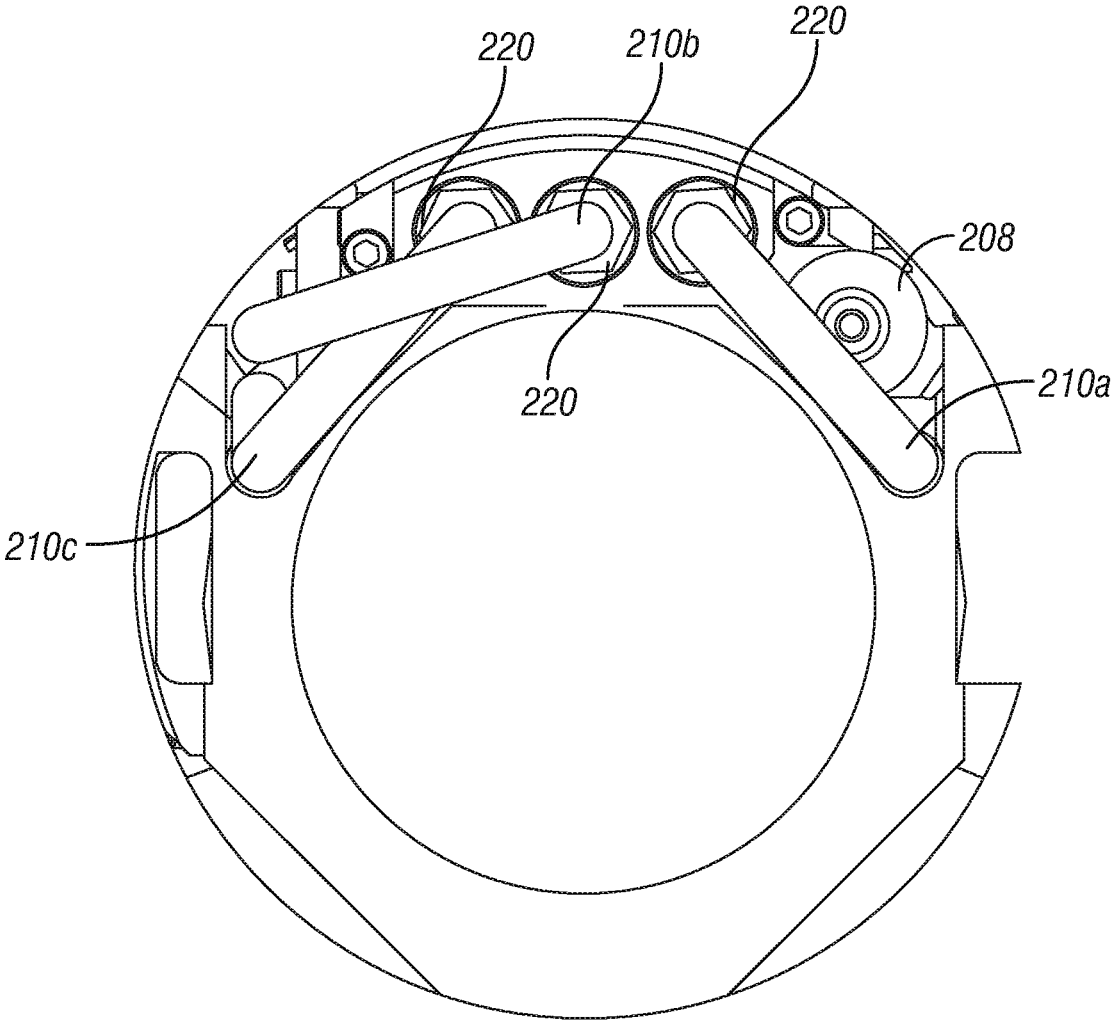
FIG. 6A is a cross-sectional view taken along lines 6A-6A of FIG. 6.
Figure 7:
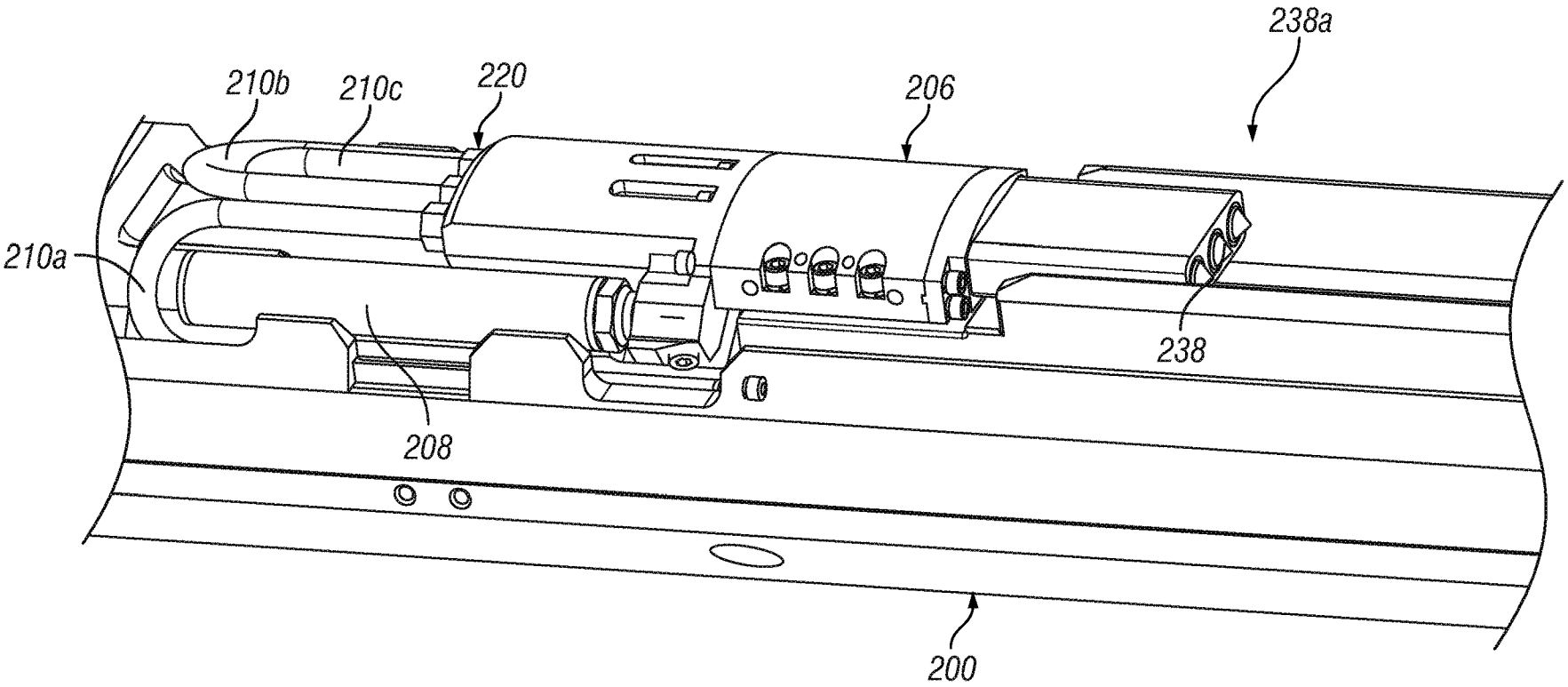
FIG. 7 is another enlarged view of the ACP of FIG. 3 showing the wet mate connector and bellows compensator according to an embodiment of the present disclosure.
Figure 8A:
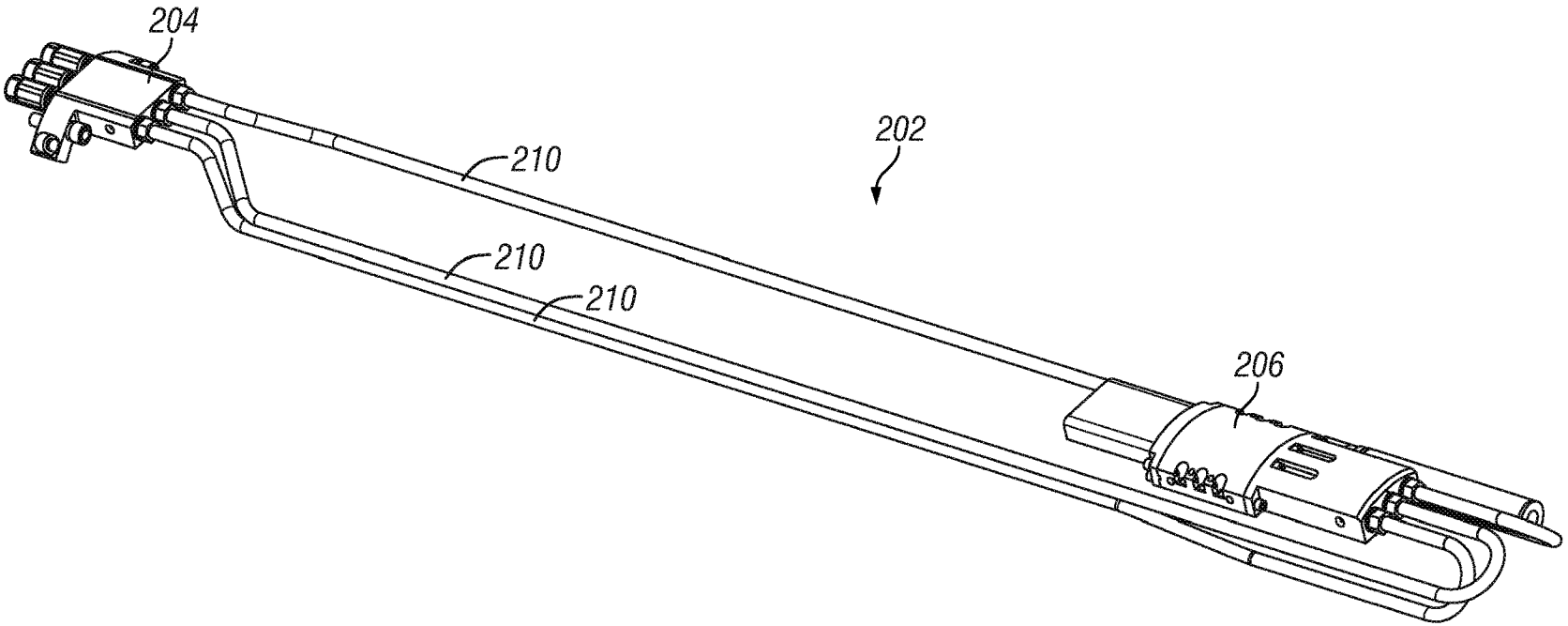
FIG. 8A is a perspective view of a permanent downhole electrical connector assembly according to an embodiment of the present disclosure.
Figure 8B:
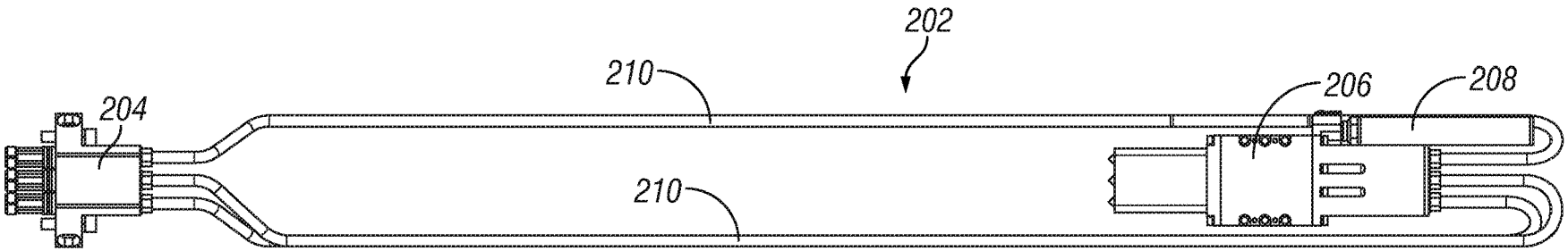
FIG. 8B is a top to view of FIG. 8A.
Figure 9:
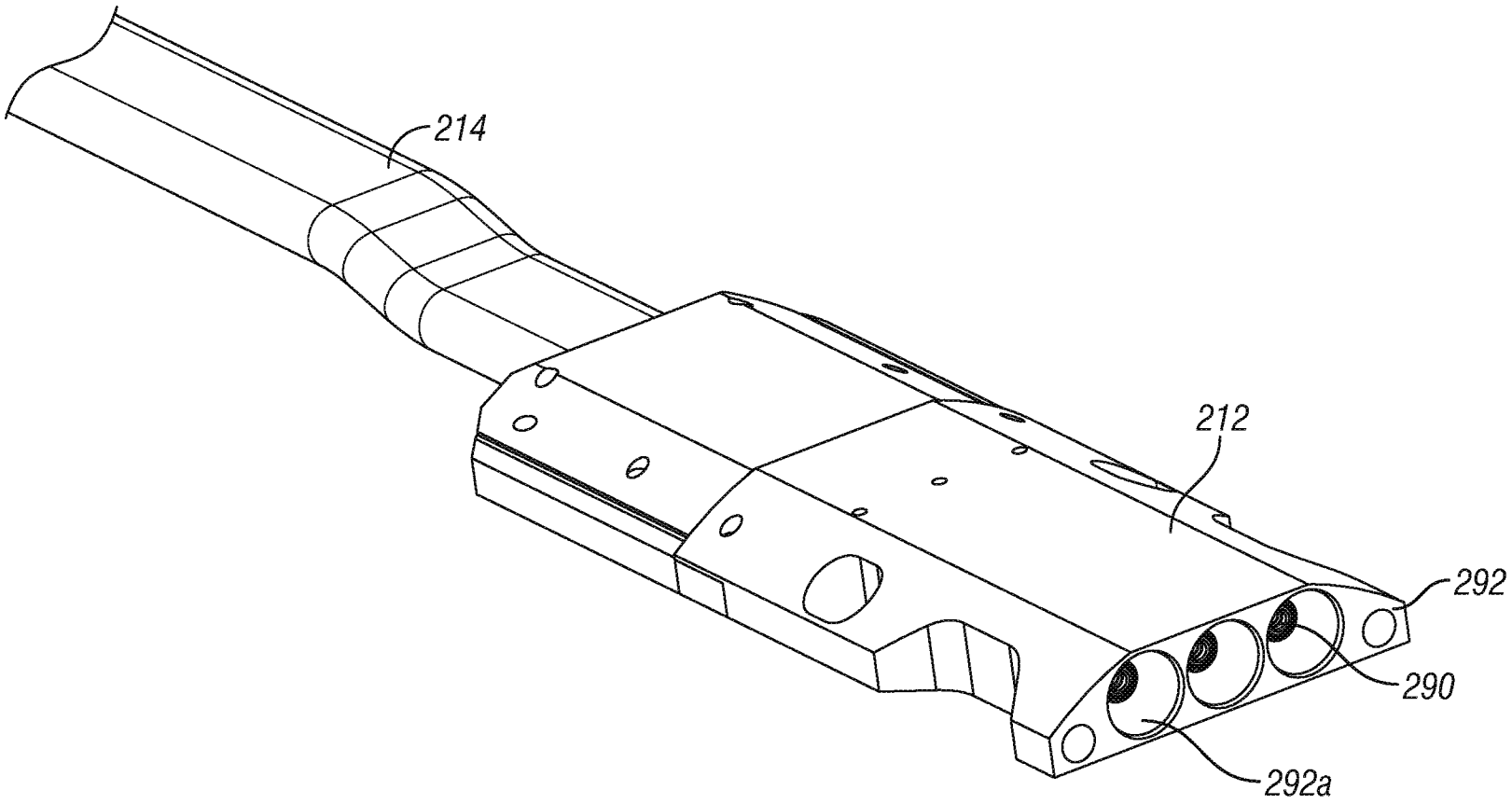
FIG. 9 is a field connector plug according to an embodiment of the present disclosure.
Figure 10:
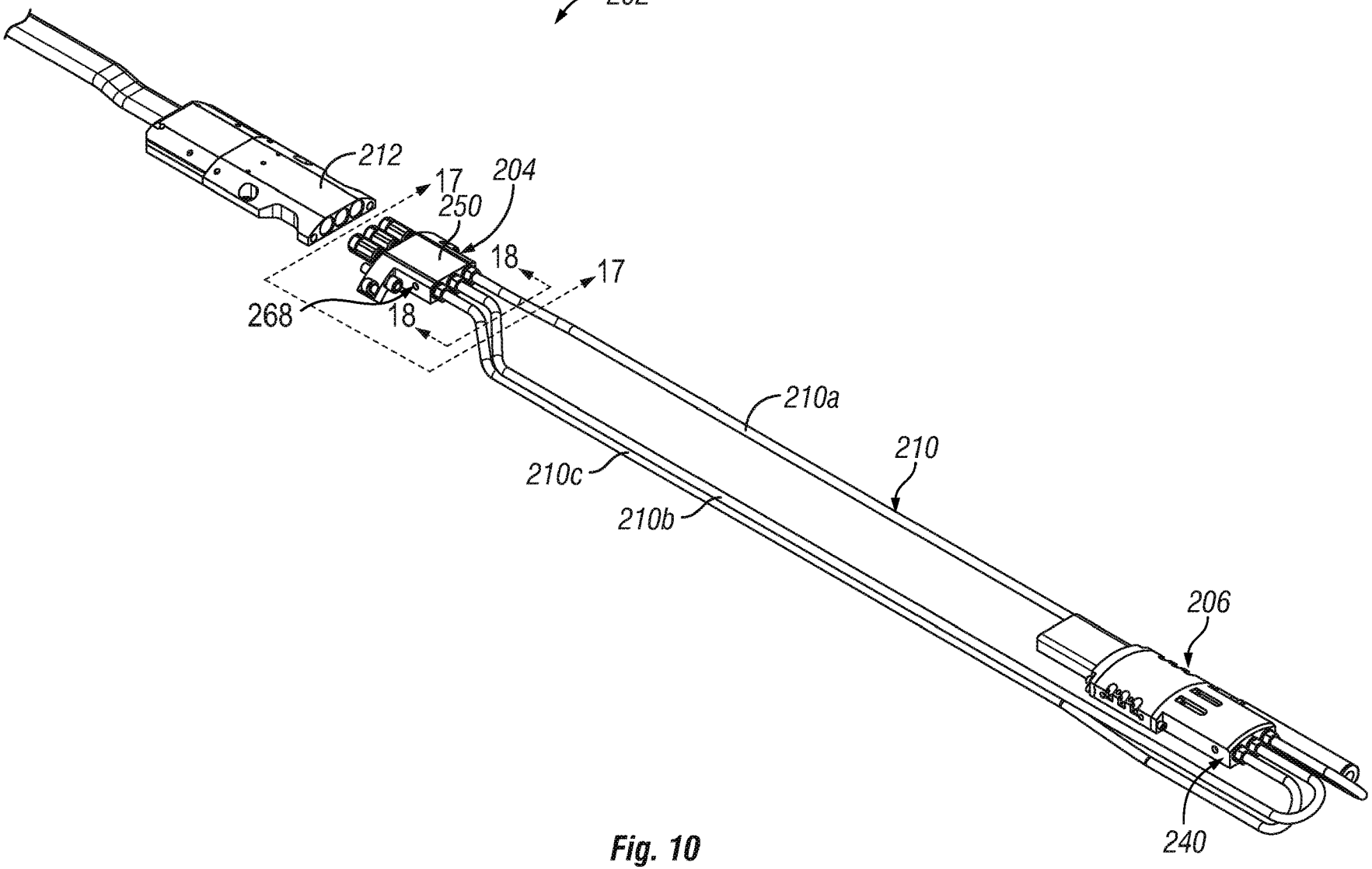
FIG. 10 shows how a field connector plug (of FIG. 9) can connect to a field connector receptacle end of the downhole electrical connector assembly of FIGS. 8A and 8B according to an embodiment of the present disclosure.
Figure 11:
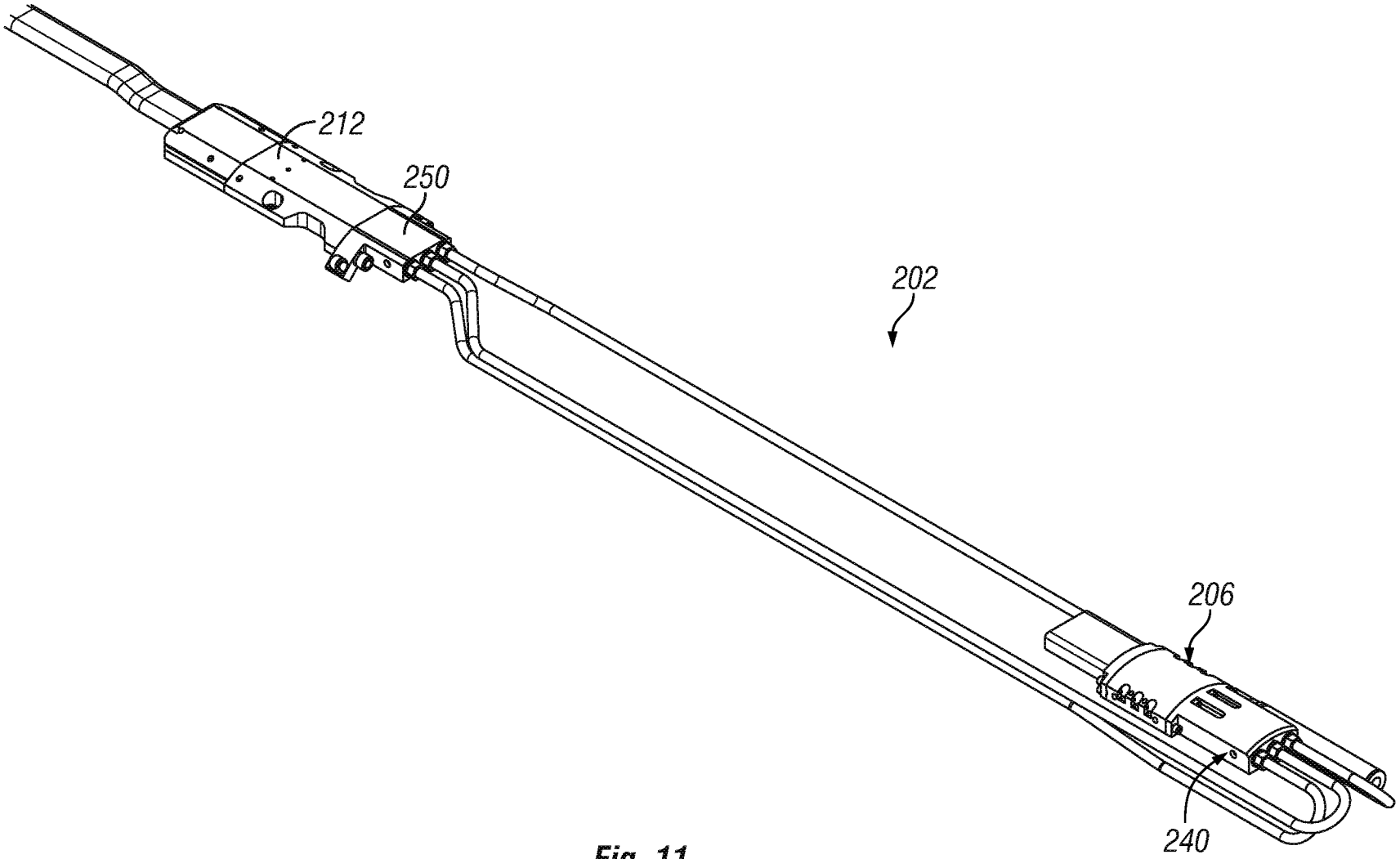
FIG. 11 shows a field connector plug (of FIG. 9) connected to a field connector receptacle end of the downhole electrical connector assembly of FIGS. 8A and 8B.
Figure 12:
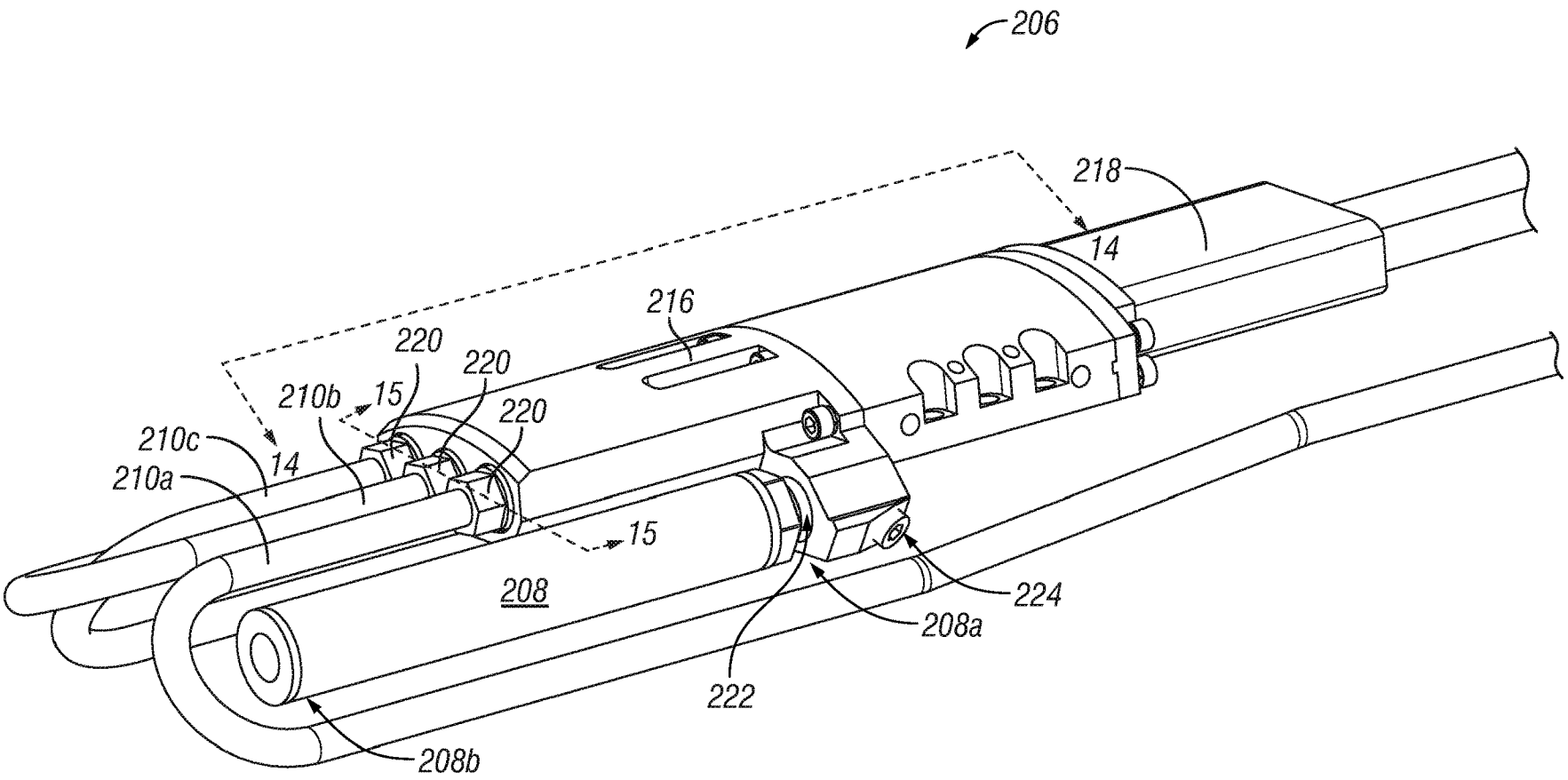
FIG. 12 is an enlarged perspective view of the wet mate connector according to an embodiment of the present disclosure.
Figure 13:
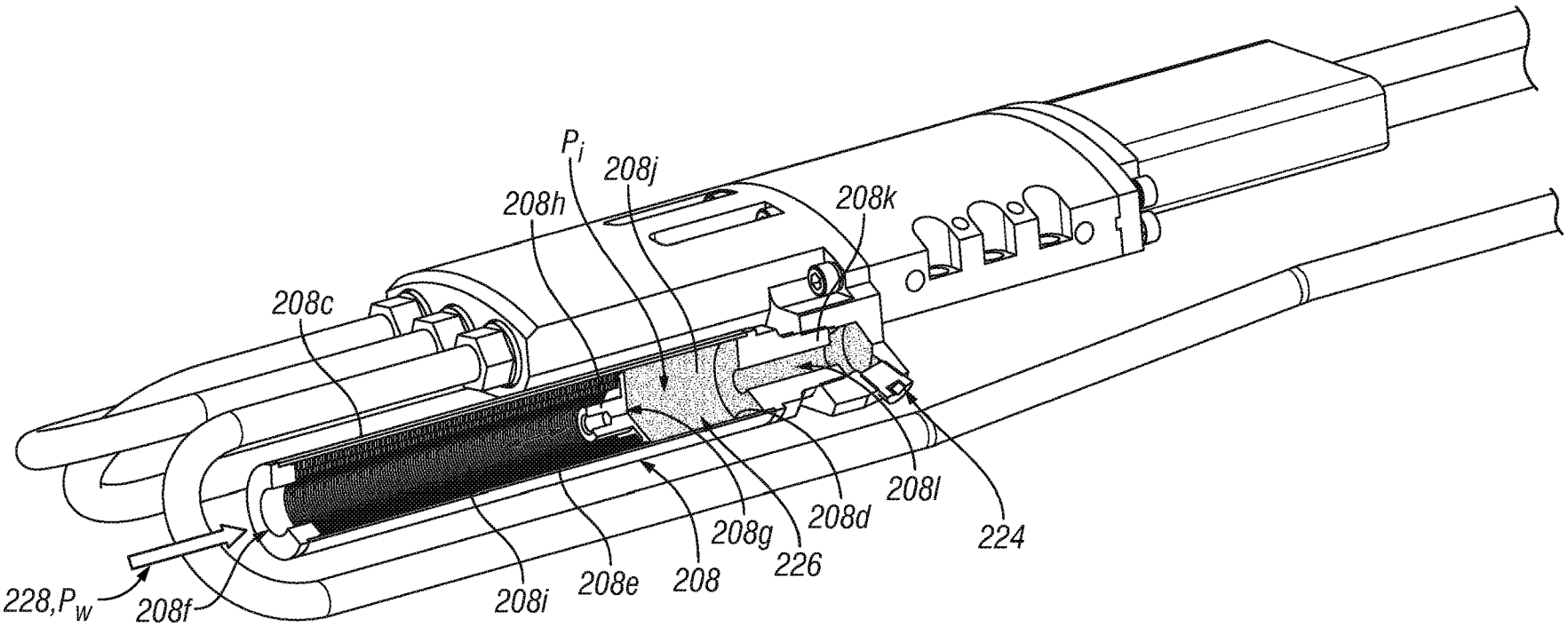
FIG. 13 shows the wet mate connector of FIG. 12 in partial sectional view along the bellows/accumulator system.
Figure 14:
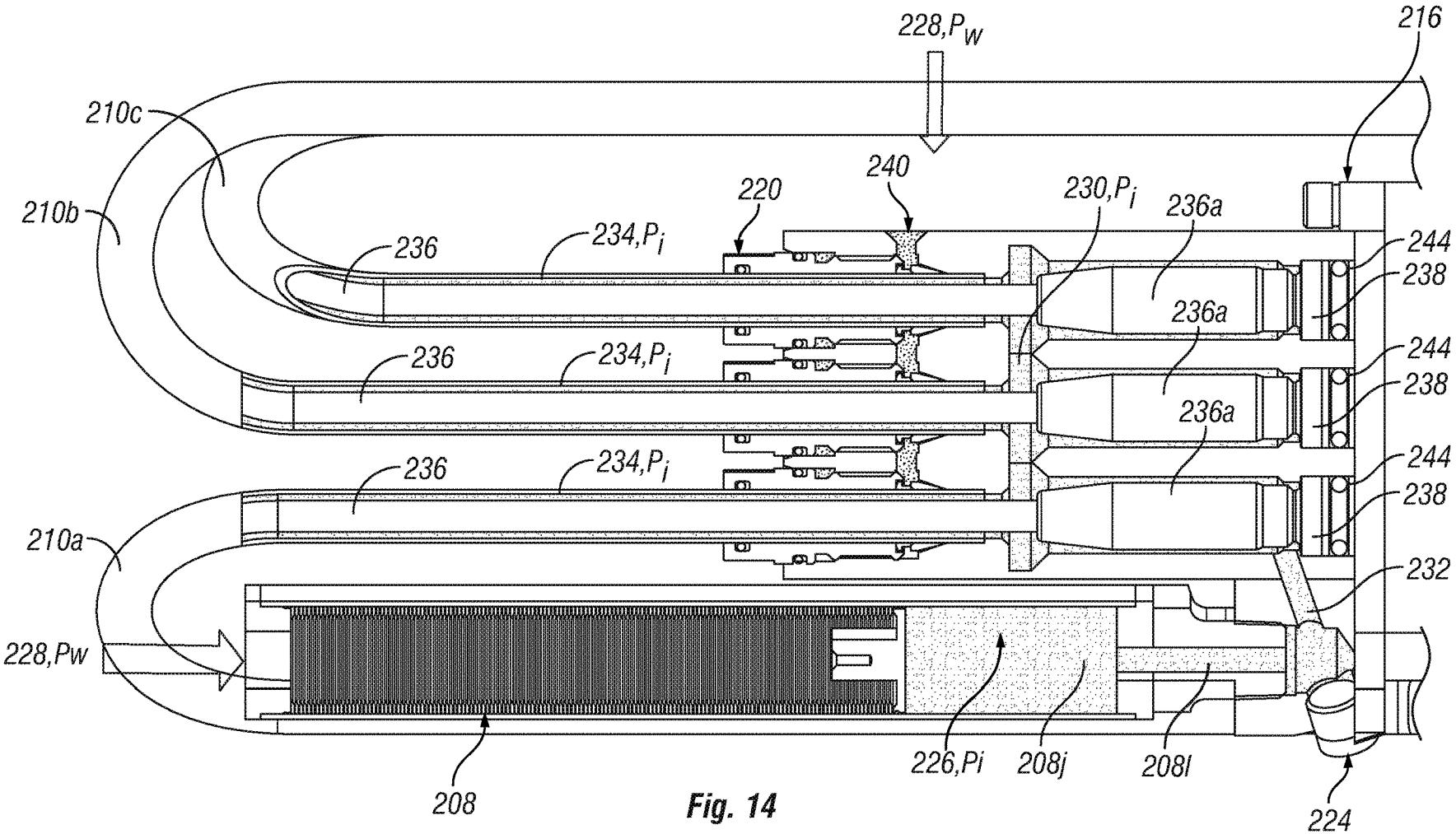
FIG. 14 is an enlarged plan view in partial sectional view of the wet mate connector taken along lines 14-14 of FIG. 12.
Figure 15:
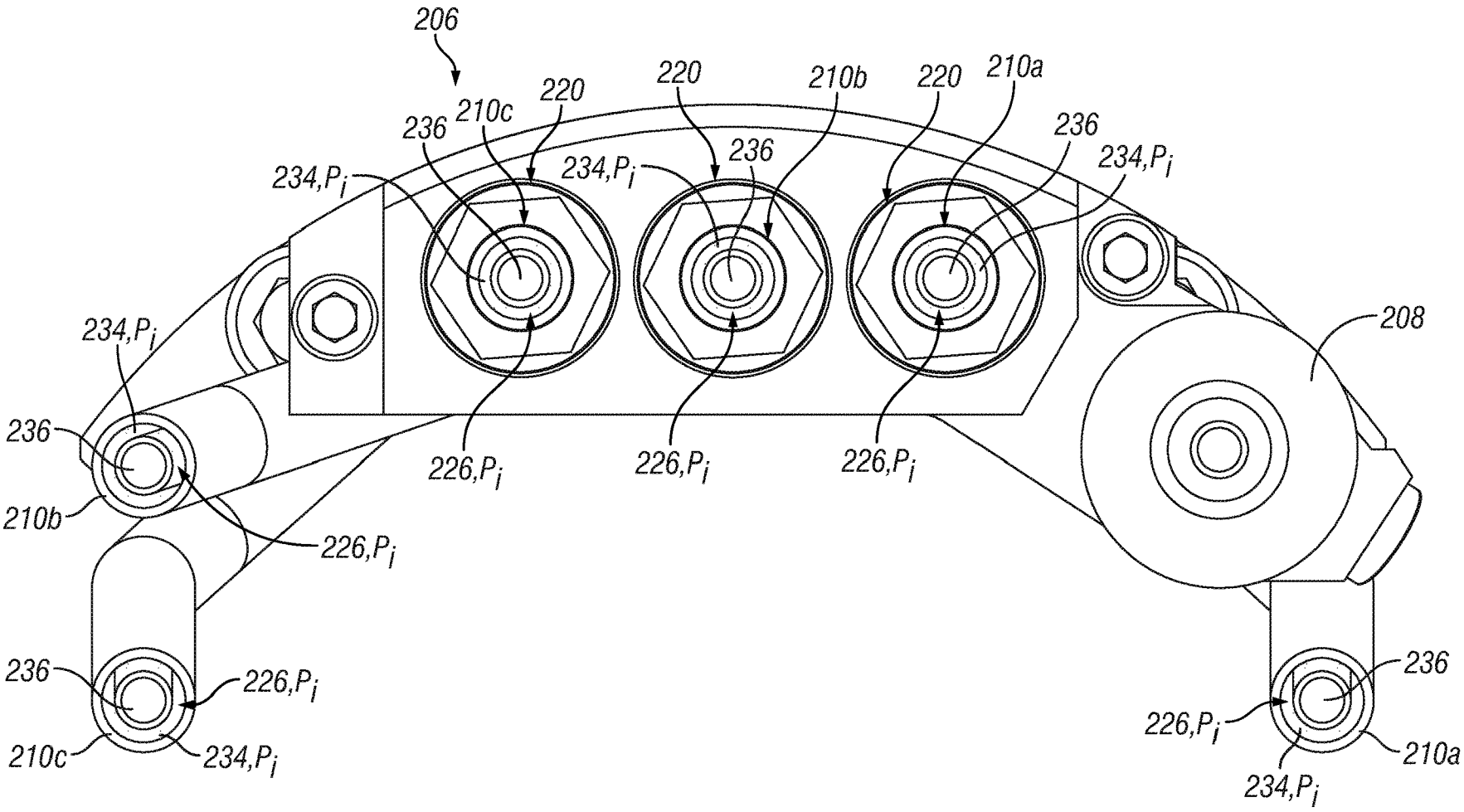
FIG. 15 is an end cross-sectional view of the wet mate connector taken along lines 15-15 of FIG. 12.
Figure 16:
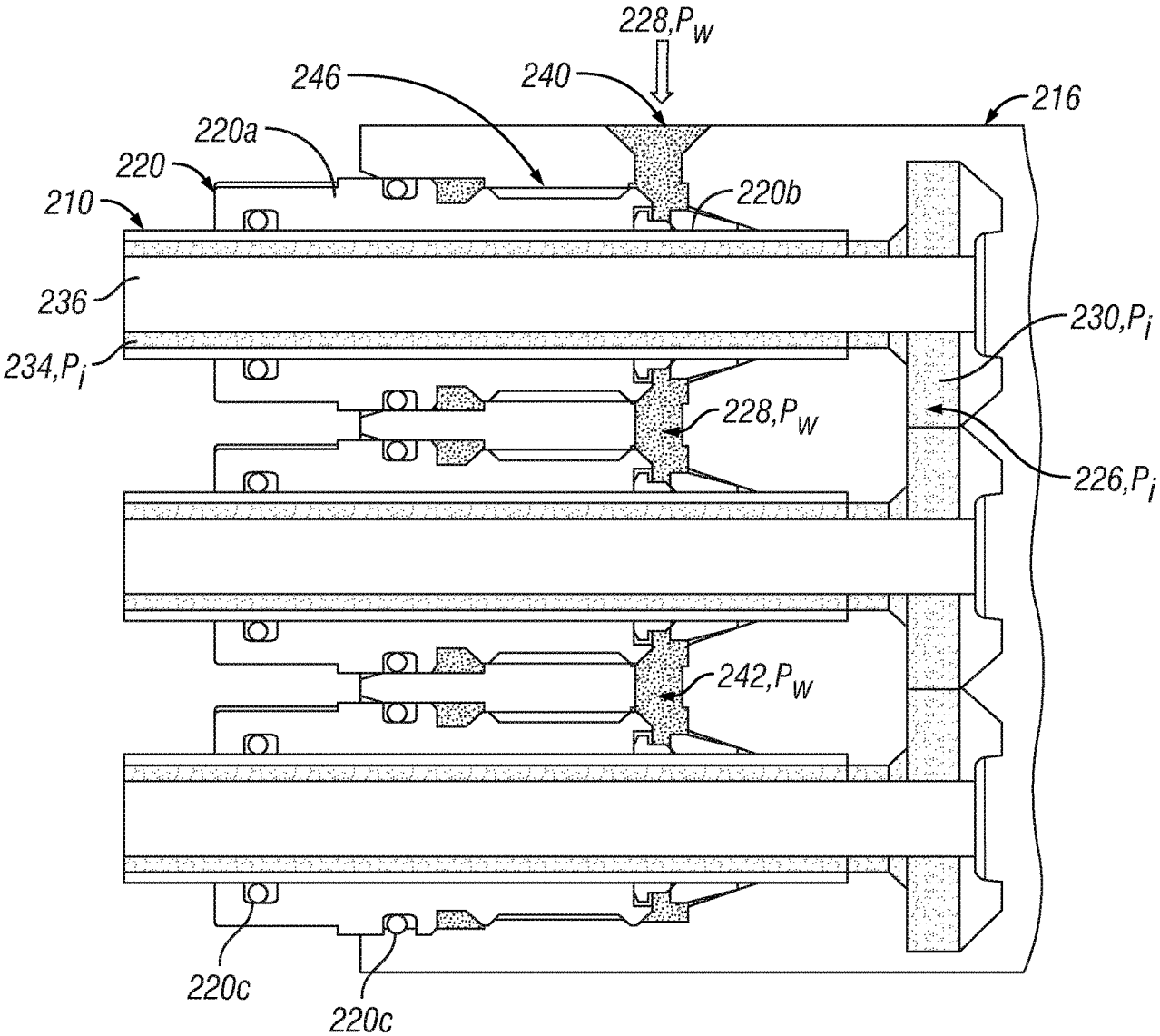
FIG. 16 is an enlarged view of a portion of FIG. 14.
Figure 17:
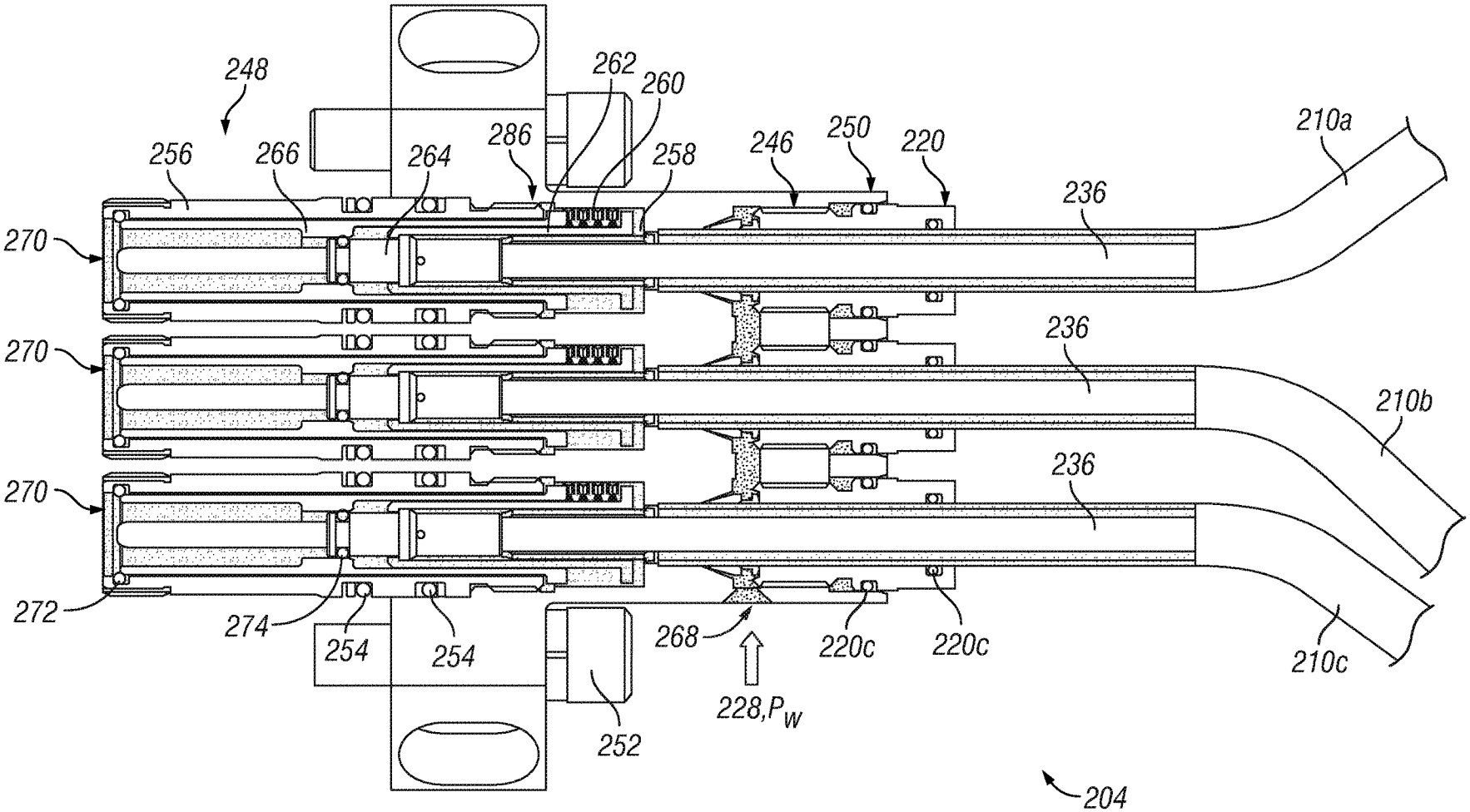
FIG. 17 is a cross-sectional view of the field connector receptacle taken along lines 17-17 of FIG. 10.
Figure 18:
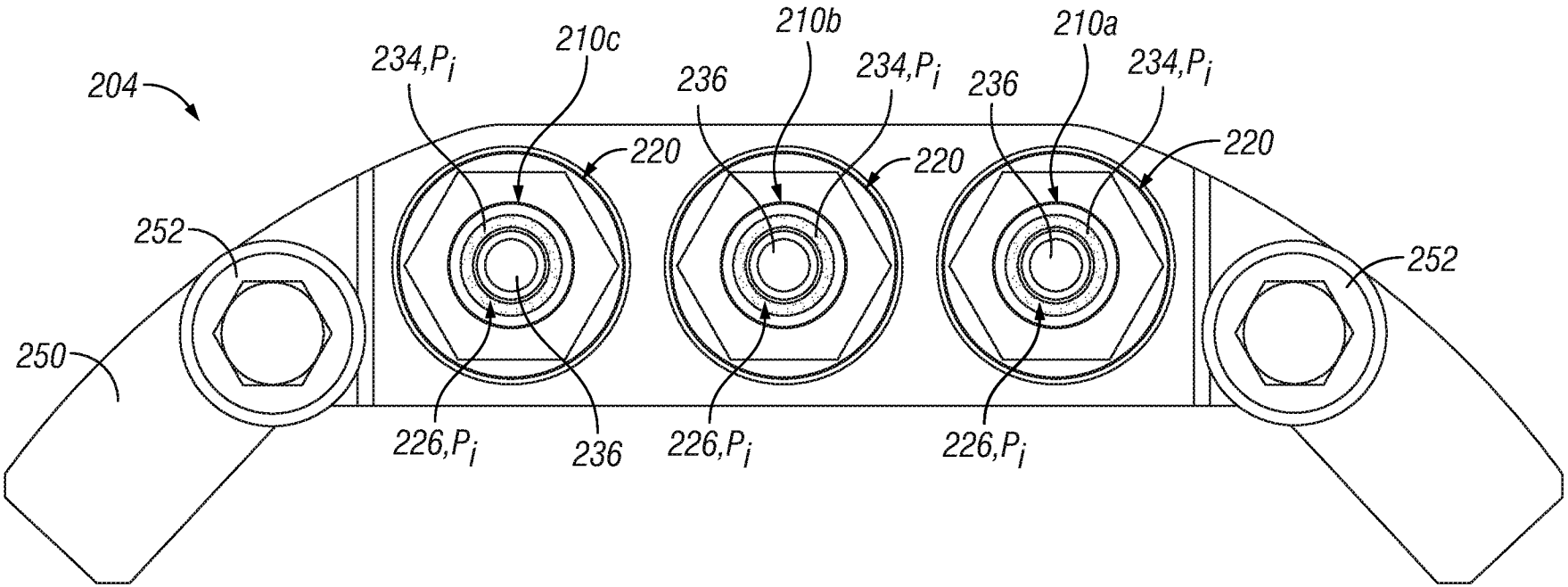
FIG. 18 is a cross-sectional view of the field connector receptacle taken along lines 18-18 of FIG. 10.
Figure 19:
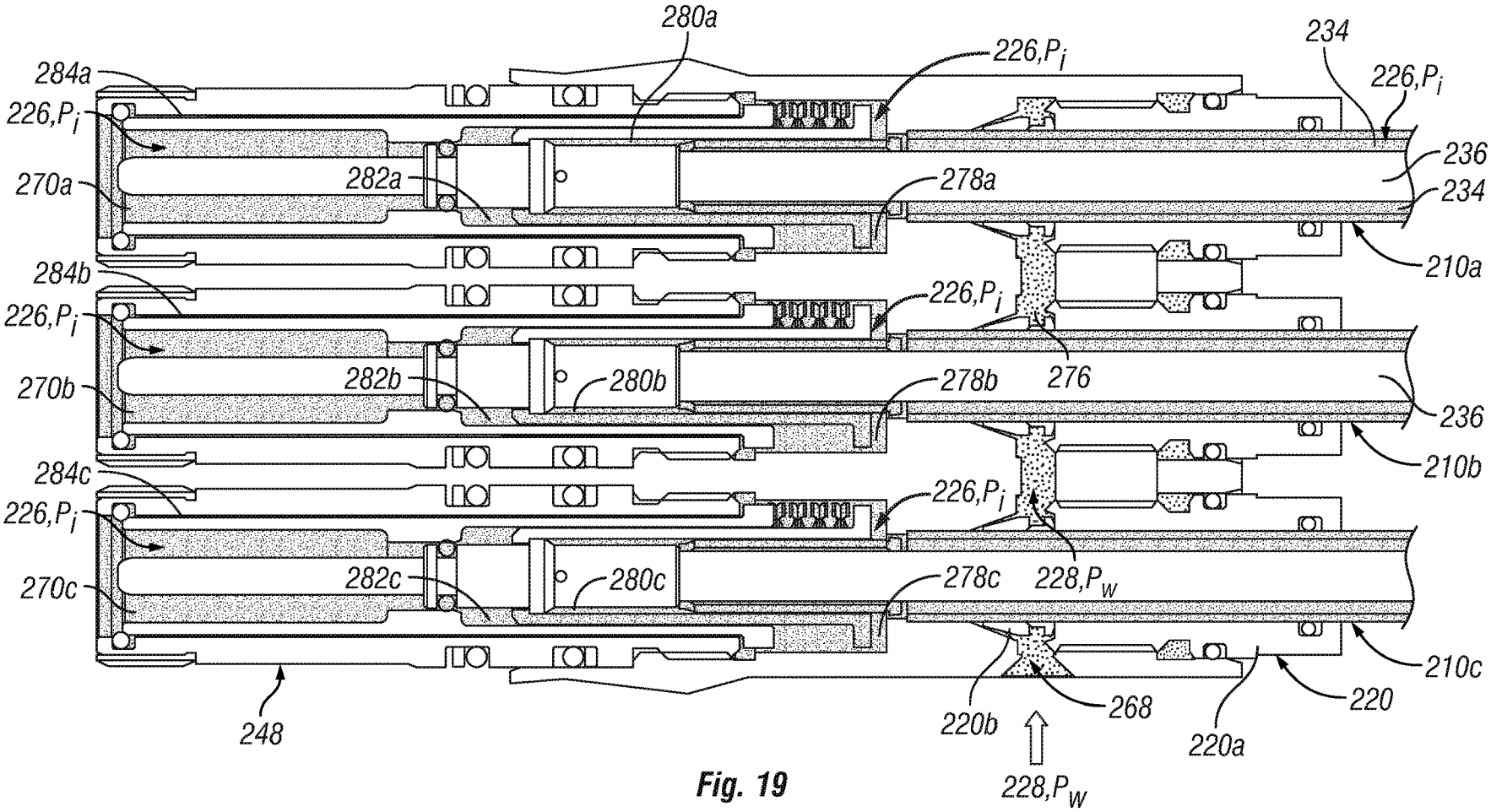
FIG. 19 is an enlarged view of a portion of FIG. 17.
Figure 20A:
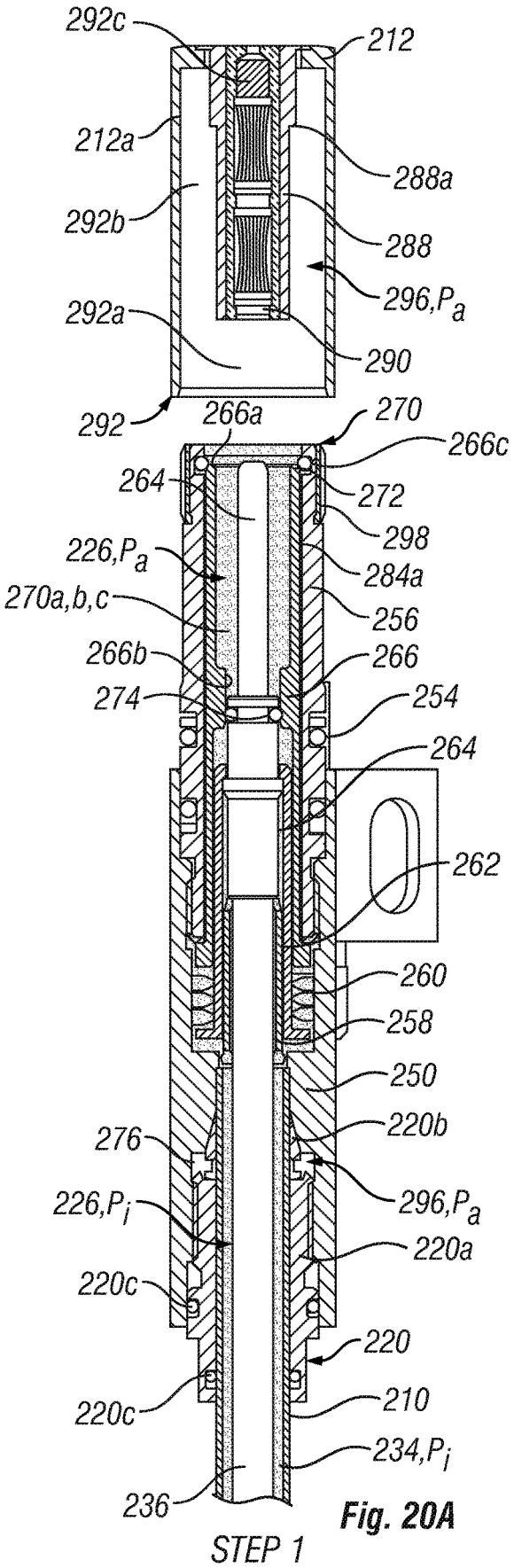
FIG. 20A is a side cross sectional view of the field connector plug disconnected from the field housing receptacle as in FIG. 10.
Figure 20B:
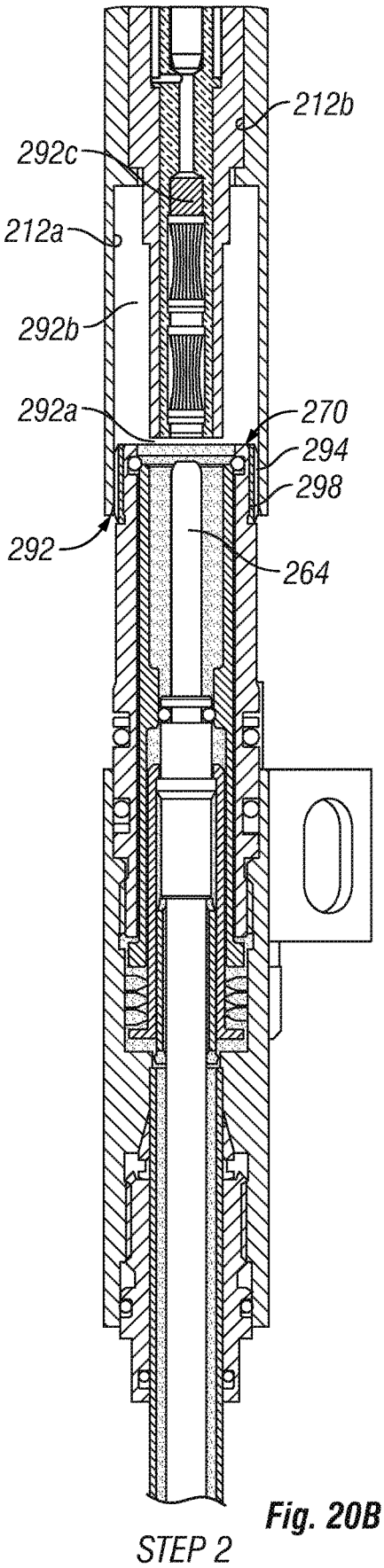
FIG. 20B is a side cross sectional view of the field connector plug in the process of being connected to the field housing receptacle.
Figure 20C:
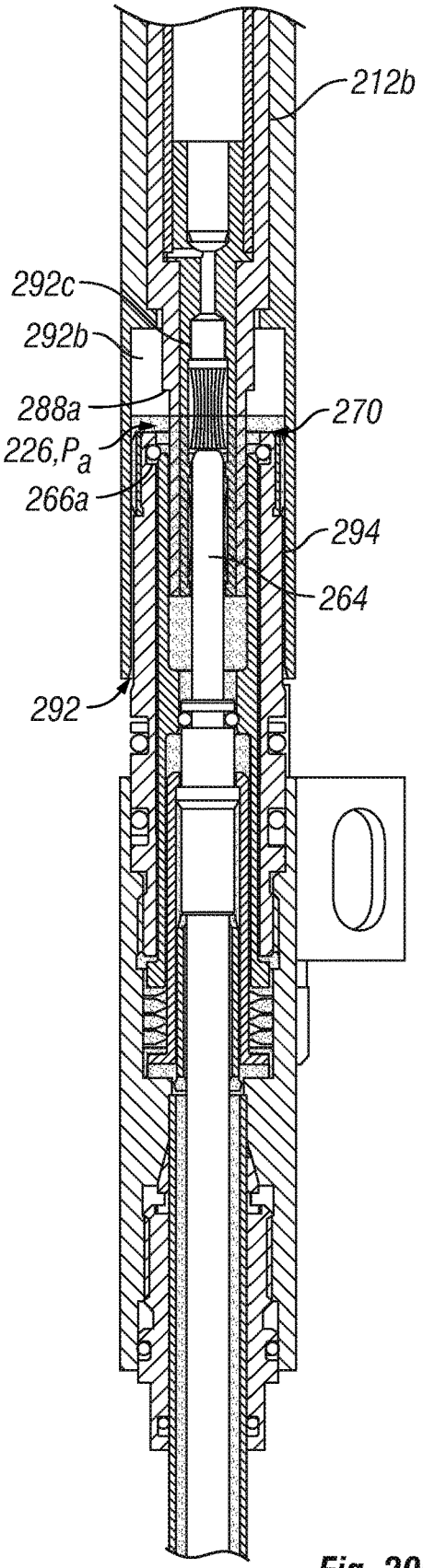
FIG. 20C is a side cross sectional view of the field connector plug in the process of being connected to the field housing receptacle.
Figure 20D:
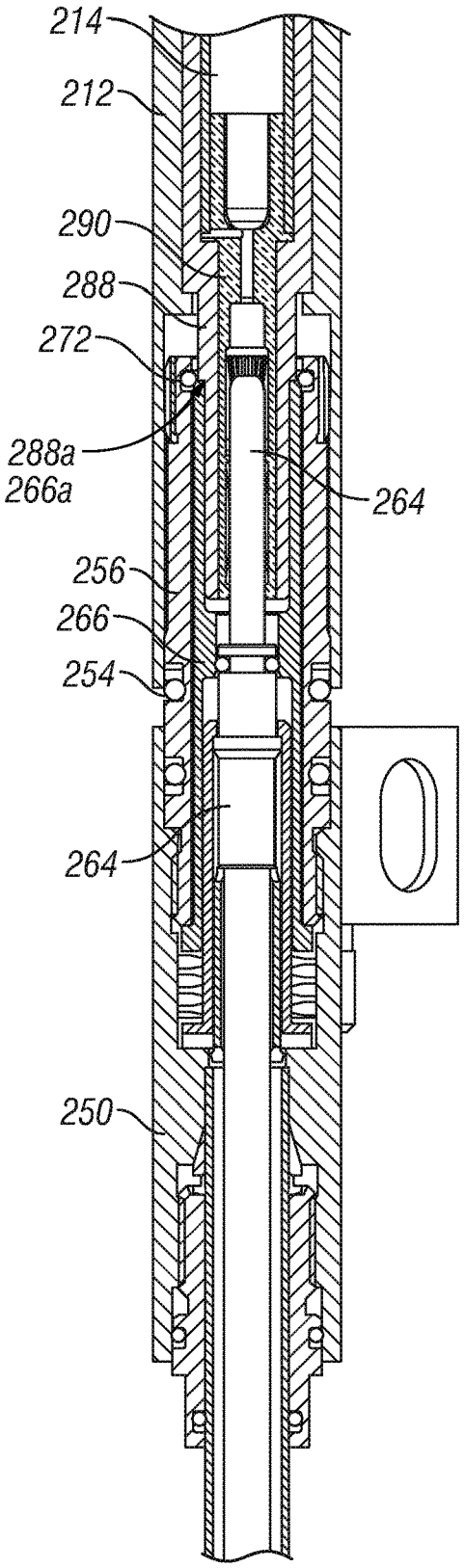
FIG. 20D is a side cross sectional view of the field connector plug in the process of being connected to the field housing receptacle and then initial activation of the field connector check valve.
Figure 20E:
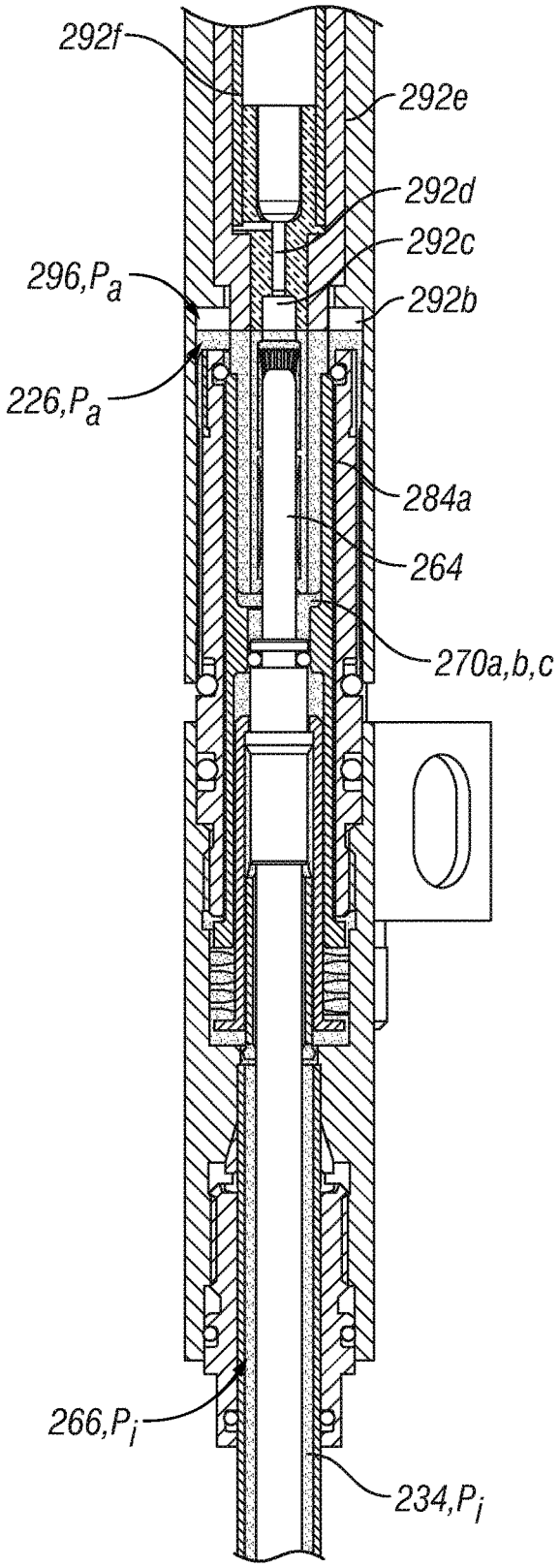
FIG. 20E is a side cross sectional view of the field connector plug further into the process of being connected to the field housing receptacle.
Figure 20F:
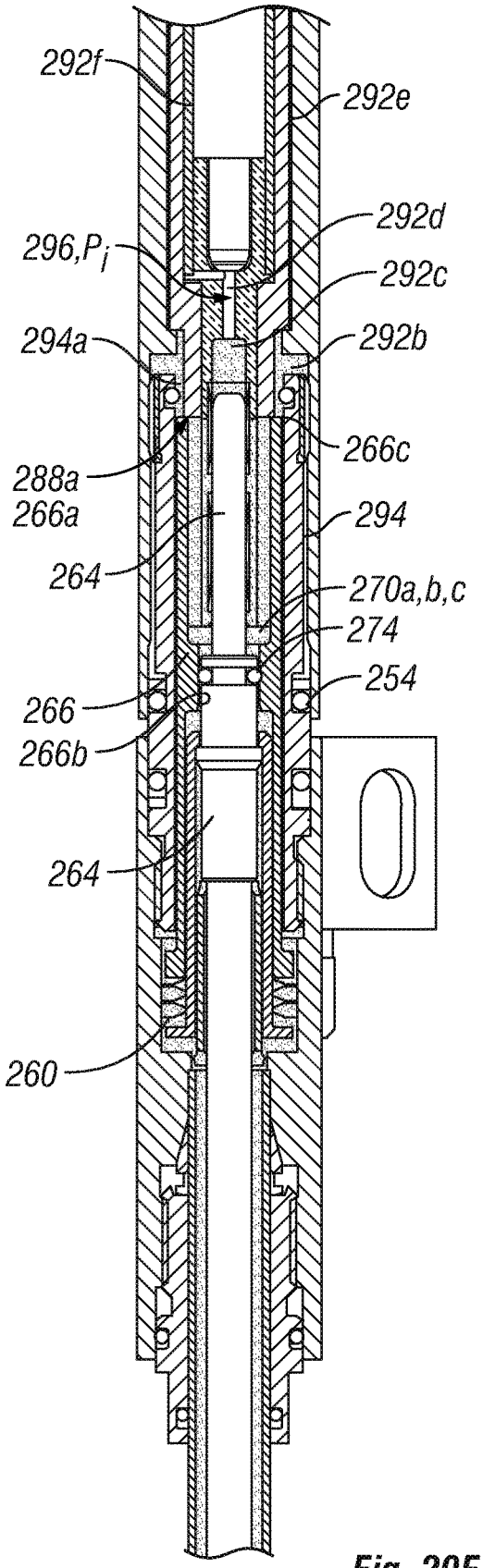
FIG. 20F is a side cross sectional view of the field connector plug further into the process of being connected to the field housing receptacle.
Figure 20G:
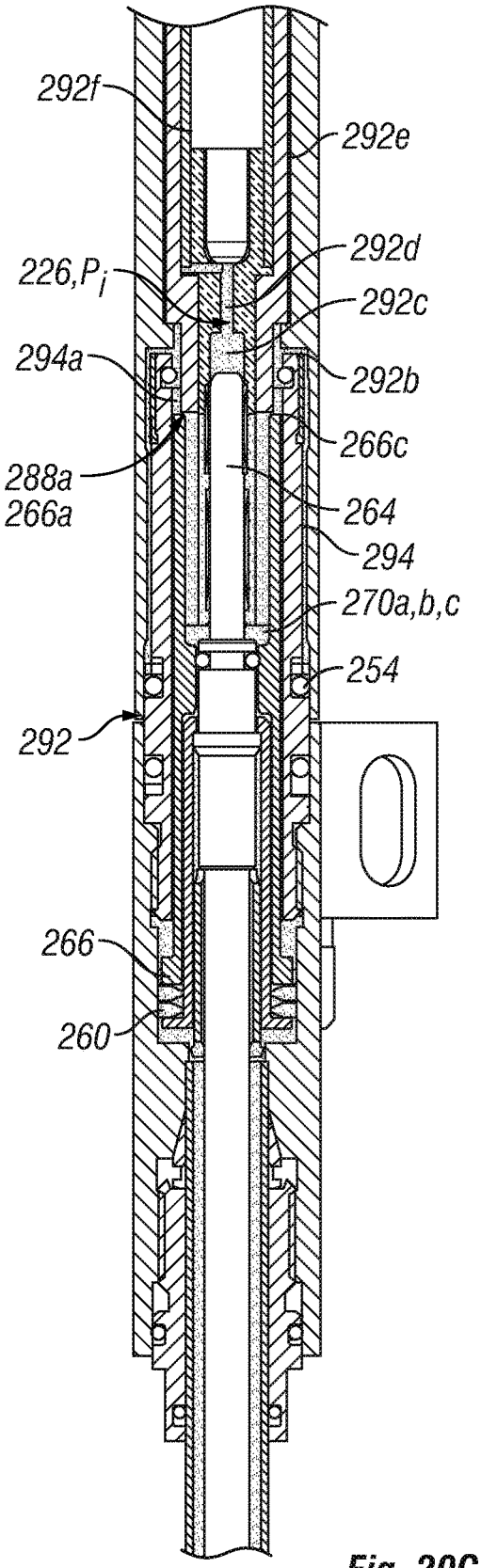
FIG. 20G is a side cross sectional view of the field connector plug fully engaged with and connected to the field housing receptacle.
Figure 21:
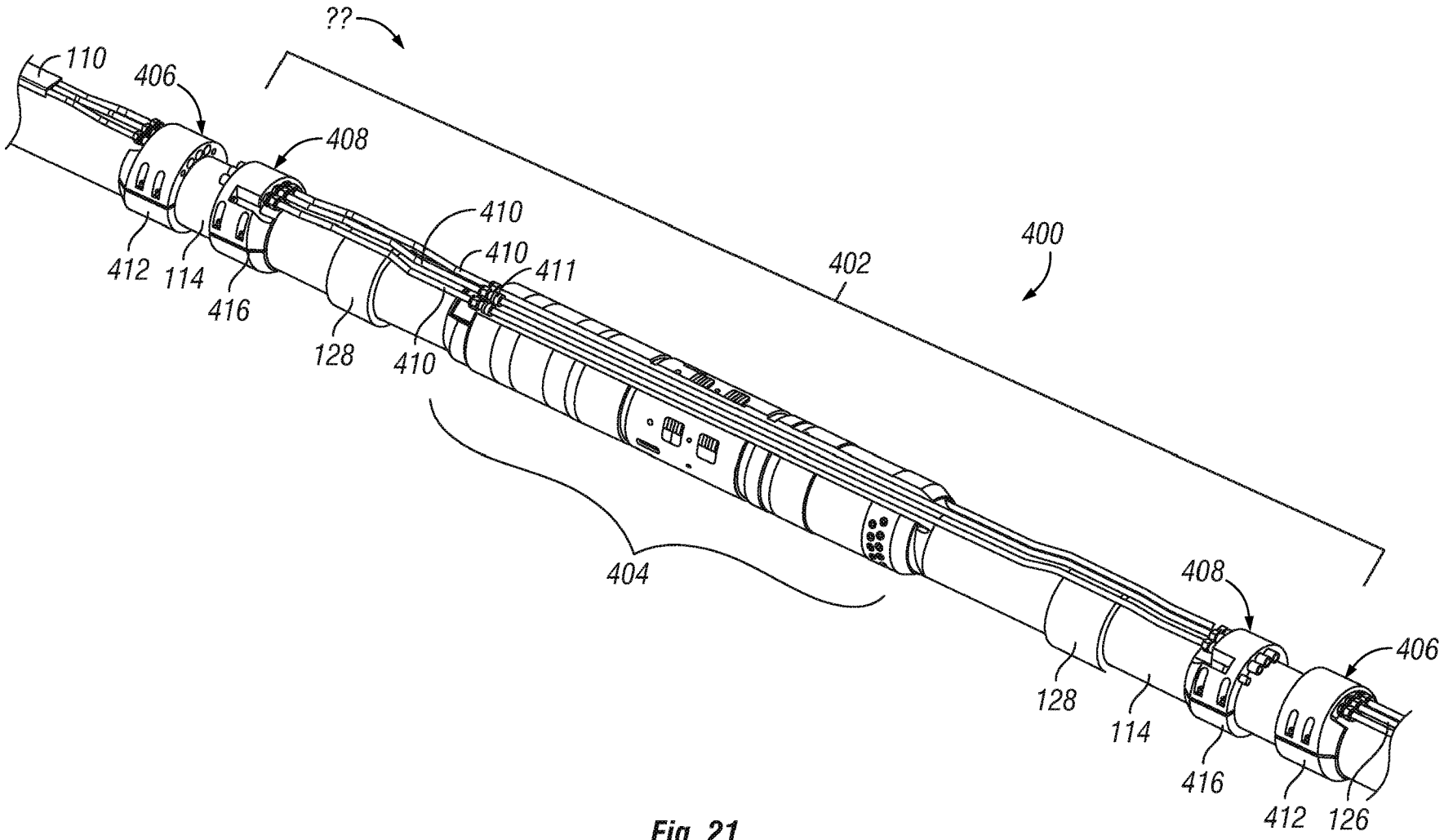
FIG. 21 depicts a perspective view of a field bypass connector system for downhole packer according to an embodiment of the present disclosure.
Figure 22:
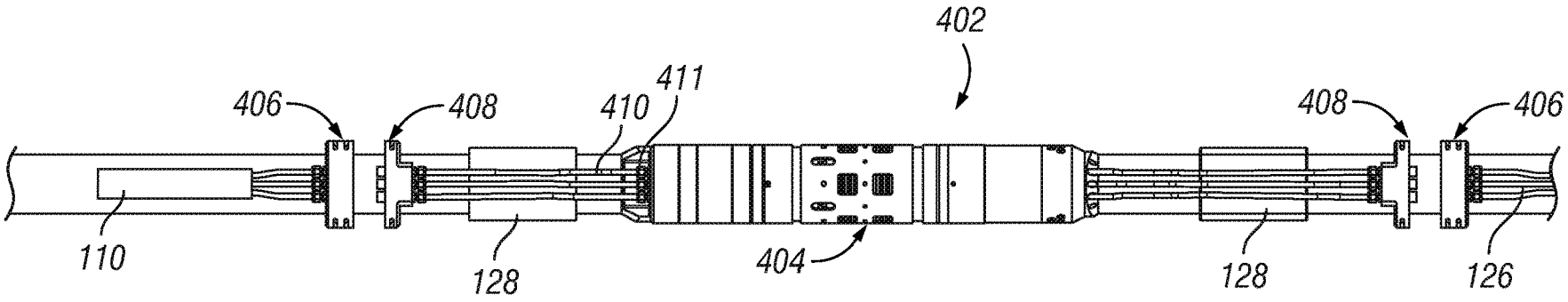
FIG. 22 is a top view of the field bypass connector system of FIG. 21.
Figure 23:
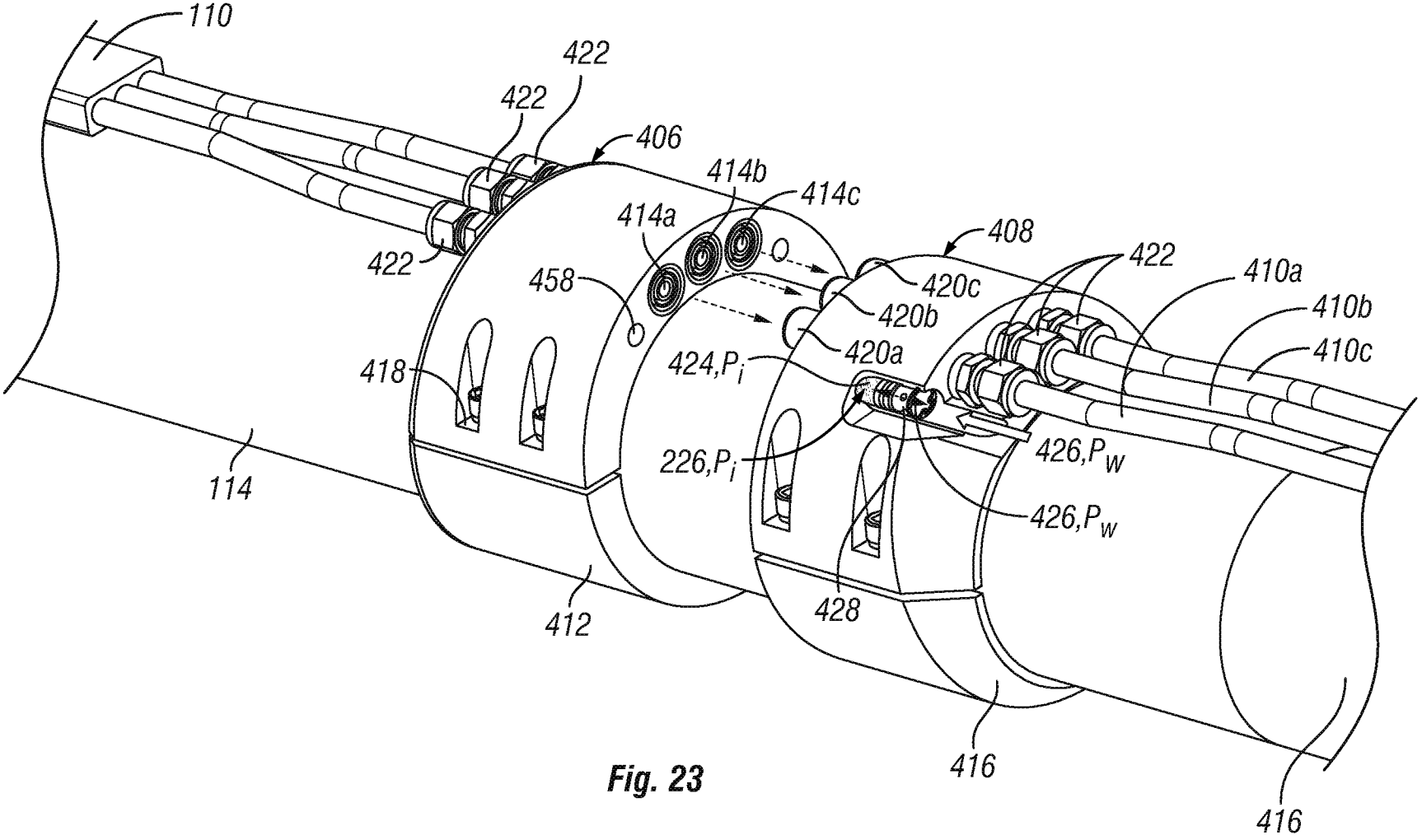
FIG. 23 depicts a perspective view of clamp-type field connector plug in the process of being connected to a clamp-type connector receptacle around the outside of a section of upper production tubing that leads to surface according to an embodiment of the present disclosure.
Figure 24:
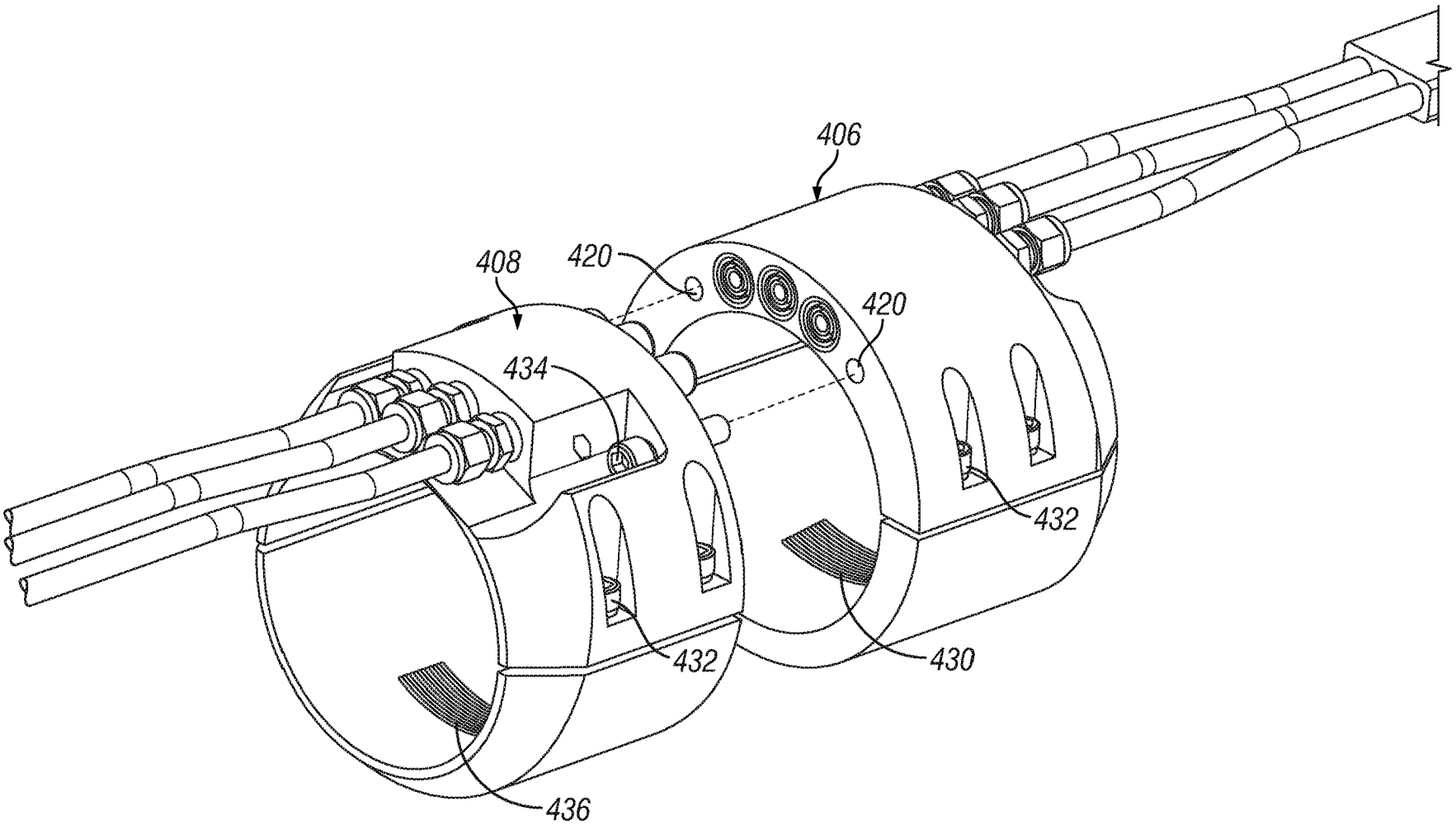
FIG. 24 depicts another perspective view of clamp-type field connector plug in the process of being connected to a clamp-type connector receptacle around the outside of a section of upper production tubing (not shown) that leads to surface according to an embodiment of the present disclosure.

Referring again to FIGS. 5, 5A and 5C, there is shown an alternate field connector plug 460 is shown with tubing encapsulated cable 126 (126*a,b,c*). In this embodiment, the field connector plug 460 comprises tubing encapsulated cable connected directly.

Figure 25:
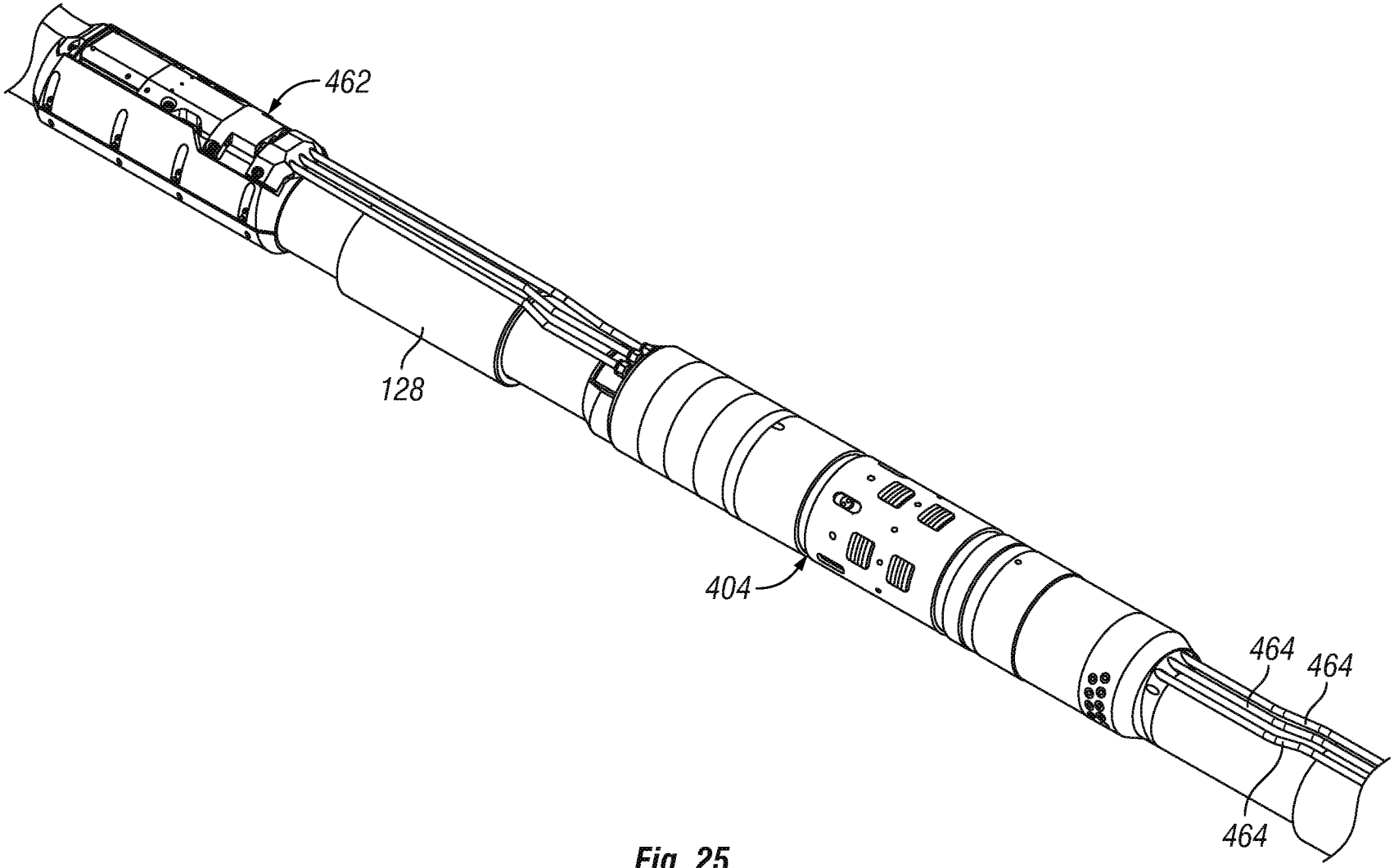
FIG. 25 illustrates a perspective view of completion equipment (such as a packer) with feedthroughs and an alternate mounting method for the bypass field connector according to an embodiment of the present disclosure.
Figure 25A:
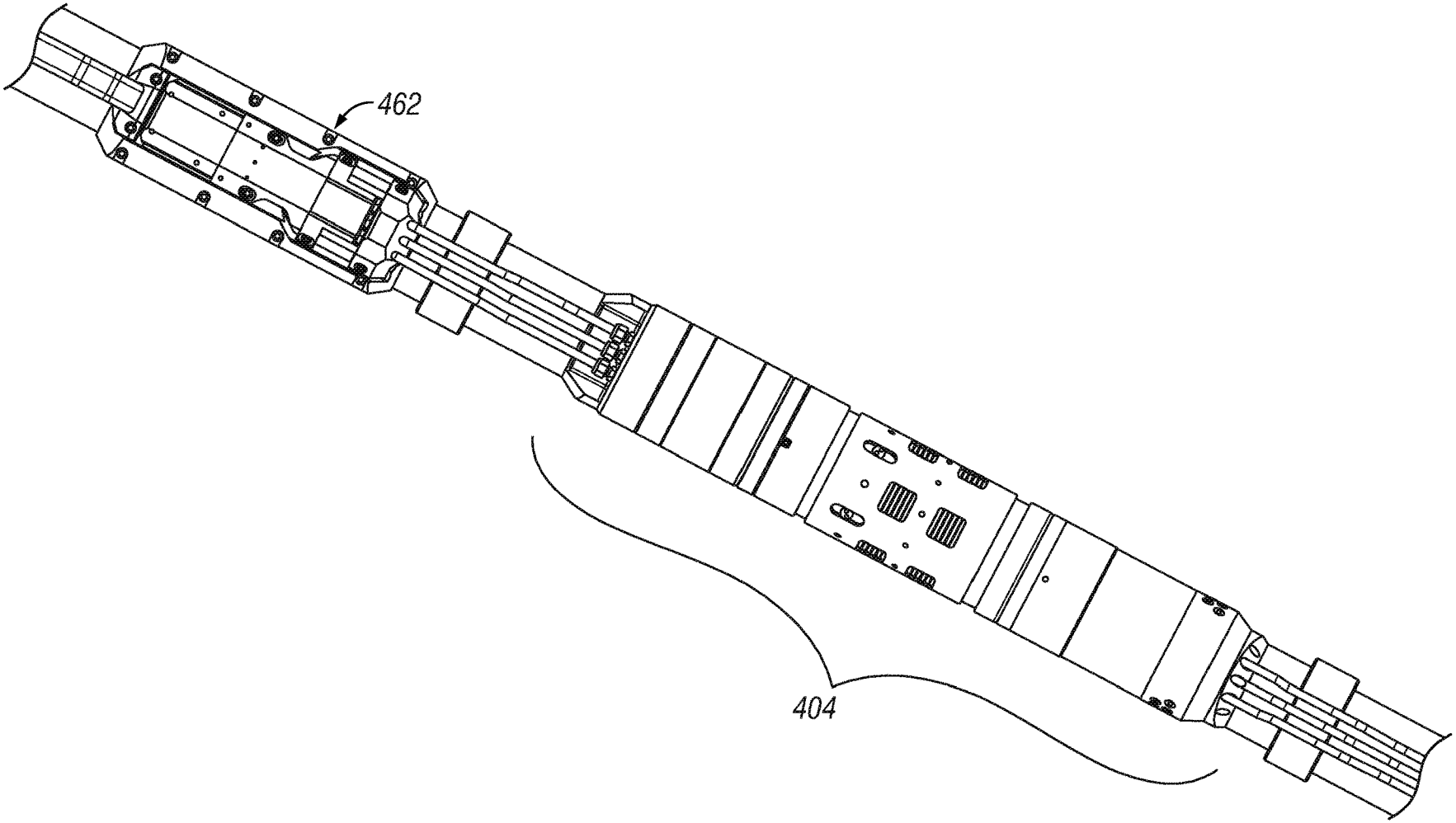
FIG. 25A is a top view of the equipment of FIG. 25.
Figure 25B:
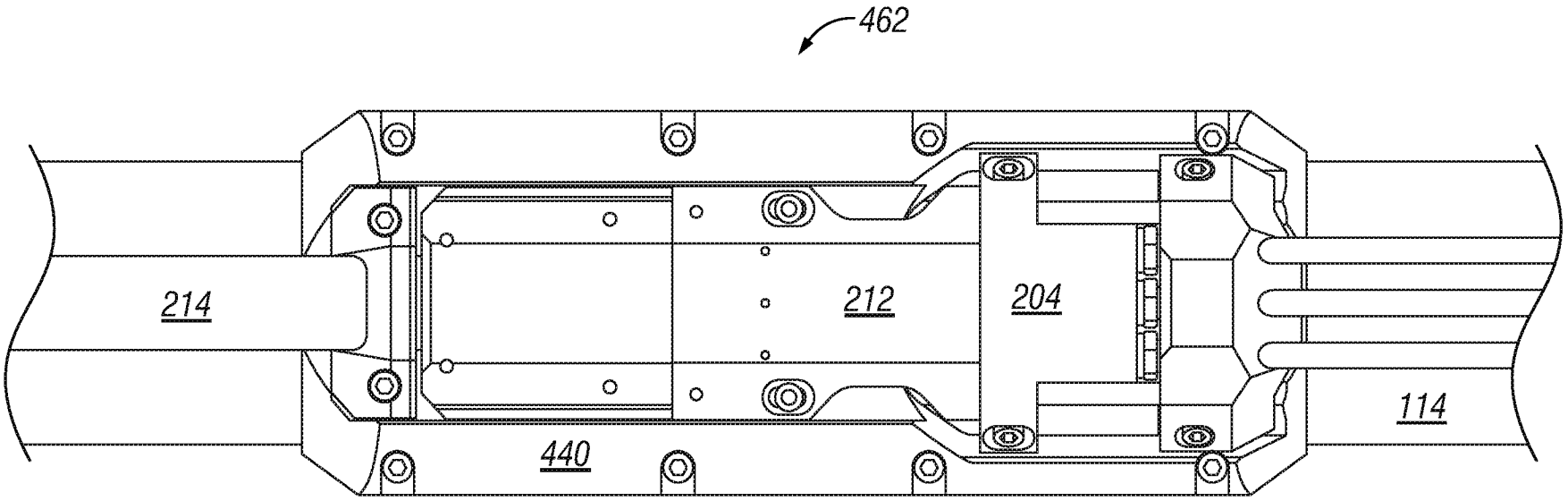
FIG. 25B is an enlarged view of a section of FIG. 25A.
Figure 26:
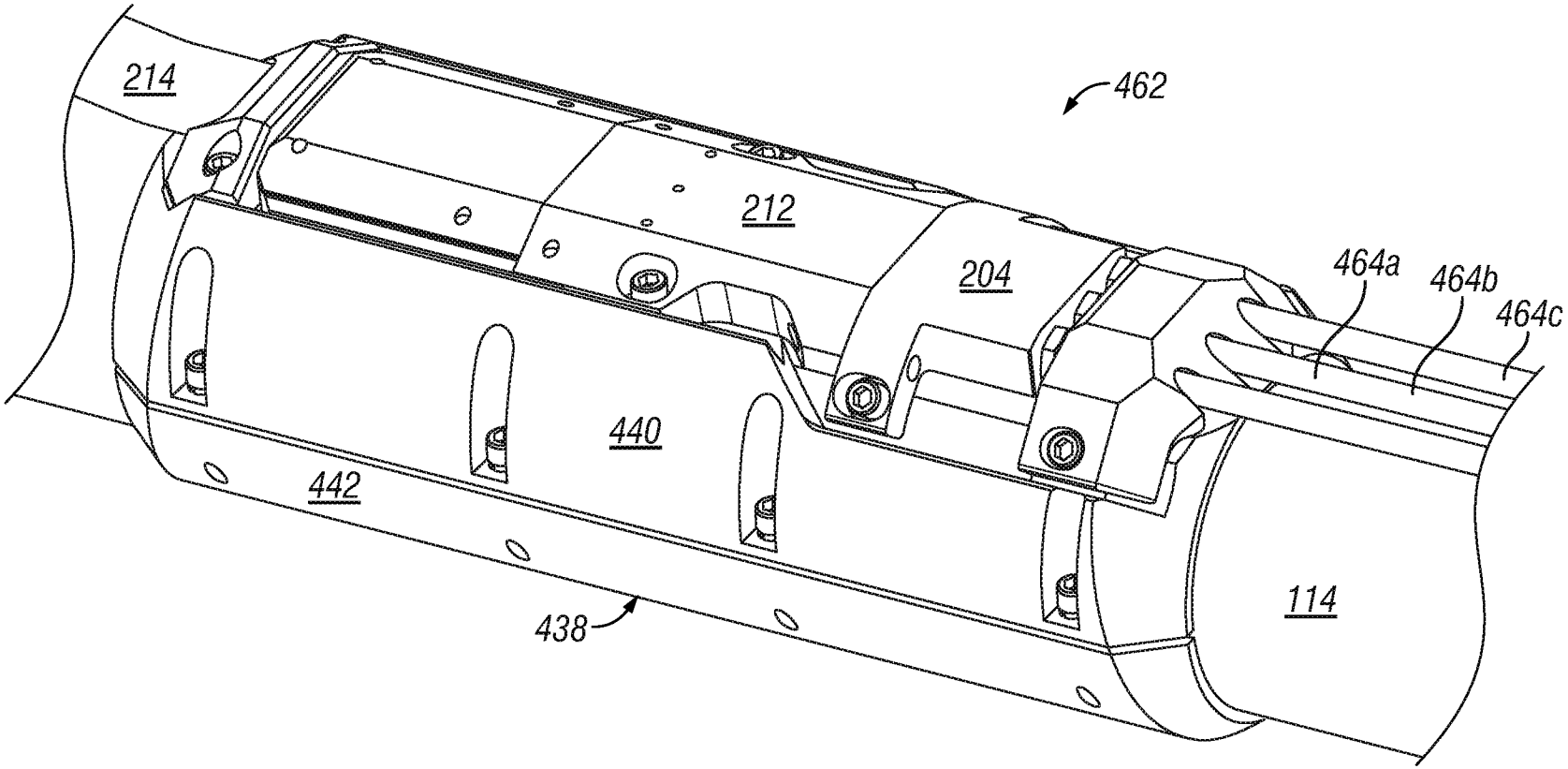
FIG. 26 is an enlarged section of FIG. 25 illustrating a bypass field connector mounting clamp according to an embodiment of the present disclosure.
Figure 27:
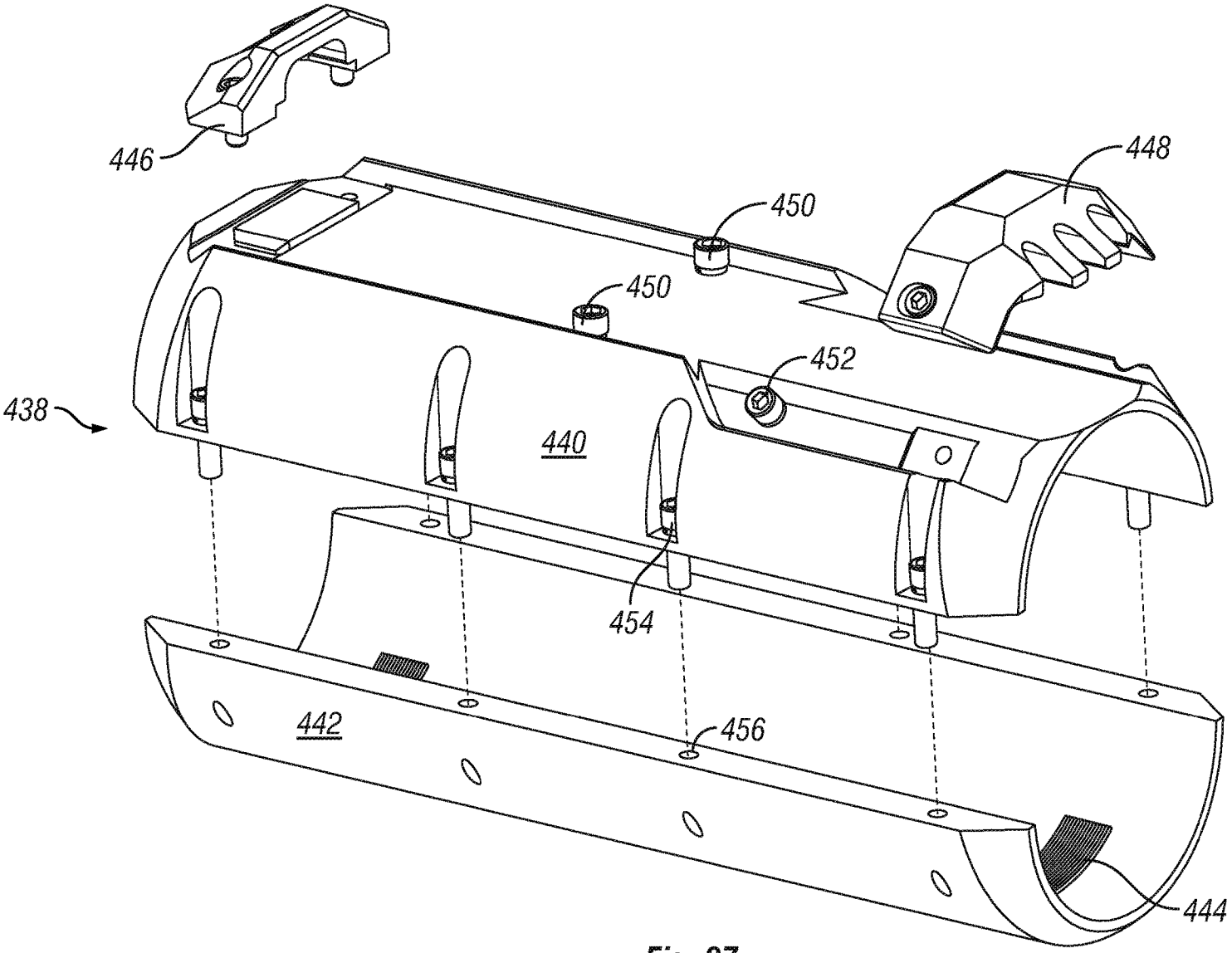
FIG. 27 is an exploded perspective view of the field connector mounting clamp of FIG. 26.
Figure 28:
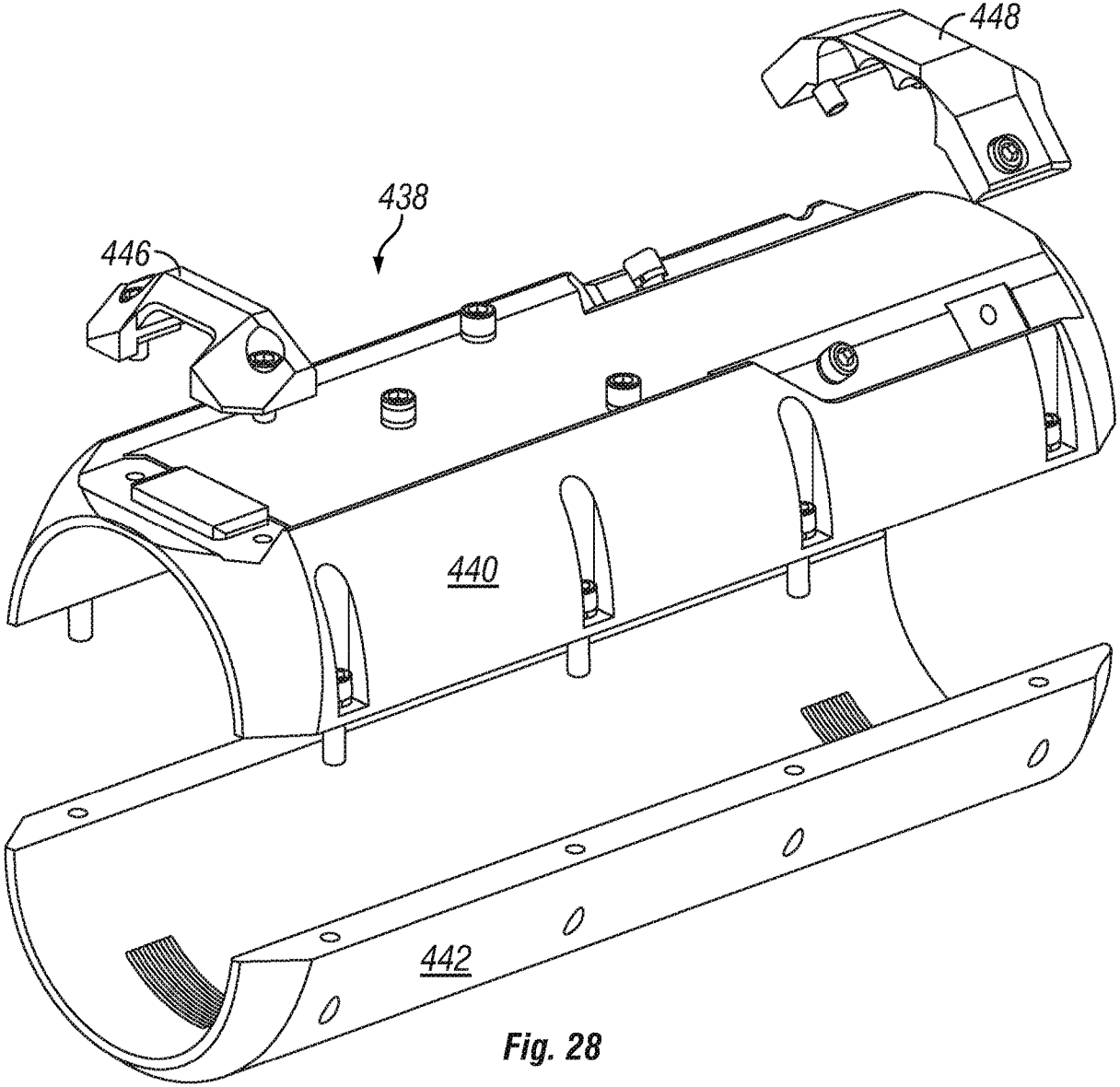
FIG. 28 is another exploded perspective view of the field connector mounting clamp of FIG. 26.
Figure 29:
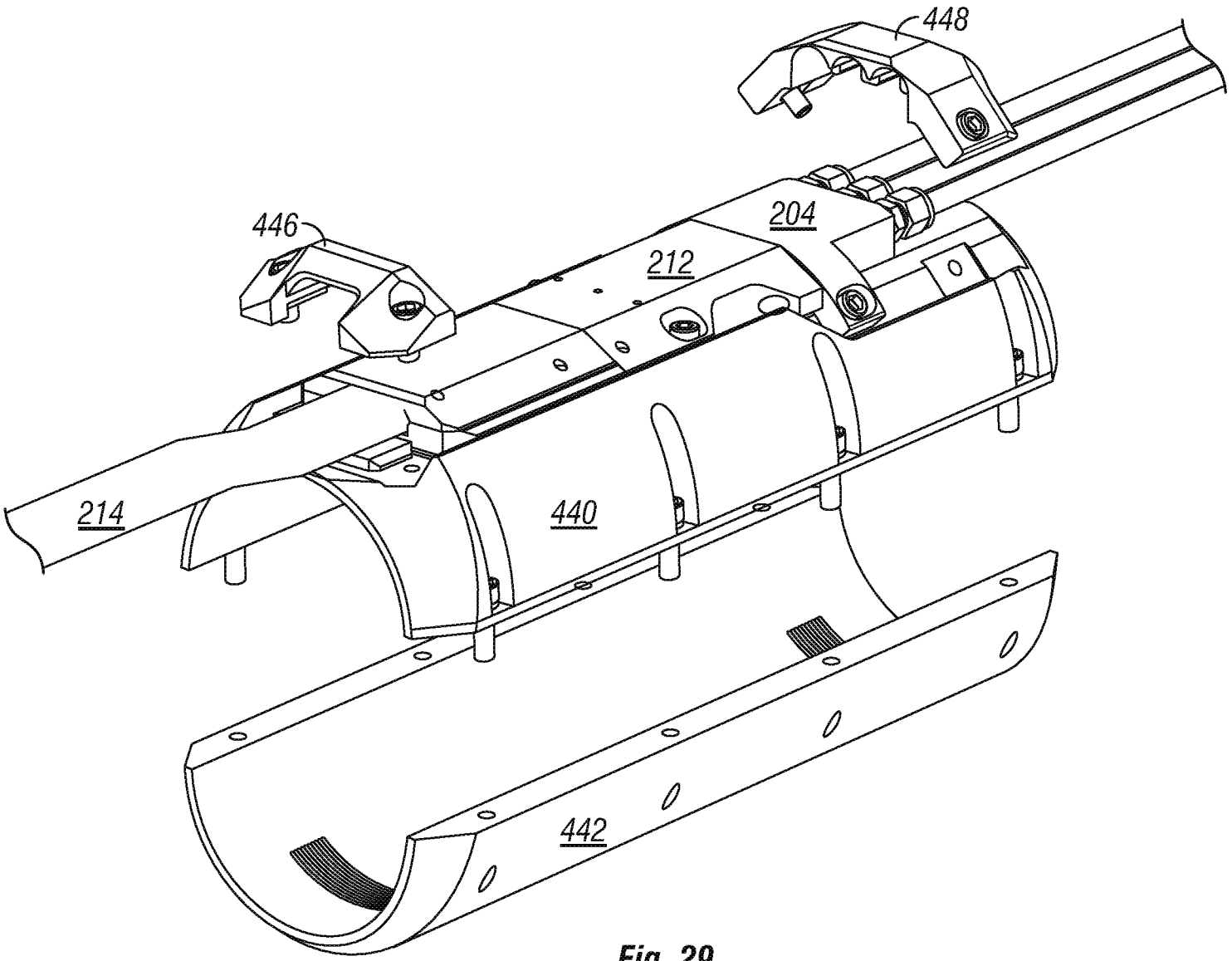
FIG. 29 is another exploded perspective view of the field connector mounting clamp of FIG. 26.
Figure 30:
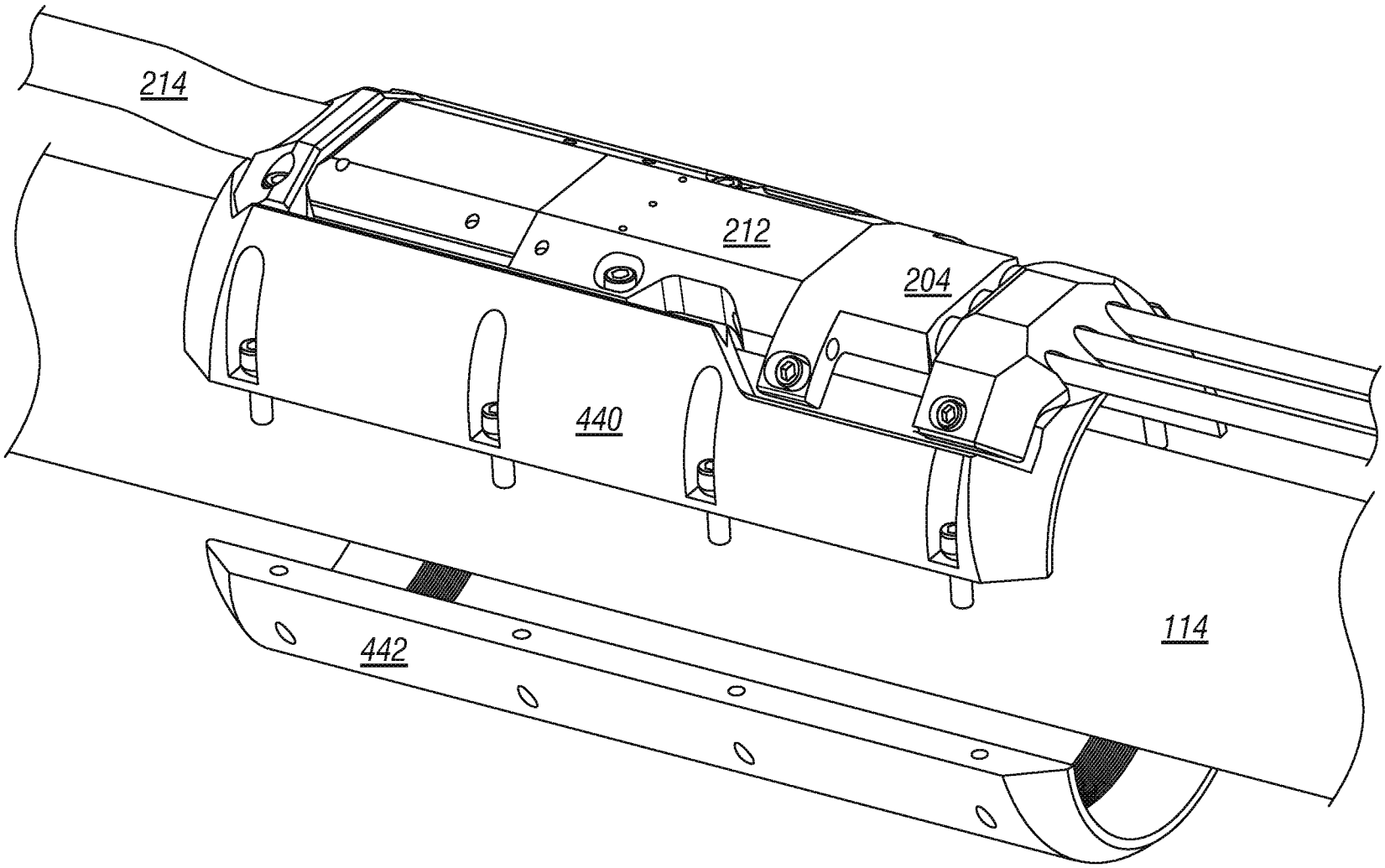
FIG. 30 is another exploded perspective view of the field connector mounting clamp of FIG. 26.

Referring also to FIG. 25, there is shown an alternate clamp mechanism 462 for mounting the plug 212 and receptacle 204 comprising a clamp with securing features.

Referring now to FIGS. 31-34A there is shown a retrievable wet connect system 500 also employing intensified dielectric fluid compensation according to the teachings herein. The system 500 is a plug-arm assembly or pressure compensated female connector system. At one end of system 500 is a pressure balance assembly 502 contained within pressure balance housing/body 510 serving as a pressure balancing and connector section. This connector end preferably has a split ring connection 512 to facilitate aligned threading. Bulkhead seals 514 are provided to make a sealed connection when the high pressure bulkhead connector 506 is connected. The pressure balance system 502 provides also plug arm extension tube body 516. A secondary housing 544 extends axially inwardly from the back side 506*a* of the bulkhead connector for a desired length to form a fluid compensation chamber 540*a* for containing a desired volume of dielectric fluid 226.

FIGS. 32A-33A show the housing 510 of a bulkhead connector or high pressure connector 506. The pressure balance assembly 502 contains an internal chamber 540*a* (formed by secondary housing 544) for receiving dielectric (pressure compensating) fluid 226 at a desired pressure $P_i$ (542) through port 518. Chamber 540*a* forms part of the overall dielectric oil 226 volume capacity 540. The dielectric oil 226 volume capacity comprises, e.g., the internal space 540*a* of the secondary housing 544, the interior annular space 540*b* within each tube 524 surrounding each electric cable 536, the bellows annular space 540*c* between the outside surface 550*c* of the bellows 500 and the inside surface of the compensator main body 522, the internal spaces 540*d*, 540*e* on the interior of connections 520 (520*a*, 520*b*), the internal spaces 540*f* within bulkhead connector 506, and the interior space 540*g* defined as the oil cavity 554 on the inside of the downhole female wet connect arm main body/housing 528. The tubes 524*a,b,c* are connected to compensator main body 522 via sealed tube fittings/connections 520*a*, 520*b*.

The metal encapsulating tubes 524 (524*a*, 524*b*, 524*c*) are used to encapsulate/house electric cables 536 (536*a*, 536*b*, 536*c*)—the insulated power or instrumentation cables. Each tube 524 extends between tube fitting female connector sections 520 (520*a*, 520*b*) on each end for sealing the encapsulated tube volume. Each tube 524 houses a cable 536 and contains an internal annular space or cavity 540*b* around the outside of each cable 536, each annular space 540*b* containing dielectric fluid 226, and forming part of the overall dielectric oil volume cavity 540.

A bellows system 508 is connected to the compensator main body 522. The bellows comprises an expandable body 550 having a first end 550*a*, a second end 550*b*, an outer surface 550*c*, an internal surface 550*d* and an internal cavity 538 in fluid communication with wellbore fluid 228 residing within inner annular spaces of the tool. The expandable body 550 extends within the compensator main body 522 from the bellows body second end 550*b* where it is secured at its second end 550*b* to the end of the main body 522 using, e.g., a retention mechanism 546, such as a snap ring or the like. The outer surface 550*c* of the bellows 550 extends within the main body 522 forming an annular channel 540*c* segment of dielectric oil chamber 540 between the outer bellows surface 550*c* and the inner surface of the main body 522. A fixed bellows sealing cap 552 creates a seal around the point of connection to prevent wellbore fluid 228 from entering into the dielectric fluid chamber 540*a* and mixing with the dielectric fluid 226 contained within the fluid compensation areas 540 (*a-g*). At the first end of the bellows 550*a*, a moving bellows cap 548 serves to seal the moving end of the bellows against any wellbore fluid 228 from the internal bellows cavity 538 and to provide compensating motion in response to wellbore fluid pressure $P_w$. The dielectric fluid chambers 540 (*a, b, c, d, e, f*) are in fluid communication with each other, and the internal pressure P of the dielectric fluid 226 contained within the chambers 540 is established initially as the desired fluid pressure upon introducing the dielectric fluid 226 into the port 518, and then can change in response to interaction with the bellows 508.

Figure 34:
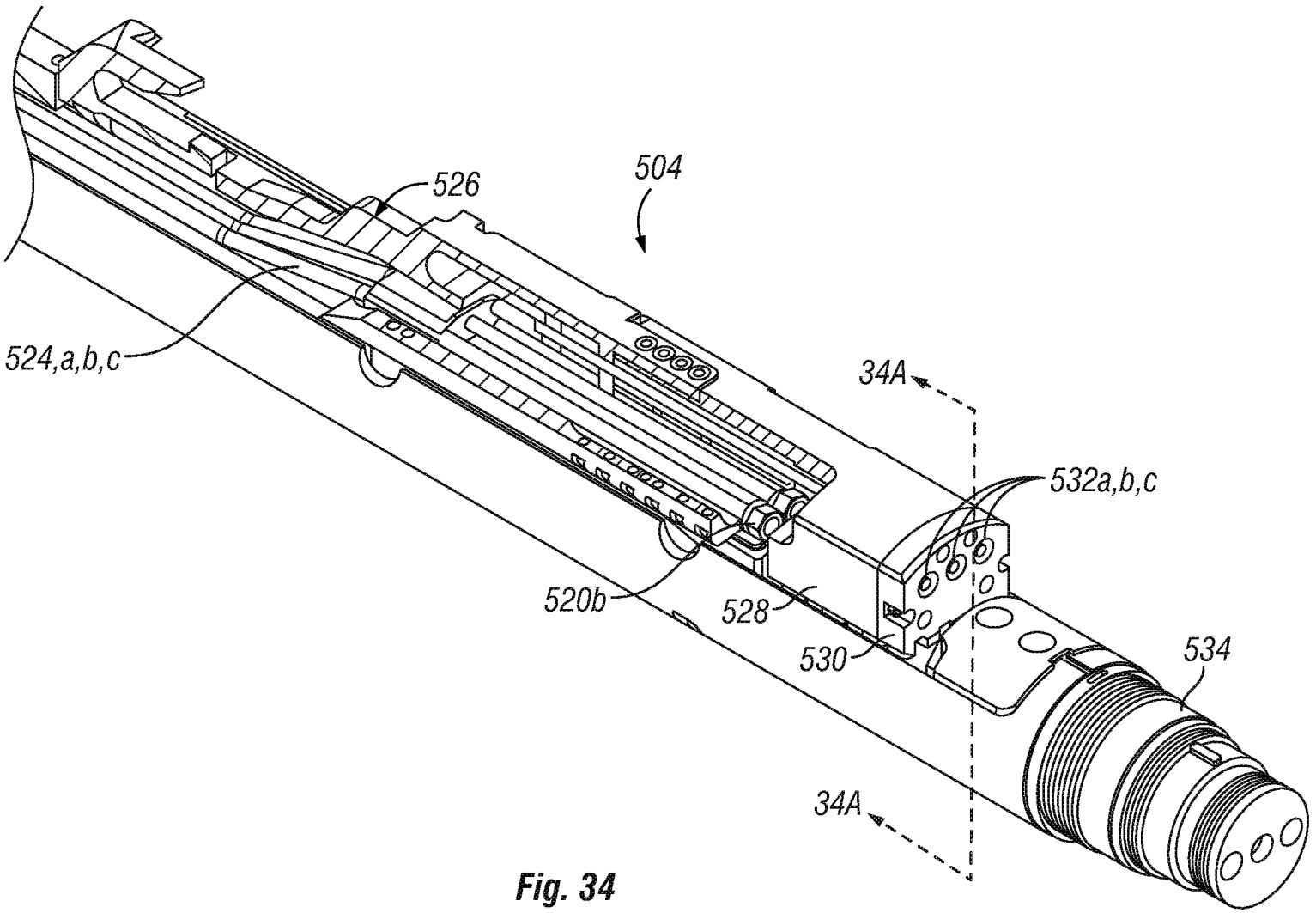
FIG. 34 is a partial cut-away enlarged view of the other end of the retrievable wet connect system of FIG. 31.
Figure 34A:
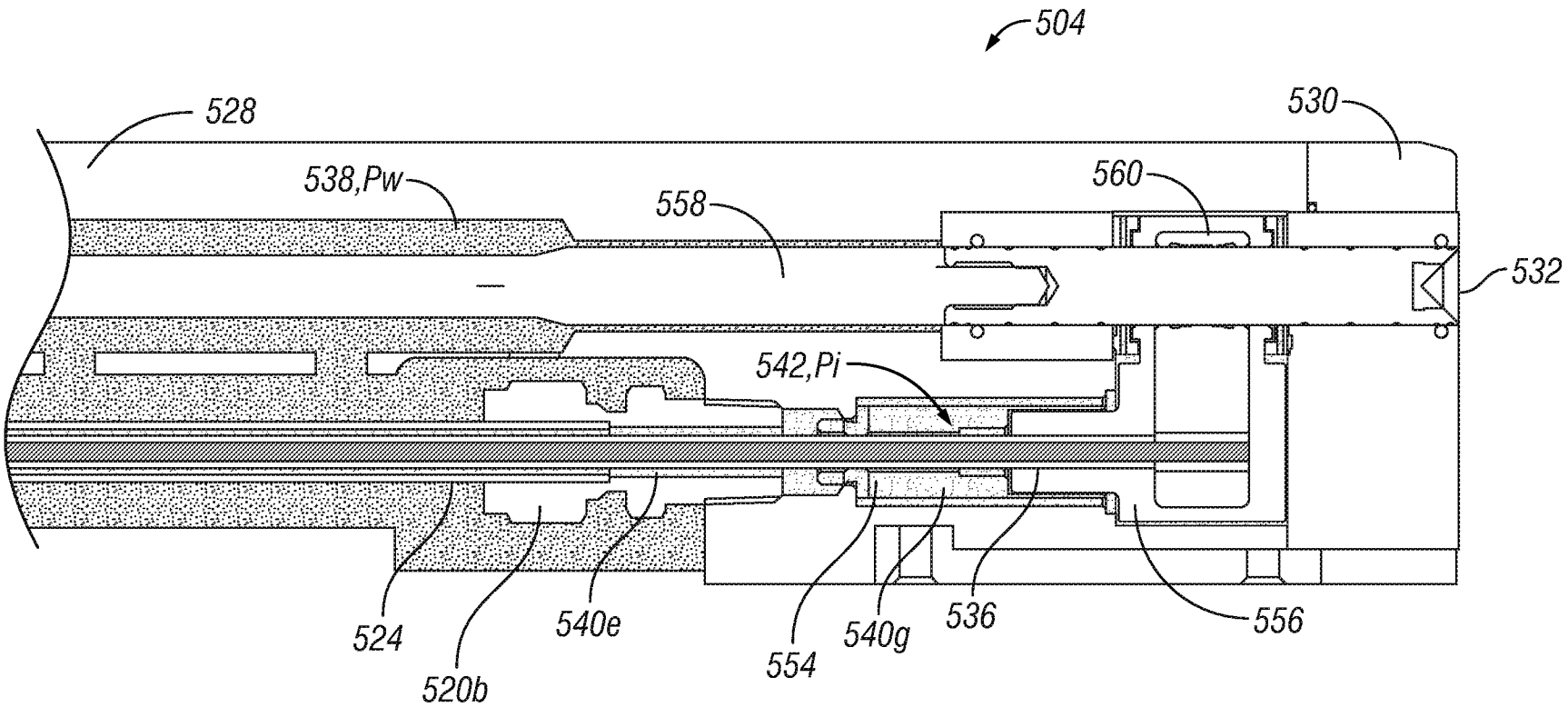
FIG. 34A is a longitudinal cross-sectional view of the system of FIG. 34.

Referring also to FIGS. 34 and 34A, at the opposite end of system 500 is a female wet connect assembly or plug head assembly 504. The female wet connect assembly 504 further comprises a plug arm assembly hook 526 serving as a mounting hook for the plug arm assembly, and a plug arm front plate 530 serving as the front plate of the female connector assembly. The plug arm front plate 530 is outfitted with female connector sockets 532 (*a, b, c*) that are protected with spring loaded retractable pins 558 which serve to protect the female contact body area 560 of the female wet connect. The female wet connect further comprises an insulator body 556 for insulating the contact of the female wet connector. As described earlier, metal encapsulated tubing 524 connects with the female wet connect via connections 520*b* and the internal electrical cable 536 in each tube continues into the female contact body 560 to complete its connection from the bulkhead connector 506 to the wet connect. As noted above, the dielectric (pressure compensating) fluid 226 (at a desired pressure $P_i$ (542)) resides within the female wet connect as follows: The dielectric fluid is introduced through port 518 to fill the internal chambers 540. The dielectric fluid is introduced into chamber 540*a* forms part of the overall dielectric oil 226 volume capacity 540, and the fluid 226 is therefore in fluid communication throughout the dielectric fluid chamber 540, including the internal space 540*a* of the secondary housing 544, the interior annular space 540*b* within each tube 524 surrounding each electric cable 536, the bellows annular space 540*c* between the outside surface 550*c* of the bellows 500 and the inside surface of the compensator main body 522, the internal spaces 540*d*, 540*e* on the interior of connections 520 (520*a*, 520*b*), the internal spaces 540*f* within bulkhead connector 506, and the interior space 540*g* defined as the oil cavity 554 on the inside of the downhole female wet connect arm main body/housing 528. The plug head assembly further comprises at its end a threaded connection for threading the plug-arm assembly 500 onto a lower section, such as a deployment section in the tubing string.

Figure 31:
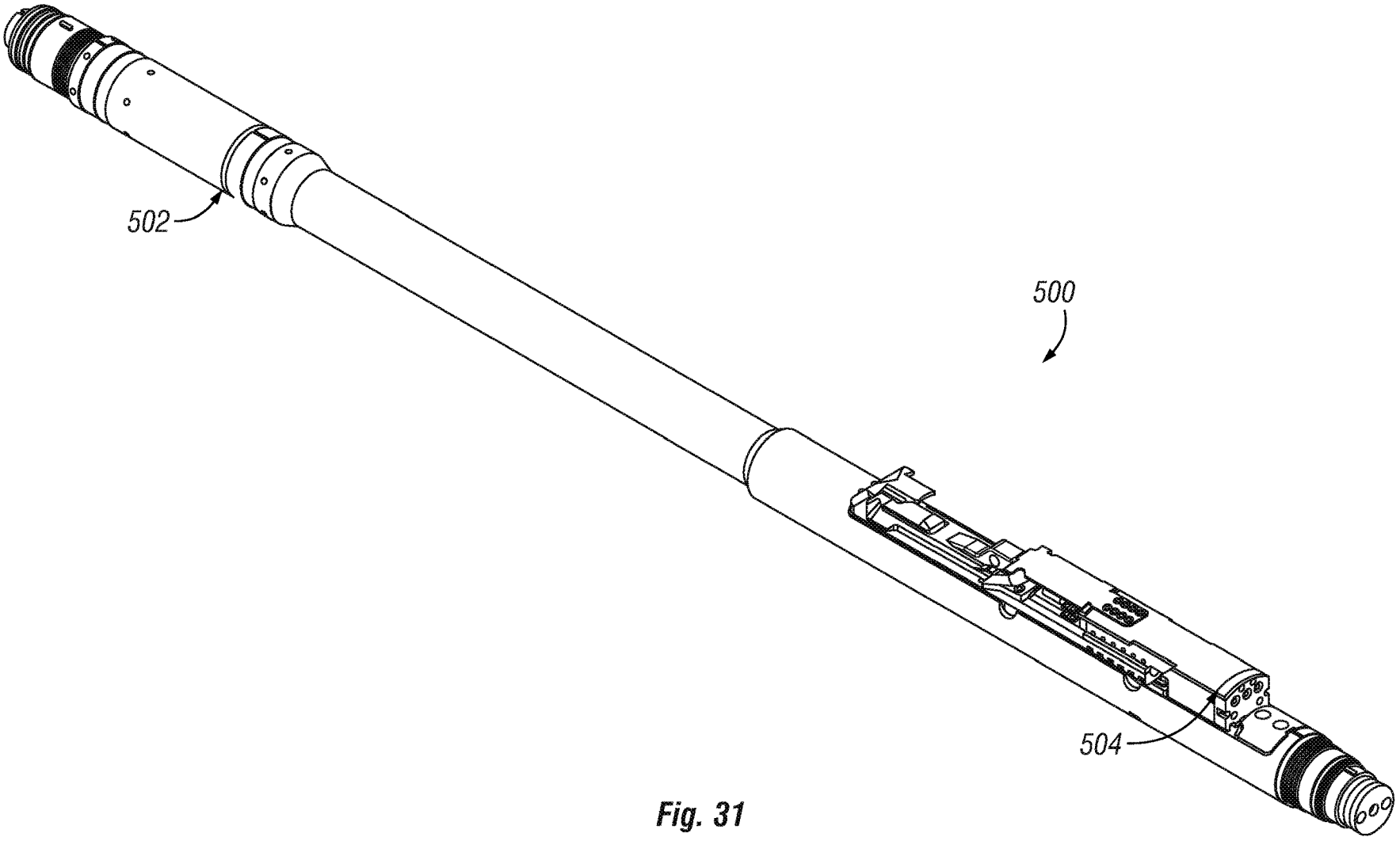
FIG. 31 illustrates a perspective view of a retrievable wet connect system according to an embodiment of the present disclosure.
Figure 31A:
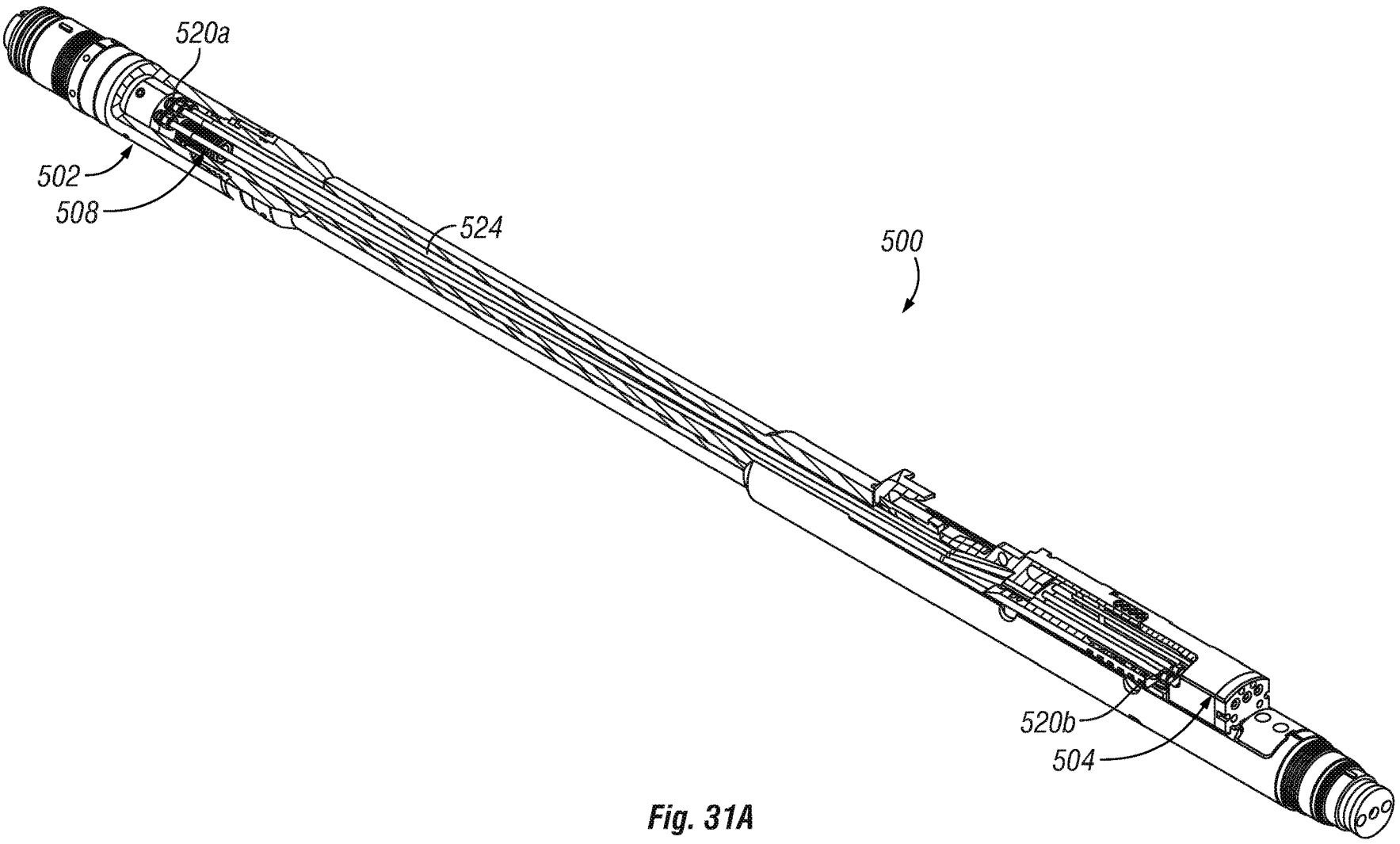
FIG. 31A is a partial exposed view of the retrievable wet connect system of FIG. 31.
Figure 32:
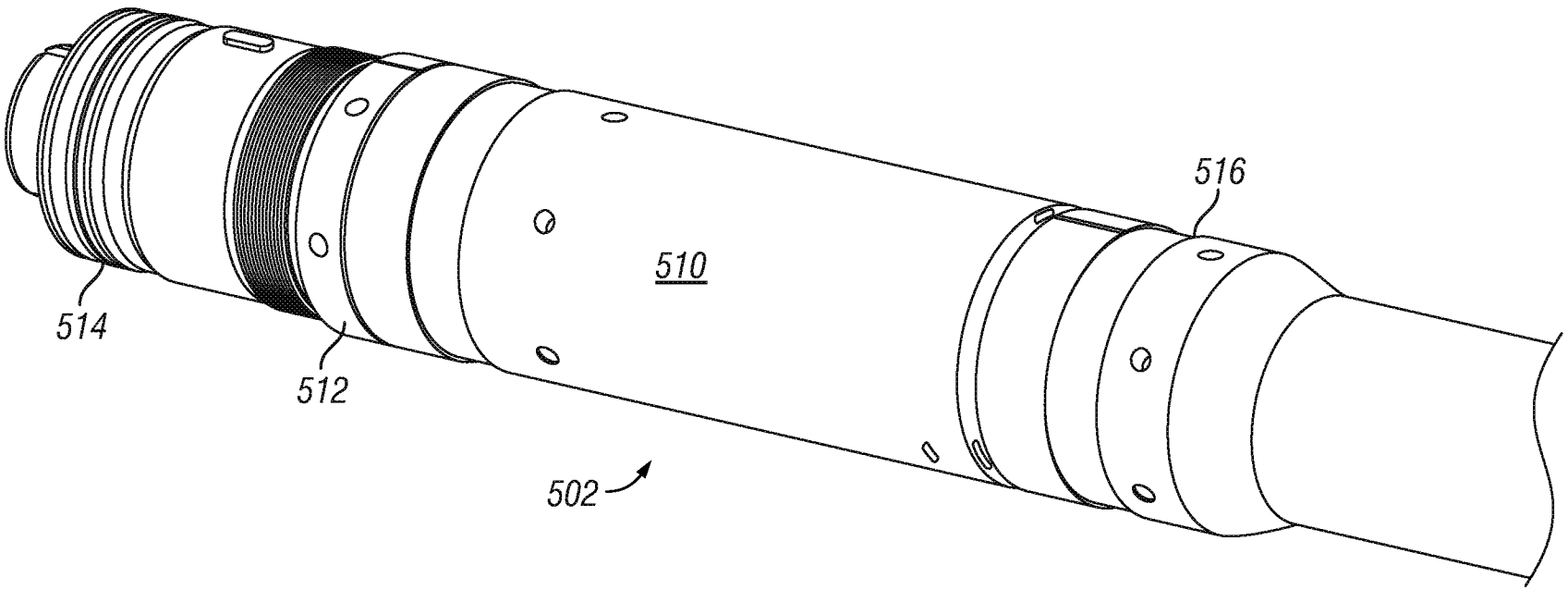
FIG. 32 is an enlarged view of one end of the retrievable wet connect system of FIG. 31.
Figure 32A:
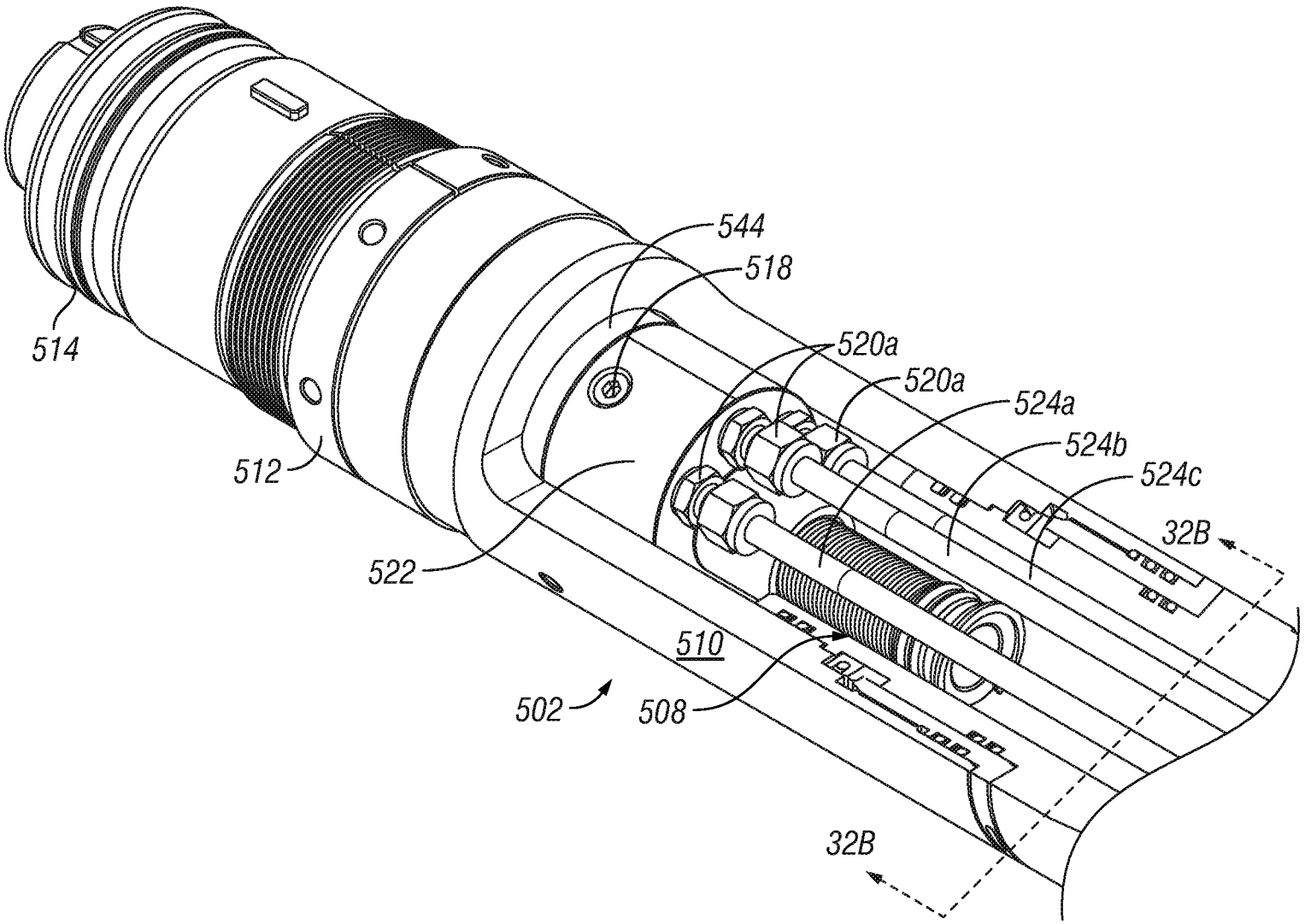
FIG. 32A is partially exposed view of the system of FIG. 32.
Figure 32B:
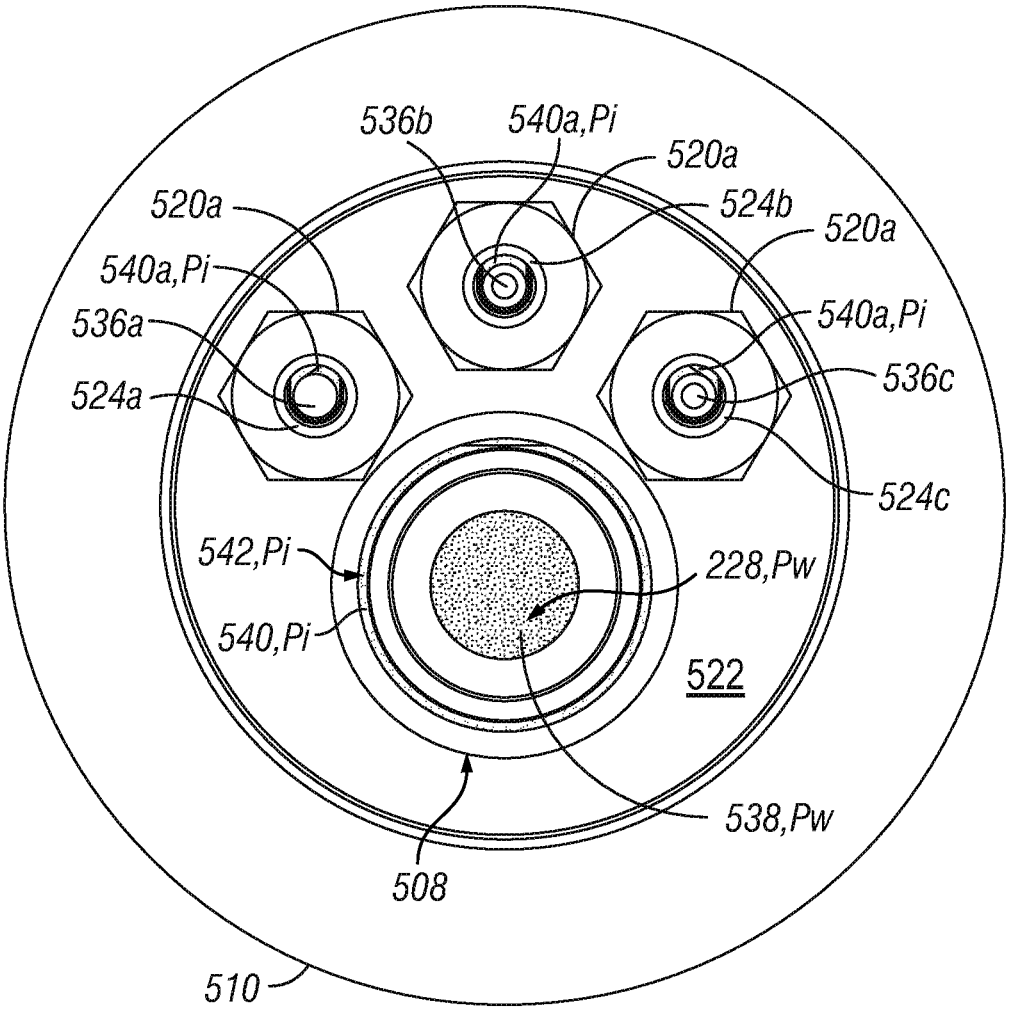
FIG. 32B is a cross-sectional view taken along lines 32B-32B of FIG. 32A.
Figure 33:
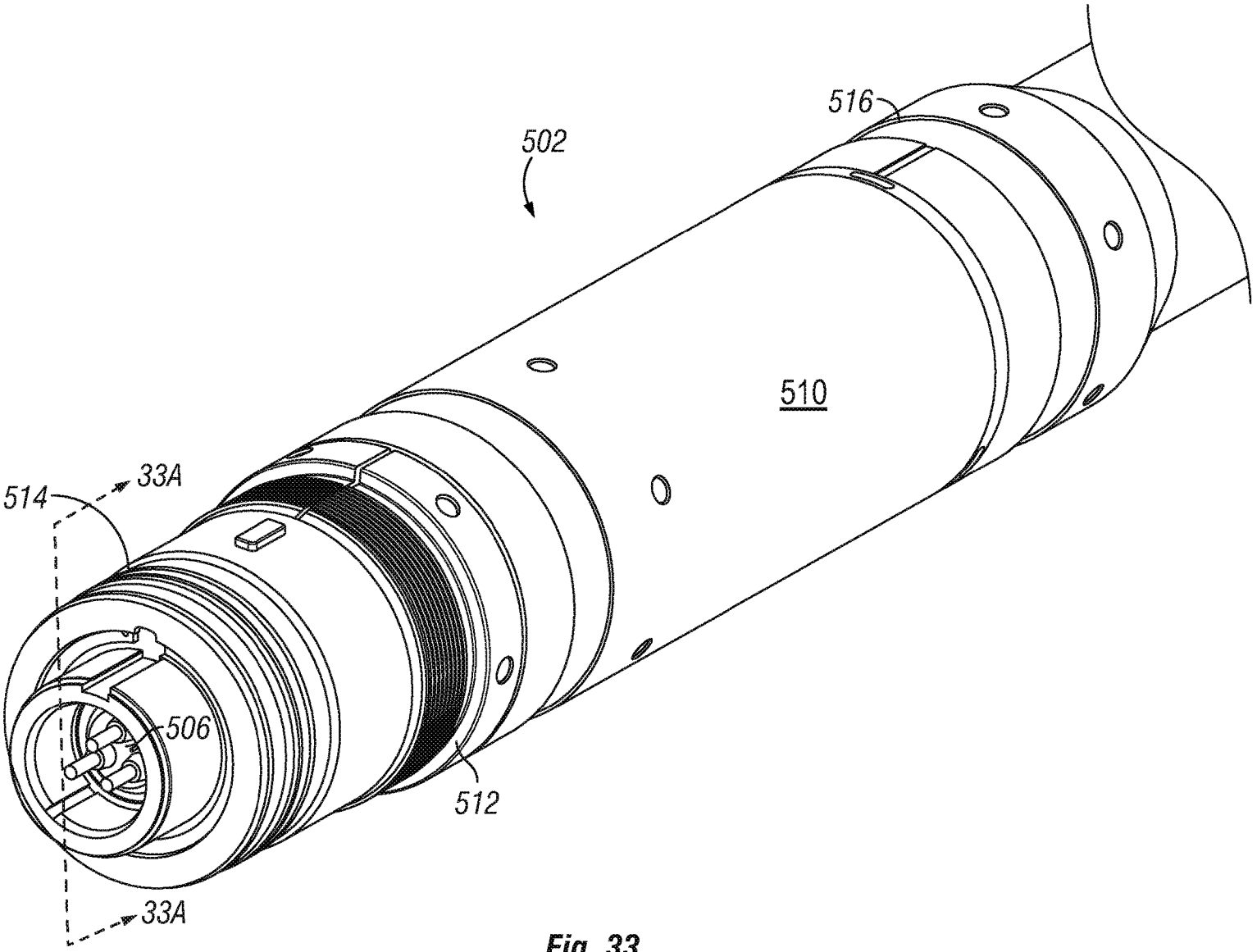
FIG. 33 is an enlarged end perspective view of the retrievable wet connect system of FIG. 32.
Figure 33A:
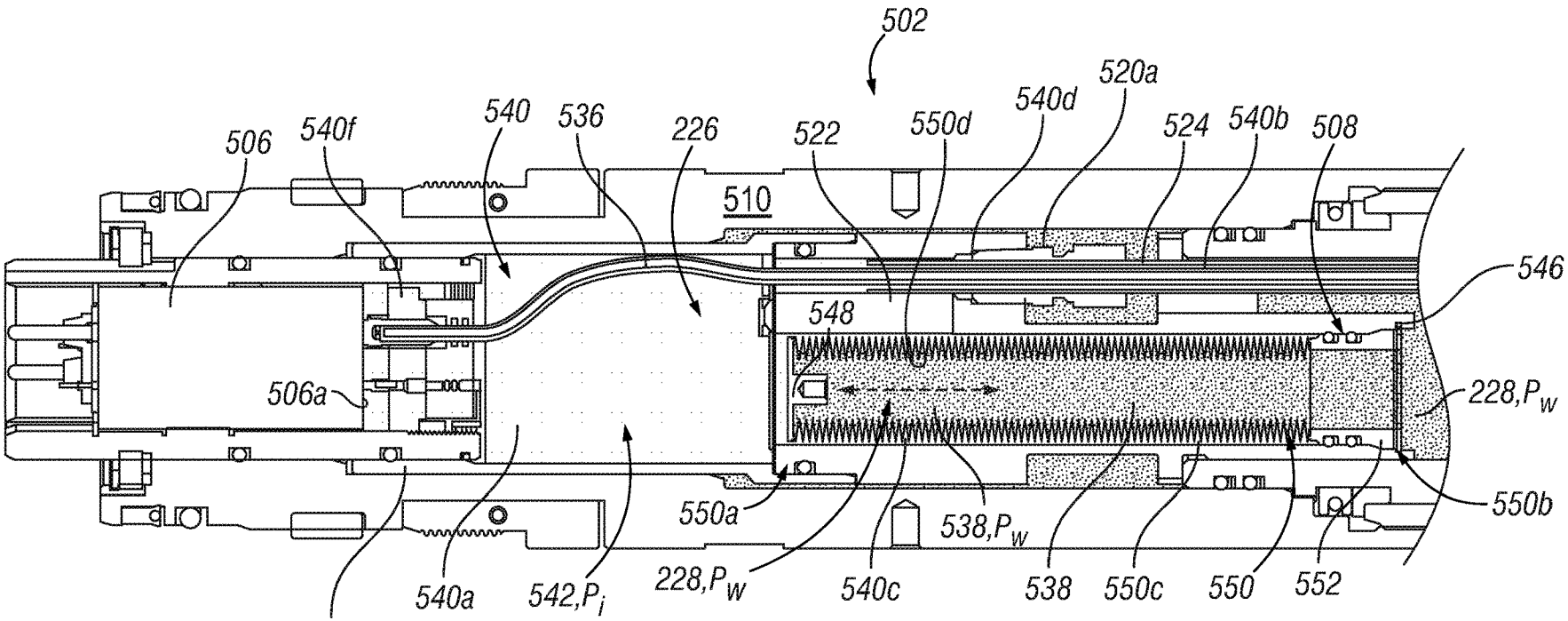
FIG. 33A is a longitudinal cross-sectional view of the system taken along lines 33A-33A of FIG. 33.

In this embodiment, the dielectric fluid 226 is introduced via sealed filler port plug 518 into fluid conduits to provide additional compensation around the wet connector, incorporating the concepts and teachings of the prior embodiments. A bellows assembly or bellows compensation system/mechanism 508 reacts to the wellbore pressures 538, $P_w$. FIG. 31A shows the electrical connectors 520*a*, 520*b* mounted on housing for exemplary oil well applications. The connectors at either end are joined by conduits 524. Here, the bellows 208 bellows/accumulator system 508 is similar to bellows 208 shown in connection with other embodiments. Dielectric fluid 226 is introduced into an internal passageway 540 (which interacts with bellows as described before) to provide additional fluid compensation around the seal area above what is already provided by the existing seals.

While the apparatus and methods of this invention have been described in terms of preferred embodiments, it will be apparent to those of skill in the art that variations may be applied to the process and system described herein without departing from the concept and scope of the invention. All such similar substitutes and modifications apparent to those skilled in the art are deemed to be within the scope and concept of the invention. Those skilled in the art will recognize that the method and apparatus of the present invention has many applications, and that the present invention is not limited to the representative examples disclosed herein. Moreover, the scope of the present invention covers conventionally known variations and modifications to the system components described herein, as would be known by those skilled in the art. While the apparatus and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

We claim:

1. A fluid compensated downhole electrical connection system for use in an oil and gas well to provide electrical power through a downhole power cable to a desired downhole device through one or more downhole power lead electrical conduits, the fluid compensated downhole electrical connection system comprising:

a. a first connector member having a first housing with a first internal chamber, the first housing having a first end for connecting to the one or more downhole power lead electrical conduits at a terminal end of a section of the downhole power cable and a second end comprising female electrical sockets capable of receiving male pin connectors to permit transmission of electrical power through the connection system, the female electrical sockets having electrically insulated electrical contacts located within the first internal chamber;

b. a second connector member having a second housing with a second internal chamber, the second housing having a first end for electrically connecting to the first connector member housing second end, and a second connector member housing second end for connecting to one or more downhole power lead electrical conduits leading to the desired downhole device, the second connector housing first end further comprising the male pin connectors located within the second internal chamber, the second internal chamber capable of being charged with a dielectric fluid prior to use;

c. a dielectric fluid port in fluid communication with the second internal chamber for introducing the dielectric fluid into just the second internal chamber prior to use, the dielectric fluid creating an internal fluid pressure greater than an ambient external pressure within the second internal chamber when the first connector member is electrically connected to the second connector member, wherein when the first connector member is electrically connected to the second connector member, the second internal chamber and the first internal chamber interact in fluid communication with each other, the second internal chamber and the first internal chamber defining a fluid flow path, thereby permitting the dielectric fluid in the second internal chamber to also be urged into the first internal chamber thereby filling the fluid flow path with the dielectric fluid; and d. a pressure balancing device having first and second ends, and an interior annular chamber, the pressure balancing device first end being connected to the second connector member in fluid communication with the second internal chamber, the pressure balancing device second end being exposed to downhole wellbore fluid pressure and capable of reacting to the wellbore pressure to cause the pressure balancing device to provide a compensating adjustment to the internal fluid pressure within the fluid flow path.

2. The fluid compensated downhole electrical connection system of claim 1 further comprising check valves.

3. The fluid compensated downhole electrical connection system of claim 1 installed in a retrievable wet connect system.

4. The fluid compensated downhole electrical connection system of claim 3, wherein said retrievable wet connect system comprises:

a. a tubular member having a first threaded end, a second threaded end, and an inner bore in fluid communication with the wellbore fluid pressure;

b. the tubular member first threaded end further comprising a high pressure bulkhead electrical connector capable of permitting the introduction of the electrical power to the desired device, c. the tubular member second threaded end comprising a threaded connection;

d. one or more fluid compensated downhole connection system cylindrical electrical conduits each having an internal annular space surrounding a single electrical wire/cable, a first fluid compensated conduit end and a second fluid compensated conduit end, the first fluid compensated conduit end being connected to the second connector member housing second end to establish electrical connection between the one or more downhole power lead electrical conduits and the respective one or more fluid compensated downhole connection system cylindrical electrical conduits when so connected, the second fluid compensated conduit end terminating at a female wet connect assembly, and e. wherein the female wet connect assembly is located proximate the tubular member second threaded end, the wet connect assembly comprising a wet connect housing having a wet connect housing internal chamber; the second fluid compensated conduit end being connected to the wet connect housing; female electrical sockets mounted to an end of the wet connect housing and being capable of receiving other male pin connectors to permit transmission of electrical power through the connection system to another section of wellbore tubing; the wet connect female electrical sockets having electrically insulated electrical contacts located within the wet connect housing internal chamber, wherein the fluid flow path further comprises the internal annular space of the one or more fluid compensated downhole connection system cylindrical electrical conduits and the wet connect housing internal chamber.

5. The fluid compensated downhole electrical connection system of claim 1 wherein the dielectric fluid internal fluid pressure is up to 15 psi greater than the ambient external pressure.

6. The fluid compensated downhole electrical connection system of claim 5 wherein the dielectric fluid internal fluid pressure is 7-14 psi greater than the ambient external pressure.

7. The fluid compensated downhole electrical connection system of claim 1 wherein the desired downhole device is a wet mate connector.

8. The permanent downhole fluid compensated electrical connector assembly of claim 1 wherein the pressure balance device is selected from the group consisting of a piston and a bellows.

9. A permanent downhole fluid compensated electrical connector assembly for use in an oil and gas well to connect to a downhole power lead connector located within a terminal end of a section of a downhole power lead providing electrical power via one or more downhole power lead electrical conduits, the fluid compensated downhole connection system comprising a. a field connector receptacle at a first assembly end, the field connector receptacle having a housing with a first internal chamber, the field connector receptacle capable of being electrically connected to the one or more downhole power lead electrical conduits;

b. a wet connector receptacle at a second assembly end, the wet connector receptacle having a housing with a second internal chamber, the wet connector receptacle capable of being electrically connected to a desired device;

c. one or more permanent downhole fluid compensated electrical connector assembly cylindrical electrical conduits each having an internal annular space surrounding a single electrical wire/cable, a first conduit end and a second conduit end, the first conduit end being connected to the field connector receptacle housing to establish electrical connection between the one or more downhole power lead electrical conduits and the respective one or more permanent downhole fluid compensated electrical connector assembly cylindrical electrical conduits when so connected, the second conduit end being connected to the wet connector receptacle housing to establish electrical connection between the one or more permanent downhole fluid compensated electrical connector assembly cylindrical electrical conduits and the desired device when so connected, wherein the permanent downhole fluid compensated electrical connector assembly cylindrical electrical conduit annular space between the first and second conduit ends, the field connector receptacle first internal chamber and the wet connector receptacle second internal chamber are in fluid communication with each other defining a fluid compensated downhole connection system fluid flow path independent of the one or more downhole power lead electrical conduits;

d. a dielectric fluid port in fluid communication with the fluid compensated downhole connection system fluid flow path for introducing an intensified dielectric fluid into just the fluid compensated downhole connection system fluid flow path prior to use, the intensified dielectric fluid creating an internal fluid pressure within the fluid compensated downhole connection system fluid flow path that is greater than an ambient pressure external to the fluid compensated downhole connection system; and e. a pressure balancing device having first and second ends, and an interior annular chamber, the pressure balancing device first end being connected to the wet connector receptacle, the pressure balancing device second end being exposed to downhole wellbore fluid pressure and capable of reacting to the wellbore pressure to cause the pressure balancing device to provide a compensating adjustment to the internal fluid pressure within the fluid compensated downhole connection system fluid flow path.

10. The permanent downhole electrical connector assembly of claim 9 installed in a permanent completion portion of production tubing.

11. The permanent downhole electrical connector assembly of claim 9 further comprising a separate pressure balancing device for each of the one or more cylindrical electrical conduits.

12. The permanent downhole fluid compensated electrical connector assembly of claim 9 wherein the intensified dielectric fluid internal fluid pressure is up to 15 psi greater than the ambient external pressure.

13. The permanent downhole fluid compensated electrical connector assembly of claim 12 wherein the intensified dielectric fluid internal fluid pressure is 7-14 psi greater than the ambient external pressure.

14. The permanent downhole fluid compensated electrical connector assembly of claim 9 wherein the pressure balance device is selected from the group consisting of a piston and a bellows.

15. A field bypass electrical connector system having upper and lower connection ends for use in an oil and gas well to provide electrical power to a downhole completion tool through one or more downhole electrical conduits, the field bypass electrical connector system comprising:

a. a downhole completion tool mounted on a production tubular member, the downhole completion tool having an internal feedthrough passage;

b. a first clamp field connector plug mountable on the production tubular member at a position along the production tubular member in the direction uphole from the downhole completion tool proximate the upper connection end, the first clamp field connector plug having a housing with a first internal chamber, the position of the first clamp field connector plug being axially and rotationally adjustable when being mounted on the production tubular member the first clamp field connector plug capable of receiving the electrical power from an uphole location via the one or more downhole electrical conduits;

c. a first clamp field connector receptacle mounted on the production tubular member at a position along the production tubular member below and proximate the first clamp field connector plug and above the downhole completion tool, the first clamp field connector receptacle having a housing with a second internal chamber, the position of the clamp-field connector receptacle being axially and rotationally adjustable when being mounted on the production tubular member, the first clamp-field connector plug and the first clamp field connector receptacle capable of being electrically connected to each other;

d. a second clamp field connector plug mountable on the production tubular member at a position along the production tubular member in the direction downhole from the downhole completion tool proximate the lower connection end, the second clamp field connector plug having a housing with a third internal chamber, the position of the second clamp field connector plug being axially and rotationally adjustable when being mounted on the production tubular member, the second clamp field connector plug capable of receiving the electrical power;

e. a second clamp field connector receptacle mounted on the production tubular member at a position along the production tubular member in the direction downhole from the downhole completion tool and proximate the second clamp field connector plug, the second clamp-type field connector receptacle having a housing with a fourth internal chamber, the position of the second clamp field connector receptacle being axially and rotationally adjustable when being mounted on the production tubular member, the second clamp field connector plug and the second clamp field connector receptacle capable of being electrically connected to each other;

f. one or more bypass connection electrical conduits having a first conduit end and a second conduit end, the first conduit end being connected to the first clamp field connector receptacle, the second conduit end being connected to the second clamp field connector plug, the one or more conduits passing through the feedthrough passage, wherein the first internal chamber and second internal chamber are in fluid communication with each other defining a first fluid flow path when connected, wherein the third internal chamber and the fourth internal chamber are in fluid communication with each other defining a second fluid flow path when connected;

g. a first dielectric fluid port in fluid communication with the first fluid flow path for introducing an intensified first dielectric fluid solely into the first fluid flow path, the intensified first dielectric fluid creating an internal fluid pressure in the first fluid flow path greater than an ambient external pressure;

h. a second dielectric fluid port in fluid communication with the second fluid flow path for introducing an intensified second dielectric fluid solely into the second fluid flow path, the intensified second dielectric fluid creating an internal fluid pressure in the second fluid flow path greater than the ambient external pressure;

i. a first pressure balancing device having first and second ends, and an interior annular chamber, the first end of the first pressure balancing device being connected to the housing of the first clamp field connector plug in fluid communication with the first clamp field connector plug housing internal chamber, the second end of the first pressure balancing device being exposed to downhole wellbore fluid pressure and capable of reacting to the wellbore pressure to cause the first pressure balancing device to provide a compensating adjustment to the internal fluid pressure in the first fluid flow path; and j. a second pressure balancing device having first and second ends, and an interior annular chamber, the first end of the second pressure balancing device being connected to the housing of the second clamp field connector plug in fluid communication with the second clamp field connector plug housing internal chamber, the second end of the second pressure balancing device being exposed to downhole wellbore fluid pressure and capable of reacting to the wellbore pressure to cause the second pressure balancing device to provide a compensating adjustment to the internal fluid pressure in the second fluid flow path, wherein when the first clamp field connector plug and the first clamp-field connector receptacle are electrically connected to each other, the intensified first dielectric fluid occupies and is confined to the first internal chamber and the second internal chamber, and wherein when the second clamp field connector plug and the second clamp field connector receptacle are electrically connected to each other, the intensified second dielectric fluid occupies and is confined to the third internal chamber and the fourth internal chamber.

16. The field bypass connector system of claim 15 wherein the downhole completion tool is a packer.

17. The field bypass connector system for a downhole completion tool of claim 15 wherein the intensified dielectric fluid internal fluid pressure is up to 15 psi greater than the ambient external pressure.

18. The field bypass connector system for a downhole completion tool of claim 17 wherein the intensified dielectric fluid internal fluid pressure is 7-14 psi greater than the ambient external pressure.

19. The permanent downhole fluid compensated electrical connector assembly of claim 15 wherein the first pressure balance device and the second pressure balance device are selected from the group consisting of a piston and a bellows.

20. A field bypass electrical connector system having upper and lower connection ends for use in an oil and gas well to provide electrical power to a downhole completion tool through one or more downhole electrical conduits, the field bypass electrical connector system comprising:

a. the downhole completion tool mounted on a production tubular member, the downhole completion tool having an internal feedthrough passage;

b. a first clamp field connector mountable on the production tubular member at a position along the production tubular member in the direction uphole from the downhole completion tool, the first clamp field connector having a first clamp field connector housing with a first internal chamber, the position of the first clamp-type field connector plug being axially and rotationally adjustable when being mounted on the production tubular member;

c. a second clamp field connector mounted on the production tubular member at a position along the production tubular member in the direction downhole from the downhole completion tool, the second clamp field connector having a second clamp field connector housing with a second internal chamber, the position of the second clamp field connector being axially and rotationally adjustable when being mounted on the production tubular member;

d. two or more cylindrical electrical conduits having a first conduit end and a second conduit end, the first conduit end being connected to the first clamp-field connector, the second conduit end being connected to the second clamp field connector, the two or more cylindrical electrical conduits passing through the internal feedthrough passage;

e. a first dielectric fluid port in fluid communication with the first internal chamber for introducing an intensified first dielectric fluid into the first chamber, the intensified dielectric fluid creating an internal fluid pressure higher than an ambient external pressure; and f. a second dielectric fluid port in fluid communication with the second internal chamber for introducing an intensified second dielectric fluid into the second chamber, the intensified dielectric fluid creating an internal fluid pressure greater than the ambient external pressure wherein the first clamp field connector is pre-charged with the intensified first dielectric fluid and is further capable of being electrically connected to the one or more downhole electrical conduits with a first mated connection, the first mated connection having a first mated connection internal chamber capable of receiving from and sharing solely with the first chamber, in fluid communication, the intensified first dielectric fluid when so electrically connected, and wherein the second clamp field connector is pre-charged with the intensified second dielectric fluid and is further capable of being electrically connected to a second mated connection, the second mated connection having a second mated connection internal chamber capable of receiving from and sharing solely with the second chamber, in fluid communication, the intensified second dielectric fluid when so electrically connected.

21. The field bypass connector system of claim 20 further comprising a first pressure balancing device having first and second ends, and an interior annular chamber, the first end of the first pressure balancing device being connected to the housing of the first clamp field connector housing in fluid communication with the first internal chamber, the second end of the first pressure balancing device being exposed to downhole wellbore fluid pressure and capable of reacting to the wellbore pressure to cause the first pressure balancing device to provide a compensating adjustment to the internal fluid pressure of the first internal chamber, and a second pressure balancing device having first and second ends, and an interior annular chamber, the first end of the second pressure balancing device being connected to the housing of the second clamp field connector in fluid communication with the second internal chamber, the second end of the second pressure balancing device being exposed to downhole wellbore fluid pressure and capable of reacting to the wellbore pressure to cause the second pressure balancing device to provide a compensating adjustment to the internal fluid pressure in the second internal chamber.

22. The permanent downhole fluid compensated electrical connector assembly of claim 21 wherein the first pressure balance device and the second pressure balance device are selected from the group consisting of a piston and a bellows.

23. The field bypass connector system for a downhole completion tool of claim 20 wherein the intensified first dielectric fluid in the first chamber and the intensified second dielectric fluid in the second chamber is up to 15 psi greater than the ambient external pressure.

24. The field bypass connector system for a downhole completion tool of claim 23 wherein the intensified first dielectric fluid in the first chamber and the intensified second dielectric fluid in the second chamber is 7-14 psi greater than the ambient external pressure.

* * * * *